US009375617B2

(12) United States Patent
Boyd et al.

(10) Patent No.: US 9,375,617 B2
(45) **Date of Patent: *Jun. 28, 2016**

(54) GOLF CLUB ASSEMBLY AND GOLF CLUB WITH AERODYNAMIC FEATURES

(71) Applicant: NIKE, Inc., Beaverton, OR (US)

(72) Inventors: Robert Boyd, Euless, TX (US); John Thomas Stites, Weatherford, TX (US); Gary G. Tavares, Southbridge, MA (US)

(73) Assignee: NIKE, Inc, Beaverton, OR (US)

( * ) Notice: Subject to any disclaimer, the term of this patent is extended or adjusted under 35 U.S.C. 154(b) by 12 days.

This patent is subject to a terminal disclaimer.

(21) Appl. No.: 14/473,348

(22) Filed: Aug. 29, 2014

(65) Prior Publication Data

US 2014/0371001 A1 Dec. 18, 2014

Related U.S. Application Data

(63) Continuation of application No. 12/945,363, filed on Nov. 12, 2010, now Pat. No. 8,821,309, which is a continuation-in-part of application No. 12/779,669, filed on May 13, 2010, now Pat. No. 8,366,565, which (Continued)

(51) Int. Cl.
*A63B 53/04* (2015.01)

(52) U.S. Cl.
CPC ..... *A63B 53/0466* (2013.01); *A63B 2053/0408* (2013.01); *A63B 2053/0433* (2013.01); *A63B 2225/01* (2013.01)

(58) Field of Classification Search
CPC ..... A63B 53/0466; A63B 2053/0408; A63B 2053/0433; A63B 2225/01
USPC ..... 473/324–350, 287–292; D21/733, 752, D21/759
See application file for complete search history.

(56) References Cited

U.S. PATENT DOCUMENTS 1,396,470 A 11/1921 Taylor
1,587,758 A 6/1926 Charavay (Continued)

FOREIGN PATENT DOCUMENTS

GB 2212402 A 7/1989
GB 2310379 A 8/1997

(Continued)

OTHER PUBLICATIONS

Achenbach, James; Pros Test New Nike Driver; Golfweek, Oct. 3, 2009; http://www.golfweek.com/news/2009/oct/12/pros-test-new-nike-drivers/.

(Continued)

*Primary Examiner* — Sebastiano Passaniti
(74) *Attorney, Agent, or Firm* — Banner & Witcoff, Ltd.

(57) ABSTRACT

A golf club head may include a body member having a ball striking face, a crown, a toe, a heel, a sole, a back, and a hosel region located at the intersection of the ball striking face, the heel, the crown and the sole. The crown may have a relatively round rear-side edge profile, as viewed from above. The sole may have a relatively square rear-side edge profile, as viewed from below. The rear-side edge of the sole may extend rearwardly beyond the rear-side edge of the crown along at least a portion of the back, as viewed from above. Further, the heel may have an airfoil-like surface in the forward portion of the heel. A golf club including the golf club head is also provided.

23 Claims, 27 Drawing Sheets

Related U.S. Application Data is a continuation-in-part of application No. 12/465,164, filed on May 13, 2009, now Pat. No. 8,162,775.

(60) Provisional application No. 61/298,742, filed on Jan. 27, 2010.

(56) References Cited

U.S. PATENT DOCUMENTS

| | | | |
|---|---|---|---|
| 1,671,956 | A | 5/1928 | Sime |
| D92,266 | S | 5/1934 | Nicoll et al. |
| 2,051,083 | A | 8/1936 | Hart |
| 2,083,189 | A | 6/1937 | Crooker |
| 2,098,445 | A | 11/1937 | Wettlaufer |
| D164,596 | S | 9/1951 | Penna |
| 2,592,013 | A | 4/1952 | Curley |
| 2,644,890 | A | 7/1953 | Hollihan |
| 2,998,254 | A | 8/1961 | Rains et al. |
| D192,515 | S | 4/1962 | Henrich |
| 3,037,775 | A | 6/1962 | Busch |
| 3,468,544 | A | 9/1969 | Antonious |
| D225,123 | S | 11/1972 | Viero et al. |
| 3,794,328 | A | 2/1974 | Gordon |
| 3,845,960 | A | 11/1974 | Thompson |
| 3,951,413 | A | 4/1976 | Bilyeu |
| D239,964 | S | 5/1976 | Wilson |
| 3,976,299 | A | 8/1976 | Lawrence et al. |
| 3,979,122 | A | 9/1976 | Belmont |
| 3,993,314 | A | 11/1976 | Harrington et al. |
| D243,706 | S | 3/1977 | Hall |
| 4,021,047 | A | 5/1977 | Mader |
| D247,824 | S | 5/1978 | Meissler |
| 4,283,057 | A | 8/1981 | Ragan |
| 4,444,392 | A | 4/1984 | Duclos |
| 4,461,481 | A | 7/1984 | Kim |
| D275,412 | S | 9/1984 | Simmons |
| D275,590 | S | 9/1984 | Duclos |
| 4,541,631 | A | 9/1985 | Sasse |
| 4,630,827 | A | 12/1986 | Yoneyama |
| 4,635,375 | A | 1/1987 | Tarcsafalvi |
| 4,653,756 | A | 3/1987 | Sato |
| 4,655,458 | A | 4/1987 | Lewandowski |
| 4,754,974 | A | 7/1988 | Kobayashi |
| D298,643 | S | 11/1988 | Mitsui |
| 4,809,982 | A | 3/1989 | Kobayashi |
| 4,850,593 | A | 7/1989 | Nelson |
| 4,874,171 | A | 10/1989 | Ezaki et al. |
| D307,783 | S | 5/1990 | Iinuma |
| 4,930,783 | A | 6/1990 | Antonious |
| D310,254 | S | 8/1990 | Take et al. |
| 4,951,953 | A | 8/1990 | Kim |
| 4,957,468 | A | 9/1990 | Otsuka et al. |
| 4,969,921 | A | 11/1990 | Silvera |
| 5,013,041 | A | 5/1991 | Sun et al. |
| 5,048,834 | A | 9/1991 | Gorman |
| 5,048,835 | A | 9/1991 | Gorman |
| 5,054,784 | A | 10/1991 | Collins |
| 5,074,563 | A | 12/1991 | Gorman |
| 5,082,279 | A | 1/1992 | Hull et al. |
| D325,324 | S | 4/1992 | Kahl |
| D326,130 | S | 5/1992 | Chorne |
| D326,885 | S | 6/1992 | Paul |
| D326,886 | S | 6/1992 | Sun et al. |
| 5,120,061 | A | 6/1992 | Tsuchida et al. |
| D329,904 | S | 9/1992 | Gorman |
| 5,149,091 | A | 9/1992 | Okumoto et al. |
| 5,158,296 | A | 10/1992 | Lee |
| 5,190,289 | A | 3/1993 | Nagai et al. |
| 5,193,810 | A | 3/1993 | Antonious |
| 5,195,747 | A | 3/1993 | Choy |
| 5,203,565 | A | 4/1993 | Murray et al. |
| 5,221,086 | A | 6/1993 | Antonious |
| 5,230,510 | A | 7/1993 | Duclos |
| 5,240,252 | A | 8/1993 | Schmidt et al. |
| 5,244,210 | A | 9/1993 | Au |
| D340,493 | S | 10/1993 | Murray et al. |
| 5,271,622 | A | 12/1993 | Rogerson |
| 5,280,923 | A | 1/1994 | Lu |
| D345,403 | S | 3/1994 | Sanchez |
| 5,295,689 | A | 3/1994 | Lundberg |
| 5,318,297 | A | 6/1994 | Davis et al. |
| 5,318,300 | A | 6/1994 | Schmidt et al. |
| D349,934 | S | 8/1994 | Feche et al. |
| D350,176 | S | 8/1994 | Antonious |
| D350,580 | S | 9/1994 | Allen |
| D351,441 | S | 10/1994 | Iinuma et al. |
| D352,324 | S | 11/1994 | Sicaeros |
| 5,366,222 | A | 11/1994 | Lee |
| D354,782 | S | 1/1995 | Gonzalez, Jr. |
| 5,401,021 | A | 3/1995 | Allen |
| 5,411,255 | A | 5/1995 | Kurashima et al. |
| 5,411,264 | A | 5/1995 | Oku |
| 5,423,535 | A | 6/1995 | Shaw et al. |
| 5,435,558 | A | 7/1995 | Iriarte |
| D362,039 | S | 9/1995 | Lin |
| 5,451,056 | A | 9/1995 | Manning |
| D363,750 | S | 10/1995 | Reed |
| 5,456,469 | A | 10/1995 | MacDougall |
| 5,464,217 | A | 11/1995 | Shenoha et al. |
| 5,465,970 | A | 11/1995 | Adams et al. |
| 5,467,989 | A | 11/1995 | Good et al. |
| 5,478,075 | A | 12/1995 | Saia et al. |
| 5,486,000 | A | 1/1996 | Chorne |
| 5,497,995 | A | 3/1996 | Swisshelm |
| 5,505,448 | A | 4/1996 | Park |
| 5,511,786 | A | 4/1996 | Antonious |
| 5,511,788 | A | 4/1996 | Manley et al. |
| 5,518,240 | A | 5/1996 | Igarashi |
| 5,524,890 | A | 6/1996 | Kim et al. |
| 5,529,303 | A | 6/1996 | Chen |
| D371,407 | S | 7/1996 | Ritchie et al. |
| 5,544,884 | A | 8/1996 | Hardman |
| 5,547,194 | A | 8/1996 | Aizawa et al. |
| 5,575,722 | A | 11/1996 | Saia et al. |
| 5,575,725 | A | 11/1996 | Olsavsky |
| 5,580,321 | A | 12/1996 | Rennhack |
| 5,584,770 | A | 12/1996 | Jensen |
| 5,590,875 | A | 1/1997 | Young |
| 5,601,498 | A | 2/1997 | Antonious |
| D379,390 | S | 5/1997 | Watanabe et al. |
| 5,628,697 | A | 5/1997 | Gamble |
| 5,632,691 | A | 5/1997 | Hannon et al. |
| 5,632,695 | A | 5/1997 | Hlinka et al. |
| 5,643,103 | A | 7/1997 | Aizawa |
| 5,643,107 | A | 7/1997 | Gorman |
| 5,665,014 | A | 9/1997 | Sanford et al. |
| 5,681,227 | A | 10/1997 | Sayrizi |
| 5,688,189 | A | 11/1997 | Bland |
| 5,697,855 | A | 12/1997 | Aizawa |
| 5,700,208 | A | 12/1997 | Nelms |
| D389,886 | S | 1/1998 | Kulchar et al. |
| D390,616 | S | 2/1998 | Maltby |
| 5,720,674 | A | 2/1998 | Galy |
| 5,735,754 | A | 4/1998 | Antonious |
| 5,776,009 | A | 7/1998 | McAtee |
| 5,785,609 | A | 7/1998 | Sheets et al. |
| 5,788,584 | A | 8/1998 | Parente et al. |
| D398,681 | S | 9/1998 | Galy |
| 5,803,829 | A | 9/1998 | Hayashi |
| 5,803,830 | A | 9/1998 | Austin et al. |
| 5,807,187 | A | 9/1998 | Hamm |
| D399,279 | S | 10/1998 | Jackson |
| 5,833,551 | A | 11/1998 | Vincent et al. |
| 5,839,975 | A | 11/1998 | Lundberg |
| 5,873,791 | A | 2/1999 | Allen |
| 5,873,793 | A | 2/1999 | Swinford |
| 5,885,170 | A | 3/1999 | Takeda |
| 5,899,818 | A | 5/1999 | Zider et al. |
| 5,908,357 | A | 6/1999 | Hsieh |
| 5,913,733 | A | 6/1999 | Bamber |
| 5,921,870 | A | 7/1999 | Chiasson |
| 5,931,742 | A | 8/1999 | Nishimura et al. |
| 5,938,540 | A | 8/1999 | Lu |
| 5,941,782 | A | 8/1999 | Cook |
| 5,954,595 | A | 9/1999 | Antonious |

(56) References Cited

U.S. PATENT DOCUMENTS 5,961,397 A 10/1999 Lu et al.
5,967,903 A 10/1999 Cheng
5,976,033 A 11/1999 Takeda
5,980,394 A 11/1999 Domas
5,997,413 A 12/1999 Wood, IV
5,997,415 A 12/1999 Wood
6,017,280 A 1/2000 Hubert
6,027,414 A 2/2000 Koebler
6,027,415 A 2/2000 Takeda
D421,472 S 3/2000 Peterson
D422,659 S 4/2000 Mertens
6,059,669 A 5/2000 Pearce
6,074,308 A 6/2000 Domas
6,077,171 A 6/2000 Yoneyama
6,123,627 A 9/2000 Antonious
6,149,534 A 11/2000 Peters et al.
6,165,080 A 12/2000 Salisbury
D436,149 S 1/2001 Helmstetter et al.
6,251,028 B1 6/2001 Jackson
6,277,032 B1 8/2001 Smith
D447,783 S 9/2001 Glod
6,296,576 B1 10/2001 Capelli
6,302,813 B1 10/2001 Sturgeon et al.
6,319,148 B1 11/2001 Tom
D454,606 S 3/2002 Helmstetter et al.
6,368,234 B1 4/2002 Galloway
6,379,262 B1 4/2002 Boone
6,422,951 B1 7/2002 Burrows
6,471,603 B1 10/2002 Kosmatka
6,471,604 B2 10/2002 Hocknell et al.
6,482,106 B2 11/2002 Saso
D470,202 S 2/2003 Tunno
6,530,847 B1 3/2003 Antonious
6,558,271 B1 5/2003 Beach et al.
6,561,922 B2 5/2003 Bamber
6,569,029 B1 5/2003 Hamburger
6,572,489 B2 6/2003 Miyamoto et al.
6,575,845 B2 6/2003 Galloway et al.
6,575,854 B1 6/2003 Yang et al.
6,609,981 B2 8/2003 Hirata
6,623,378 B2 9/2003 Beach et al.
D481,430 S 10/2003 Tunno
6,641,490 B2 11/2003 Ellemor
6,716,114 B2 4/2004 Nishio
6,733,359 B1 5/2004 Jacobs
6,739,983 B2 5/2004 Helmstetter et al.
6,773,359 B1 8/2004 Lee
6,776,725 B1 8/2004 Miura et al.
D498,507 S 11/2004 Gamble
D498,508 S 11/2004 Antonious
D499,155 S 11/2004 Imamoto
6,824,474 B1 11/2004 Thill
6,825,315 B2 11/2004 Aubert
D502,232 S 2/2005 Antonious
6,855,068 B2 2/2005 Antonious
D502,751 S 3/2005 Lukasiewicz
6,860,818 B2 3/2005 Mahaffey et al.
6,890,267 B2 5/2005 Mahaffey et al.
6,929,563 B2 8/2005 Nishitani
D509,869 S 9/2005 Mahaffey
D515,642 S 2/2006 Antonious
D515,643 S 2/2006 Ortiz
7,025,692 B2 4/2006 Erickson et al.
7,121,956 B2 10/2006 Lo
7,128,662 B2 10/2006 Kumamoto
7,128,664 B2 10/2006 Onoda et al.
7,147,580 B2 12/2006 Nutter et al.
7,163,468 B2 1/2007 Gibbs et al.
7,175,541 B2 2/2007 Lo
7,261,641 B2 8/2007 Lindner
D564,611 S 3/2008 Llewellyn et al.
7,351,161 B2 4/2008 Beach
7,390,266 B2 6/2008 Gwon
7,390,271 B2 6/2008 Yamamoto
7,481,716 B1 1/2009 Johnson
D589,107 S 3/2009 Oldknow
D589,576 S 3/2009 Kadoya
7,500,924 B2 3/2009 Yokota
7,524,249 B2 4/2009 Breier et al.
D592,714 S 5/2009 Lee
7,559,854 B2 7/2009 Harvell et al.
D598,510 S 8/2009 Barez et al.
7,568,985 B2 8/2009 Beach et al.
7,578,754 B2 8/2009 Nakamura
7,601,078 B2 10/2009 Mergy et al.
D606,144 S 12/2009 Kim et al.
D608,850 S 1/2010 Oldknow
7,641,568 B2 1/2010 Hoffman et al.
D609,296 S 2/2010 Oldknow
D609,297 S 2/2010 Oldknow
D609,300 S 2/2010 Oldknow
D609,764 S 2/2010 Oldknow
7,658,686 B2 2/2010 Soracco
7,682,264 B2 3/2010 Hsu et al.
7,682,267 B2 3/2010 Libonati
7,699,718 B2 4/2010 Lindner
7,704,160 B2 4/2010 Lindner
7,704,161 B2 4/2010 Lindner
7,713,138 B2 5/2010 Sato et al.
7,717,807 B2 5/2010 Evans et al.
7,803,065 B2 9/2010 Breier et al.
7,922,595 B2 4/2011 Libonati
8,062,151 B2 * 11/2011 Boyd ..... A63B 53/0466 473/334
8,133,135 B2 3/2012 Stites et al.
D657,838 S 4/2012 Oldknow
D658,252 S 4/2012 Oldknow
8,162,775 B2 4/2012 Tavares et al.
D659,781 S 5/2012 Oldknow
D659,782 S 5/2012 Oldknow
D660,931 S 5/2012 Oldknow
8,177,658 B1 5/2012 Johnson
8,177,659 B1 5/2012 Ehlers
8,182,364 B2 5/2012 Cole et al.
8,221,260 B2 7/2012 Stites et al.
8,226,501 B2 * 7/2012 Stites ..... A63B 53/0466 473/328
8,353,784 B2 1/2013 Boyd et al.
8,366,565 B2 2/2013 Tavares et al.
8,398,505 B2 3/2013 Tavares et al.
8,444,502 B2 5/2013 Karube
8,485,917 B2 7/2013 Tavares et al.
8,678,946 B2 3/2014 Boyd et al.
8,753,224 B1 * 6/2014 Kim ..... A63B 53/0466 473/327
8,821,309 B2 * 9/2014 Boyd ..... A63B 53/0466 473/305
2001/0001774 A1 5/2001 Antonious
2001/0027139 A1 10/2001 Saso
2002/0072433 A1 6/2002 Galloway et al.
2002/0077194 A1 6/2002 Carr et al.
2002/0077195 A1 6/2002 Carr et al.
2002/0082108 A1 6/2002 Peters et al.
2002/0121031 A1 9/2002 Smith et al.
2003/0017884 A1 1/2003 Masters et al.
2003/0087710 A1 5/2003 Sheets et al.
2003/0087719 A1 5/2003 Usoro et al.
2003/0157995 A1 8/2003 Mahaffey
2003/0220154 A1 11/2003 Anelli
2003/0232659 A1 12/2003 Mahaffey et al.
2003/0236131 A1 12/2003 Burrows
2004/0009824 A1 1/2004 Shaw
2004/0009829 A1 1/2004 Kapilow
2004/0018891 A1 1/2004 Antonious
2004/0138002 A1 7/2004 Murray
2004/0157678 A1 8/2004 Kohno
2004/0229713 A1 11/2004 Helmstetter et al.
2005/0009622 A1 1/2005 Antonious
2005/0020379 A1 1/2005 Kumamoto
2005/0026723 A1 2/2005 Kumamoto
2005/0032584 A1 2/2005 Van Nimwegen
2005/0049073 A1 3/2005 Herber
2005/0054459 A1 3/2005 Oldenburg
2005/0107183 A1 5/2005 Takeda et al.

(56) References Cited

U.S. PATENT DOCUMENTS

| | | | |
|---|---|---|---|
| 2005/0119068 | A1 | 6/2005 | Onoda et al. |
| 2005/0153798 | A1 | 7/2005 | Rigoli |
| 2005/0153799 | A1 | 7/2005 | Rigoli |
| 2005/0215350 | A1 | 9/2005 | Reyes et al. |
| 2005/0221914 | A1 | 10/2005 | Ezaki et al. |
| 2005/0221915 | A1 | 10/2005 | De Shiell et al. |
| 2005/0233831 | A1 | 10/2005 | Ezaki et al. |
| 2005/0245329 | A1 | 11/2005 | Nishitani et al. |
| 2005/0250594 | A1 | 11/2005 | Nishitani et al. |
| 2005/0261079 | A1 | 11/2005 | Qualizza |
| 2006/0000528 | A1 | 1/2006 | Galloway |
| 2006/0014588 | A1 | 1/2006 | Page |
| 2006/0054438 | A1 | 3/2006 | Asaba et al. |
| 2006/0079349 | A1 | 4/2006 | Rae et al. |
| 2006/0148588 | A1 | 7/2006 | Gibbs et al. |
| 2006/0252576 | A1 | 11/2006 | Lo |
| 2006/0281582 | A1 | 12/2006 | Sugimoto |
| 2006/0293114 | A1 | 12/2006 | Chen |
| 2006/0293120 | A1 | 12/2006 | Cackett et al. |
| 2007/0026965 | A1 | 2/2007 | Huang |
| 2007/0049407 | A1 | 3/2007 | Tateno et al. |
| 2007/0093315 | A1 | 4/2007 | Kang |
| 2007/0149310 | A1 | 6/2007 | Bennett et al. |
| 2007/0161433 | A1 | 7/2007 | Yokota |
| 2007/0293341 | A1 | 12/2007 | Jeong |
| 2008/0009364 | A1 | 1/2008 | Chen |
| 2008/0039228 | A1 | 2/2008 | Breier et al. |
| 2008/0102985 | A1 | 5/2008 | Chen |
| 2008/0113825 | A1 | 5/2008 | Funayama et al. |
| 2008/0139339 | A1 | 6/2008 | Cheng |
| 2008/0146374 | A1 | 6/2008 | Beach et al. |
| 2008/0188320 | A1 | 8/2008 | Kamatari |
| 2008/0242444 | A1 | 10/2008 | Park et al. |
| 2009/0048035 | A1 | 2/2009 | Stites et al. |
| 2009/0075751 | A1 | 3/2009 | Gilbert et al. |
| 2009/0082135 | A1 | 3/2009 | Evans et al. |
| 2009/0098949 | A1 | 4/2009 | Chen |
| 2009/0124410 | A1 | 5/2009 | Rife |
| 2009/0149276 | A1 | 6/2009 | Golden et al. |
| 2009/0203465 | A1 | 8/2009 | Stites et al. |
| 2009/0239681 | A1 | 9/2009 | Sugimoto |
| 2009/0286618 | A1 | 11/2009 | Beach et al. |
| 2010/0022325 | A1 | 1/2010 | Doran |
| 2010/0041490 | A1 | 2/2010 | Boyd et al. |
| 2010/0056298 | A1 | 3/2010 | Jertson et al. |
| 2010/0105498 | A1 | 4/2010 | Johnson |
| 2010/0184526 | A1 | 7/2010 | Park |
| 2010/0234126 | A1 | 9/2010 | Cackett et al. |
| 2010/0292020 | A1 | 11/2010 | Tavares et al. |
| 2010/0311517 | A1 | 12/2010 | Tavares et al. |
| 2011/0009209 | A1 | 1/2011 | Llewellyn et al. |
| 2011/0118051 | A1 | 5/2011 | Thomas |
| 2011/0136584 | A1 | 6/2011 | Boyd et al. |
| 2011/0281663 | A1 | 11/2011 | Stites et al. |
| 2011/0281664 | A1 | 11/2011 | Boyd et al. |
| 2012/0142452 | A1 | 6/2012 | Burnett et al. |
| 2012/0149494 | A1 | 6/2012 | Takahashi et al. |
| 2012/0178548 | A1 | 7/2012 | Tavares et al. |
| 2012/0196701 | A1 | 8/2012 | Stites et al. |
| 2012/0252597 | A1 | 10/2012 | Thomas |
| 2012/0277026 | A1 | 11/2012 | Tavares et al. |

FOREIGN PATENT DOCUMENTS

| | | | |
|---|---|---|---|
| JP | 3023452 | U | 4/1996 |
| JP | 2008-266692 | | 10/1996 |
| JP | 2009-262324 | | 10/1997 |
| JP | H09262324 | A | 10/1997 |
| JP | 2011-47316 | | 2/1999 |
| JP | H11-164723 | A | 6/1999 |
| JP | 2000-042150 | A | 2/2000 |
| JP | 2000042150 | A | 2/2000 |
| JP | 3023452 | B2 | 3/2000 |
| JP | 2000229139 | A | 8/2000 |
| JP | 2001-212267 | A | 8/2001 |
| JP | 2002291947 | A | 10/2002 |
| JP | 2004/052474 | A | 2/2004 |
| JP | 2004159854 | A | 6/2004 |
| JP | 2005-237535 | A | 9/2005 |
| JP | 2006-116002 | A | 5/2006 |
| JP | 2007044148 | A | 2/2007 |
| JP | 2007-054198 | A | 3/2007 |
| JP | 2007-117728 | A | 5/2007 |
| JP | 2007-190077 | A | 8/2007 |
| JP | 2008-136861 | A | 6/2008 |
| JP | 2008136861 | A | 6/2008 |
| JP | 2009-11366 | | 1/2009 |
| JP | 2009000281 | A | 1/2009 |
| JP | 2009011366 | A | 1/2009 |
| JP | 2009-022571 | A | 2/2009 |
| JP | 2009540933 | A | 11/2009 |
| JP | 2009-279145 | A | 12/2009 |
| JP | 2009-279373 | A | 12/2009 |
| JP | 2011-528263 | A | 11/2011 |
| JP | 2011528263 | A | 11/2011 |
| JP | 05-337220 | B2 | 11/2013 |
| TW | 405427 | U | 9/2000 |
| TW | 444601 | U | 7/2001 |
| WO | 9922824 | A1 | 5/1999 |
| WO | 2004022171 | A1 | 3/2004 |
| WO | 2004052474 | A1 | 6/2004 |
| WO | 2006073930 | A2 | 7/2006 |
| WO | 2008157655 | A1 | 12/2008 |
| WO | 2008157691 | A2 | 12/2008 |
| WO | 2010028114 | A2 | 3/2010 |
| WO | 2010104898 | A2 | 9/2010 |

OTHER PUBLICATIONS

Adamsgolf, Speedline Driver advertisement, Golf World magazine, Mar. 9, 2009, p. 15.

FT Hybrids Overview, CallawayGolf.com, printed Sep. 24, 2010, 2 pages. http:/lwww"callawaygolf.com/Giobal/en-US/Products/Ciubs/Hybrids/FTHybrids.html.

PING Go if Clubs: Rapture V2 Technology and Iron Specifications. Printed Feb. 11, 2009: D 1 1 http://www.ping.com/clubs/ironsdetaiLaspx?id=3652.

Rendall, Jeffrey A., Taylor Made RAC Irons—Finer Sounds Produces Less Fury, GolftheMidAtlantic.com, printed Sep. 24, 2010, 7 pages. http://www .golfthemidatlantic. com/story /232.

X-22 Irons Overview, CallawayGolf.com, printed Sep. 24, 2010, 2 pages. http:i/www"callawaygolf.com/Giobal!en-US/ProductsiCiubs/IronsiX-221rons.html.

* cited by examiner

GOLF CLUB ASSEMBLY AND GOLF CLUB WITH AERODYNAMIC FEATURES

RELATED APPLICATIONS

The present patent application is a continuation application of and claims priority to U.S. patent application Ser. No. 12/945,363, filed Nov. 12, 2010, entitled "Golf Club Assembly and Golf Club With Aerodynamic Features," and naming Gary Tavares, et al. as inventors, which is a continuation-in-part of U.S. patent application Ser. No. 12/779,669, filed May 13, 2010, now U.S. Pat. No. 8,366,565, entitled "Golf Club Assembly and Golf Club With Aerodynamic Features," and naming Gary Tavares, et al. as inventors, which is a continuation-in-part of U.S. patent application Ser. No. 12/465,164, filed May 13, 2009, now U.S. Pat. No. 8,162,775 entitled "Golf Club Assembly and Golf Club With Aerodynamic Features," and naming Gary Tavares, et al. as inventors, and which also claims the benefit of priority of Provisional Application No. 61/298,742, filed Jan. 27, 2010, entitled "Golf Club Assembly and Golf Club With Aerodynamic Features," and naming Gary Tavares, et al. as inventors. Each of these earlier filed applications is incorporated herein by reference in its entirety.

FIELD

Aspects of this invention relate generally to golf clubs and golf club heads, and, in particular, to golf clubs and golf club heads with aerodynamic features.

BACKGROUND

The distance a golf ball travels when struck by a golf club is determined in large part by club head speed at the point of impact with the golf ball. Club head speed in turn can be affected by the wind resistance or drag provided by the club head during the entirety of the swing, especially given the large club head size of a driver. The club head of a driver or a fairway wood in particular produces significant aerodynamic drag during its swing path. The drag produced by the club head leads to reduced club head speed and, therefore, reduced distance of travel of the golf ball after it has been struck.

Air flows in a direction opposite to the golf club head's trajectory over those surfaces of the golf club head that are roughly parallel to the direction of airflow. An important factor affecting drag is the behavior of the air flow's boundary layer. The "boundary layer" is a thin layer of air that lies very close to the surface of the club head during its motion. As the airflow moves over the surfaces, it encounters an increasing pressure. This increase in pressure is called an "adverse pressure gradient" because it causes the airflow to slow down and lose momentum. As the pressure continues to increase, the airflow continues to slow down until it reaches a speed of zero, at which point it separates from the surface. The air stream will hug the club head's surfaces until the loss of momentum in the airflow's boundary layer causes it to separate from the surface. The separation of the air streams from the surfaces results in a low pressure separation region behind the club head (i.e., at the trailing edge as defined relative to the direction of air flowing over the club head). This low pressure separation region creates pressure drag. The larger the separation region, the greater the pressure drag.

One way to reduce or minimize the size of the low pressure separation region is by providing a streamlined form that allows laminar flow to be maintained for as long as possible, thereby delaying or eliminating the separation of the laminar air stream from the club surface.

Reducing the drag of the club head not only at the point of impact, but also during the course of the entire downswing prior to the point of impact, would result in improved club head speed and increased distance of travel of the golf ball. When analyzing the swing of golfers, it has been noted that the heel/hosel region of the club head leads the swing during a significant portion of the downswing and that the ball striking face only leads the swing at (or immediately before) the point of impact with the golf ball. The phrase "leading the swing" is meant to describe that portion of the club head that faces the direction of swing trajectory. For purposes of discussion, the golf club and golf club head are considered to be at a 0° orientation when the ball striking face is leading the swing, i.e. at the point of impact. It has been noted that during a downswing, the golf club may be rotated by about 90° or more around the longitudinal axis of its shaft during the 90° of downswing prior to the point of impact with the golf ball.

During this final 90° portion of the downswing, the club head may be accelerated to approximately 65 miles per hour (mph) to over 100 mph, and in the case of some professional golfers, to as high as 140 mph. Further, as the speed of the club head increases, typically so does the drag acting on the club head. Thus, during this final 90° portion of the downswing, as the club head travels at speeds upwards of 100 mph, the drag force acting on the club head could significantly retard any further acceleration of the club head.

Club heads that have been designed to reduce the drag of the head at the point of impact, or from the point of view of the club face leading the swing, may not function well to reduce the drag during other phases of the swing cycle, such as when the heel/hosel region of the club head is leading the downswing.

It would be desirable to provide a golf club head that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

This application discloses a golf club head with improved aerodynamic performance. In accordance with certain aspects, a golf club head may include a body member having a ball striking face, a crown, a toe, a heel, a sole, a back, and a hosel region located at the intersection of the ball striking face, the heel, the crown and the sole. A drag reducing structure on the body member may be configured to reduce drag for the club head during at least a portion of a golf downswing from an end of a backswing through a moment-of-impact with the golf ball, and optionally, through at least the last 90° of the downswing up to and immediately prior to impact with the golf ball. A golf club including the golf club head is also provided.

In accordance with certain aspects, a golf club head may include a body member having a ball striking face, a crown, a toe, a heel, a sole, a back, and a hosel region located at the intersection of the ball striking face, the heel, the crown and the sole. The crown may have a relatively round rear-side edge profile, as viewed from above. The sole may have a relatively square rear-side edge profile, as viewed from below.

The rear-side edge of the sole may extend rearwardly beyond the rear-side edge of the crown along at least a portion of the back, as viewed from above. Further, a Kammback feature may be provided between the relatively round rear-side edge of the crown and the relatively square rear-side edge of the sole.

According to other aspects, the heel may have an airfoil-like surface in the forward portion of the heel.

According to some aspects, a diffuser may extend at least across a majority of the heel-to-toe width of the sole at an angle of from approximately 15 degrees to approximately 75 degrees from a moment-of-impact trajectory direction. Further, the diffuser may extend to a toe-side edge of the crown.

In accordance with other aspects, a club head may be provided wherein the crown may have a rear-side crown edge that transitions to one of the heel and the toe with a first crown transition profile, as viewed from above, in a crown transition region. The sole may have a rear-side sole edge that transitions to one of the heel and the toe with a first sole transition profile, as viewed from above, in a first sole transition region that is less smoothly curving than the crown transition profile.

According to certain aspects, the rear-side crown edge may have one of a generally circular, elliptical or parabolic profile when viewed from above. Further, the rear-side sole edge and the first sole transition region may form a generally squared-off profile when viewed from above.

According to further aspects, a transition region of the crown to the back is one of an abrupt transition and a sharp transition, as viewed from the side. According to other aspects, the back of the club head may be provided with a rearwardly tapered projection. The tapered projection may be formed by the transition of the back to the sole. Further the tapered projection may extend from the Kammback feature.

According to even other aspects, an elongated hosel fairing may be provide on the crown. The elongated hosel fairing may extend from the hosel region at an angle of from approximately 15 degrees to approximately 75 degrees from a moment-of-impact trajectory direction.

These and additional features and advantages disclosed here will be further understood from the following detailed disclosure of certain embodiments.

Figure 1A:
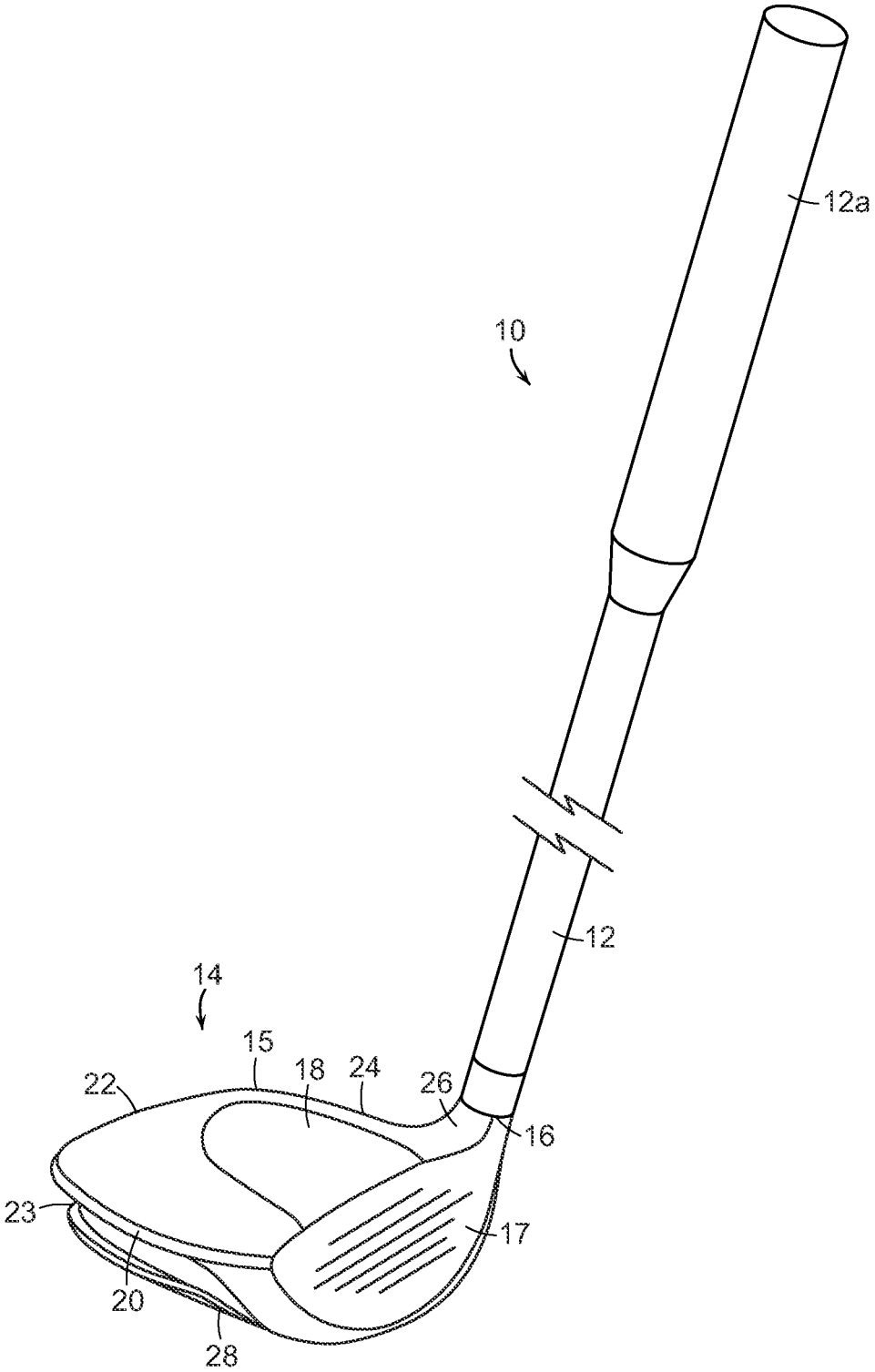
FIG. 1A is a perspective view of a golf club with a groove formed in its club head according to an illustrative aspect.

The figures referred to above are not drawn necessarily to scale, should be understood to provide a representation of particular embodiments of the invention, and are merely conceptual in nature and illustrative of the principles involved. Some features of the golf club head depicted in the drawings may have been enlarged or distorted relative to others to facilitate explanation and understanding. The same reference numbers are used in the drawings for similar or identical components and features shown in various alternative embodiments. Golf club heads as disclosed herein would have configurations and components determined, in part, by the intended application and environment in which they are used.

DETAILED DESCRIPTION

An illustrative embodiment of a golf club 10 is shown in FIG. 1A and includes a shaft 12 and a golf club head 14 attached to the shaft 12. Golf club head 14 may be a driver, as shown in FIG. 1A. The shaft 12 of the golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors (including releasable and adjustable mechanisms), via friction fits, via retaining element structures, etc.). A grip or other handle element 12*a* may be positioned on the shaft 12 to provide a golfer with a slip resistant surface with which to grasp golf club shaft 12. The grip element 12*a* may be attached to the shaft 12 in any desired manner, including in conventional manners known and used in the art (e.g., via adhesives or cements, via threads or other mechanical connectors (including releasable connectors), via fusing techniques, via friction fits, via retaining element structures, etc.).

In the example structure of FIG. 1A, the club head 14 includes a body member 15 to which the shaft 12 is attached at a hosel or socket 16 for receiving the shaft 12 in known fashion. The body member 15 includes a plurality of portions, regions, or surfaces as defined herein. This example body member 15 includes a ball striking face 17, a crown 18, a toe 20, a back 22, a heel 24, a hosel region 26 and a sole 28. Back 22 is positioned opposite ball striking face 17, and extends between crown 18 and sole 28, and further extends between toe 20 and heel 24. This particular example body member 15 further includes a skirt or Kammback feature 23 and a recess or diffuser 36 formed in sole 28.

Figure 1B:
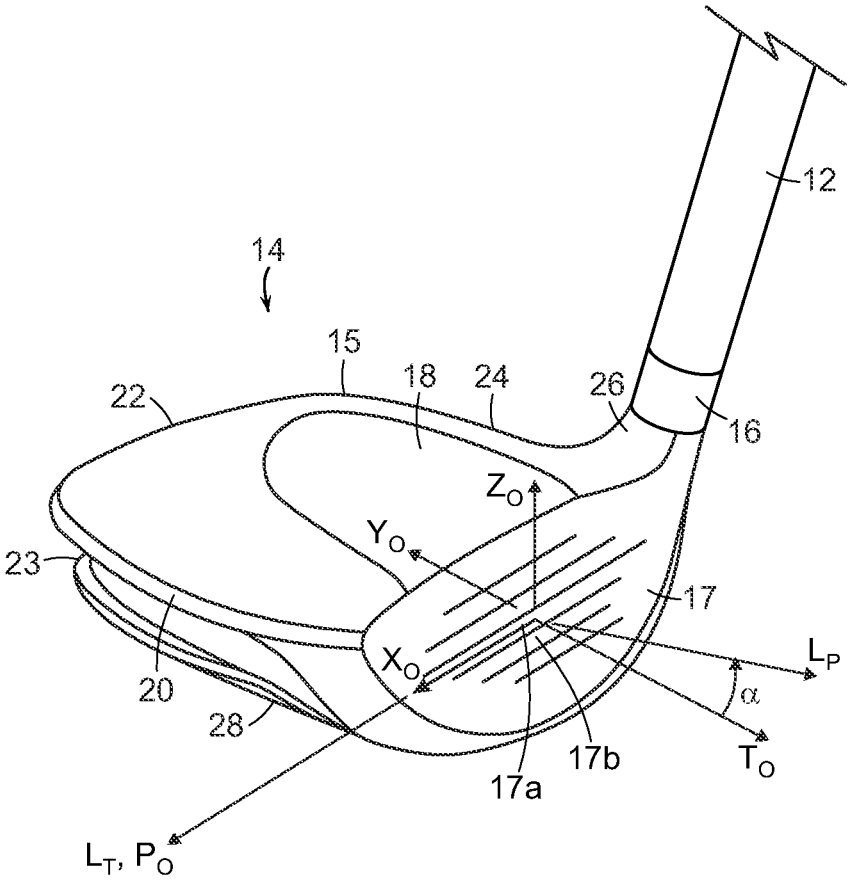
FIG. 1B is a close up of the club head of FIG. 1A with orientation axes provided.

Referring to FIG. 1B, the ball striking face region 17 is a region or surface that may be essentially flat or that may have a slight curvature or bow (also known as "bulge"). Although the golf ball may contact the ball striking face 17 at any spot on the face, the desired-point-of-contact 17*a* of the ball striking face 17 with the golf ball is typically approximately centered within the ball striking face 17. For purposes of this disclosure, a line $L_T$ drawn tangent to the surface of the striking face 17 at the desired-point-of-contact 17*a* defines a direction parallel to the ball striking face 17. The family of lines drawn tangent to the surface of the striking face 17 at the desired-point-of-contact 17*a* defines a striking face plane 17*b*. Line $L_P$ defines a direction perpendicular to the striking face plane 17*b*. Further, the ball striking face 17 may generally be provided with a loft angle $\alpha$, such that at the point of impact (and also at the address position, i.e., when the club head is positioned on the ground adjacent to the golf ball prior to the initiation of the backswing) the ball striking plane 17*b* is not perpendicular to the ground. Generally, the loft angle $\alpha$ is meant to affect the initial upward trajectory of the golf ball at the point of impact. Rotating the line $L_P$ drawn perpendicular to the striking face plane 17*b* through the negative of the loft angle $\alpha$ defines a line $T_0$ oriented along the desired club-head-trajectory at the point of impact. Generally, this point-of-impact club-head-trajectory direction $T_0$ is perpendicular to the longitudinal axis of the club shaft 12.

Still referring to FIG. 1B, a set of reference axes ($X_0$, $Y_0$, $Z_0$) associated with a club head oriented at a 60 degree lie angle position with a face angle of zero degrees (see, e.g., USGA Rules of Golf, Appendix II and see also, FIG. 28) can now be applied to the club head 14. The $Y_0$-axis extends from the desired-point-of-contact 17*a* along the point-of-impact club-head-trajectory line in a direction opposite to the $T_0$ direction. The $X_0$-axis extends from desired-point-of-contact 17*a* generally toward the toe 20 and is perpendicular to the $Y_0$-axis and parallel to the horizontal with the club at a 60 degree lie angle position. Thus, the line $L_T$, when drawn parallel to the ground, is coincident with the $X_0$-axis. The $Z_0$-axis extends from desired-point-of-contact 17*a* generally vertically upward and perpendicular to both the $X_0$-axis and the $Y_0$-axis. For purposes of this disclosure, the "centerline" of the club head 14 is considered to coincide with the $Y_0$-axis (and also with the $T_0$ line). The term "rearwardly" as used herein generally refers to a direction opposite to the point-of-impact club-head trajectory direction $T_0$, i.e., in the positive direction of the $Y_0$-axis.

Referring now to FIGS. 1-6, the crown 18, which is located on the upper side of the club head 14, extends from the ball striking face 17 back toward the back 22 of the golf club head 14. When the club head 14 is viewed from below, i.e., along the $Z_0$-axis in the positive direction, the crown 18 cannot be seen.

The sole 28, which is located on the lower or ground side of the club head 14 opposite to the crown 18, extends from the ball striking face 17 back to the back 22. As with the crown 18, the sole 28 extends across the width of the club head 14, from the heel 24 to the toe 20. When the club head 14 is viewed from above, i.e., along the $Z_0$-axis in the negative direction, the sole 28 cannot be seen.

Figure 3:
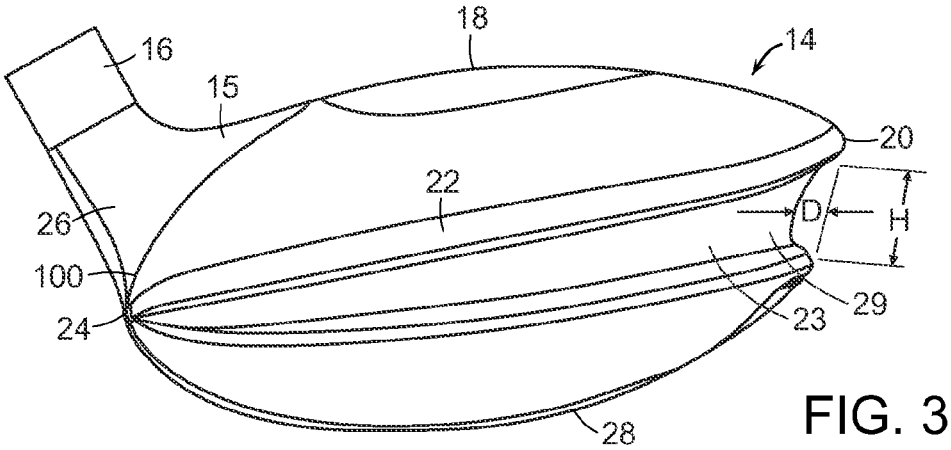
FIG. 3 is a back elevation view of the club head of the golf club of FIG. 1A.
Figure 4:
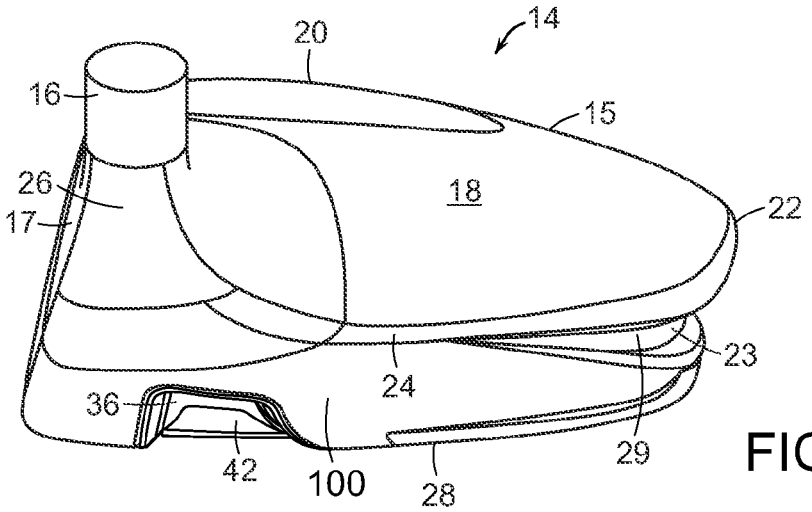
FIG. 4 is a side elevation view of the club head of the golf club of FIG. 1A, viewed from a heel side of the club head.

Referring to FIGS. 3 and 4, the back 22 is positioned opposite the ball striking face 17, is located between the crown 18 and the sole 28, and extends from the heel 24 to the toe 20. When the club head 14 is viewed from the front, i.e., along the $Y_0$-axis in the positive direction, the back 22 cannot be seen. In some golf club head configurations, the back 22 may be provided with a skirt or with a Kammback feature 23.

The heel 24 extends from the ball striking face 17 to the back 22. When the club head 14 is viewed from the toe side, i.e., along the $X_0$-axis in the positive direction, the heel 24 cannot be seen. In some golf club head configurations, the heel 24 may be provided with a skirt or with a Kammback feature 23 or with a portion of a skirt or with a portion of a Kammback feature 23.

The toe 20 is shown as extending from the ball striking face 17 to the back 22 on the side of the club head 14 opposite to the heel 24. When the club head 14 is viewed from the heel side, i.e., along the $X_0$-axis in the negative direction, the toe 20 cannot be seen. In some golf club head configurations, the toe 20 may be provided with a skirt or with a Kammback feature 23 or with a portion of a skirt or with a portion of a Kammback feature 23.

The socket 16 for receiving the shaft is located within the hosel region 26. The hosel region 26 is shown as being located at the intersection of the ball striking face 17, the heel 24, the crown 18 and the sole 28 and may encompass those portions of the heel 24, the crown 18 and the sole 28 that lie adjacent to the hosel 16. Generally, the hosel region 26 includes surfaces that provide a transition from the socket 16 to the ball striking face 17, the heel 24, the crown 18 and/or the sole 28.

Thus it is to be understood that the terms: the ball striking face 17, the crown 18, the toe 20, the back 22, the heel 24, the hosel region 26 and the sole 28, refer to general regions or portions of the body member 15. In some instances, the regions or portions may overlap one another. Further, it is to be understood that the usage of these terms in the present disclosure may differ from the usage of these or similar terms in other documents. It is to be understood that in general, the terms toe, heel, ball striking face and back are intended to refer to the four sides of a golf club, which make up the perimeter outline of a body member when viewed directly from above when the golf club is in the address position.

In the embodiment illustrated in FIGS. 1-6, body member 15 may generally be described as a "square head." Although not a true square in geometric terms, crown 18 and sole 28 of square head body member 15 are substantially square as compared to a traditional round-shaped club head.

Another embodiment of a club head 14 is shown as club head 54 in FIGS. 7-10. Club head 54 has a more traditional round head shape. It is to be appreciated that the phrase "round head" does not refer to a head that is completely round but, rather, one with a generally or substantially round profile.

Figure 11:
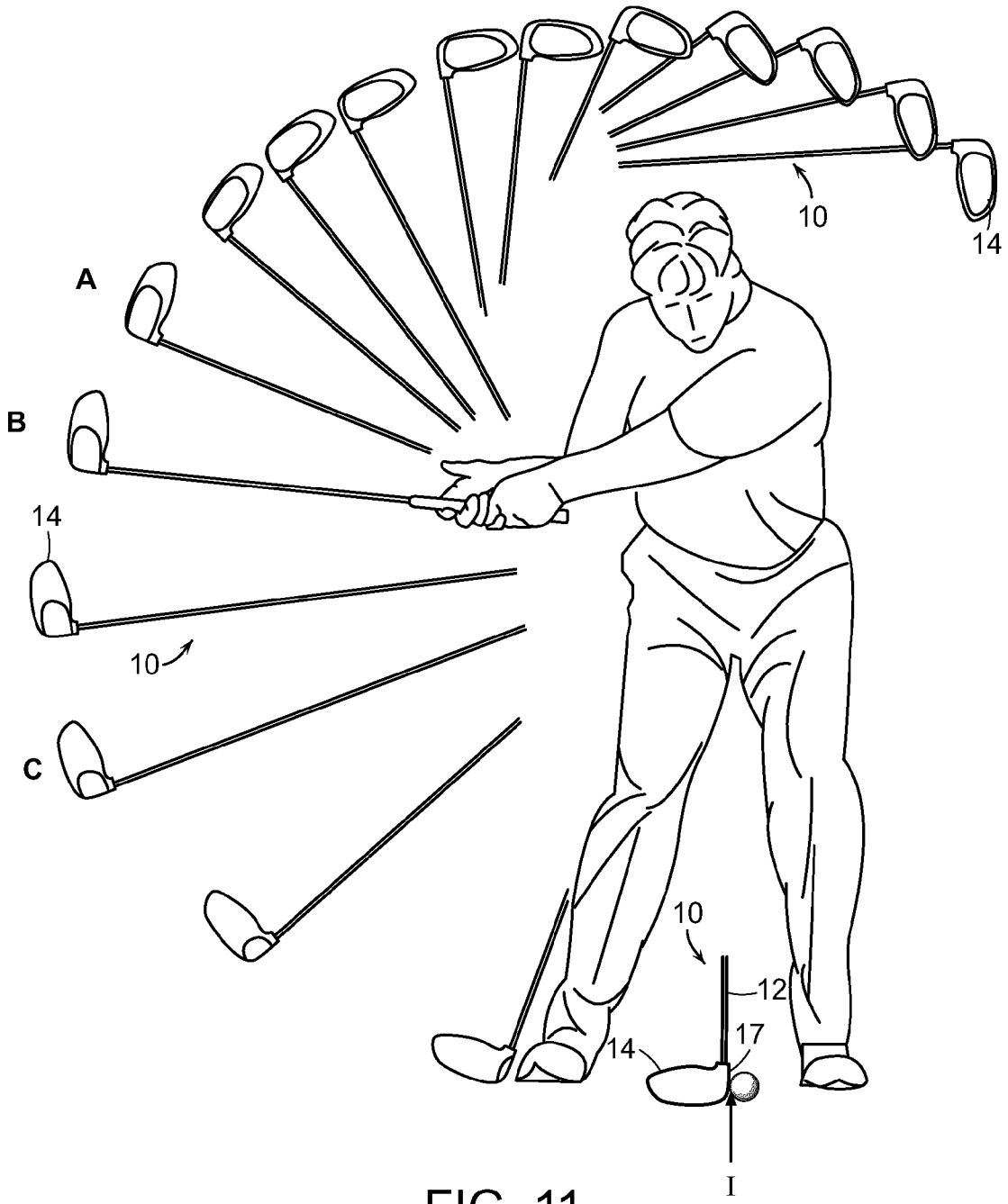
FIG. 11 is a schematic, time-lapsed, front view of a typical golfer's downswing.
Figure 12A:
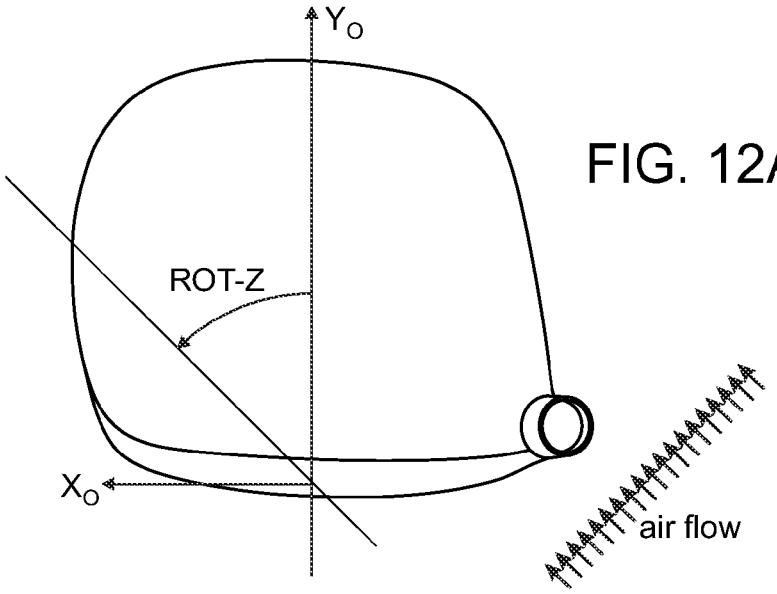
FIG. 12A is a top plan view of a club head illustrating yaw.
Figure 12B:
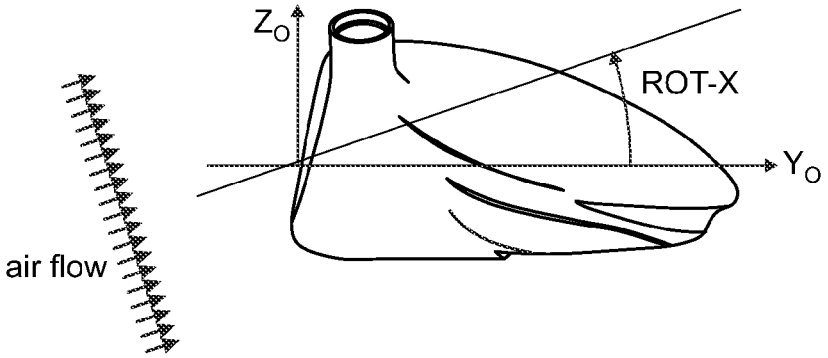
FIG. 12B is a heel-side elevation view of a club head illustrating pitch.
Figure 12C:
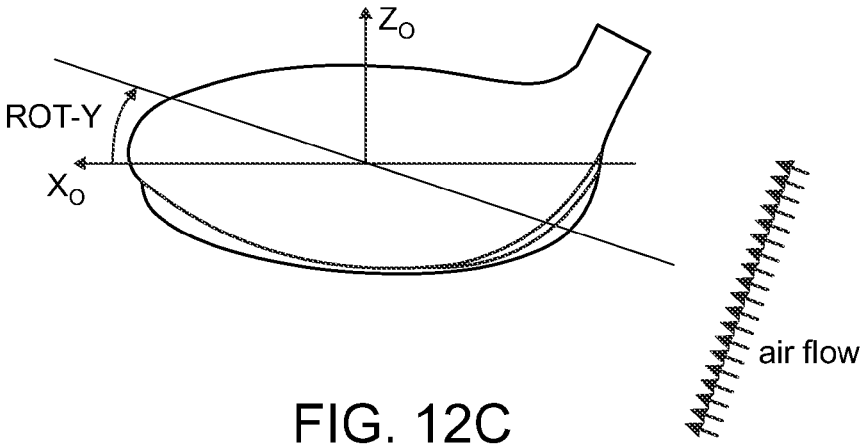
FIG. 12C is a front elevation view of a club head illustrating roll.

FIG. 11 is a schematic front view of a motion capture analysis of at least a portion of a golfer's downswing. As shown in FIG. 11, at the point of impact (I) with a golf ball, the ball striking face 17 may be considered to be substantially perpendicular to the direction of travel of the club head 14. (In actuality, the ball striking face 17 is usually provided with a loft of from approximately 2° to 4°, such that the ball striking face 17 departs from the perpendicular by that amount.) During a golfer's backswing, the ball striking face 17, which starts at the address position, twists outwardly away from the golfer (i.e., clockwise when viewed from above for a right-handed golfer) due to rotation of the golfer's hips, torso, arms, wrists and/or hands. During the downswing, the ball striking face 17 rotates back into the point-of-impact position.

In fact, referring to FIGS. 11 and 12A-12C, during the downswing the club head 14 experiences a change in yaw angle (ROT-Z) (see FIG. 12A) (defined herein as a rotation of the club head 14 around the vertical $Z_0$-axis), a change in pitch angle (ROT-X) (see FIG. 12B) (defined herein as a rotation of the club head 14 around the $X_0$-axis), and a change in roll angle (ROT-Y) (see FIG. 12C) (defined herein as a rotation of the club head 14 around the $Y_0$-axis).

The yaw, pitch, and roll angles may be used to provide the orientation of the club head 14 with respect to the direction of air flow (which is considered to be the opposite direction from the instantaneous trajectory of the club head). At the point of impact and also at the address position, the yaw, pitch and roll angles may be considered to be 0°. For example, referring to FIG. 12A, at a measured yaw angle of 45°, the centerline $L_0$ of the club head 14 is oriented at 45° to the direction of air flow, as viewed along the $Z_0$-axis. As another example, referring to FIG. 12B, at a pitch angle of 20°, the centerline $L_0$ of the club head 14 is oriented at 20° to the direction of air flow, as viewed along the $X_0$-axis. And, referring to FIG. 12C, with a roll angle of 20°, the $X_0$-axis of the club head 14 is oriented at 20° to the direction of air flow, as viewed along the $Y_0$-axis.

Figure 13:
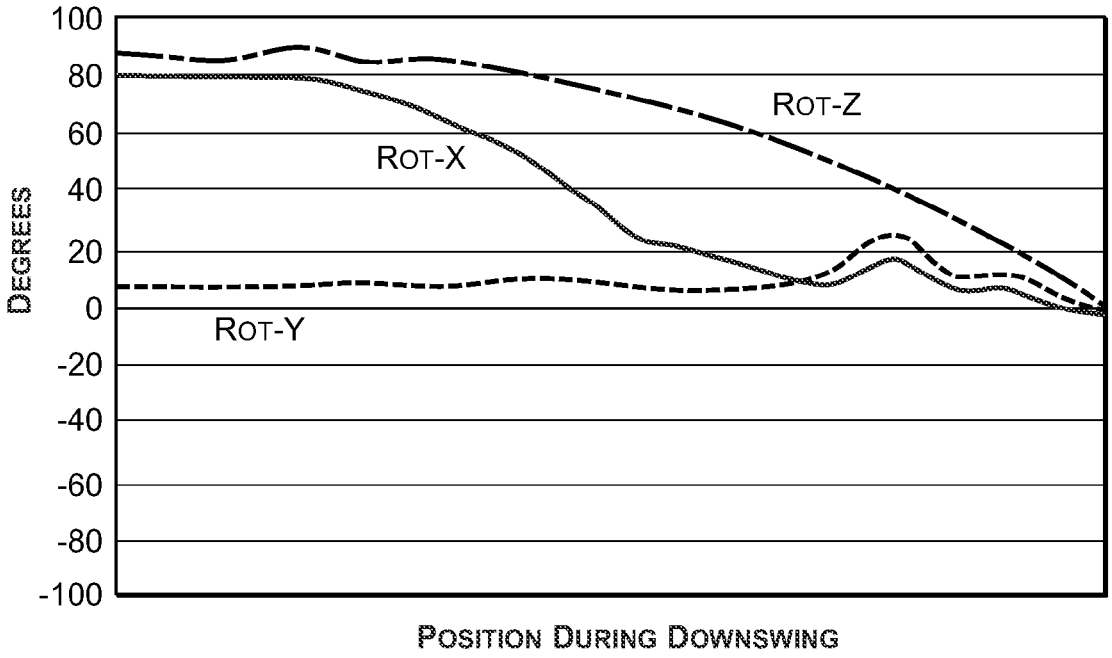
FIG. 13 is a graph of representative yaw, pitch and roll angles as a function of position of a club head during a typical downswing.

FIG. 13 is a graph of representative yaw (ROT-Z), pitch (ROT-X) and roll (ROT-Y) angles as a function of position of a club head 14 during a typical downswing. It can be seen by referring to FIG. 11 and to FIG. 13, that during a large portion of the downswing, the ball striking face 17 of the golf club head 14 is not leading the swing. At the beginning of a golfer's downswing, due to an approximately 90° yaw rotation, the heel 24 may be essentially leading the swing. Even further, at the beginning of a golfer's downswing, due to an approximately 10° roll rotation, the lower portion of the heel 24 is essentially leading the swing. During the downswing, the orientation of the golf club and club head 14 changes from the approximately 90° of yaw at the beginning of the downswing to the approximately 0° of yaw at the point of impact.

Moreover, referring to FIG. 13, typically, the change in yaw angle (ROT-Z) over the course of the downswing is not constant. During the first portion of the downswing, when the club head 14 moves from behind the golfer to a position approximately at shoulder height, the change in yaw angle is typically on the order of 20°. Thus, when the club head 14 is approximately shoulder high, the yaw is approximately 70°. When the club head 14 is approximately waist high, the yaw angle is approximately 60°. During the last 90° portion of the downswing (from waist height to the point of impact), the golf club generally travels through a yaw angle of about 60° to the yaw angle of 0° at the point of impact. However, the change in yaw angle during this portion of the downswing is generally not constant, and, in fact, the golf club head 14 typically closes from approximately a 20° yaw to the 0° yaw at the point of impact only over the last 10° degrees of the downswing. Over the course of this latter 90° portion of the downswing, yaw angles of 45° to 60° may be considered to be representative.

Similarly, still referring to FIG. 13, typically, the change in roll angle (ROT-Y) over the course of the downswing is also not constant. During the first portion of the downswing, when the club head 14 moves from behind the golfer to a position approximately at waist height, the roll angle is fairly constant, for example, on the order of 7° to 13°. However, the change in roll angle during the portion of the downswing from approximately waist height to the point of impact is generally not constant, and, in fact, the golf club head 14 typically has an increase in roll angle from approximately 10° to approximately 20° as the club head 14 swings from approximately waist height to approximately knee height, and then a subsequent decrease in roll angle to 0° at the point of impact. Over the course of a waist-to-knee portion of the downswing, a roll angle of 15° may be considered to be representative.

The speed of the golf club head also changes during the downswing, from 0 mph at the beginning of the downswing to 65 to 100 mph (or more, for top-ranked golfers) at the point of impact. At low speed, i.e., during the initial portion of the downswing, drag due to air resistance may not be very significant. However, during the portion of the downswing when club head 14 is even with the golfer's waist and then swinging through to the point of impact, the club head 14 is travelling at a considerable rate of speed (for example, from 60 mph up to 130 mph for professional golfers). During this portion of the downswing, drag due to air resistance causes the golf club head 14 to impact the golf ball at a slower speed than would be possible without air resistance.

Figure 14C:
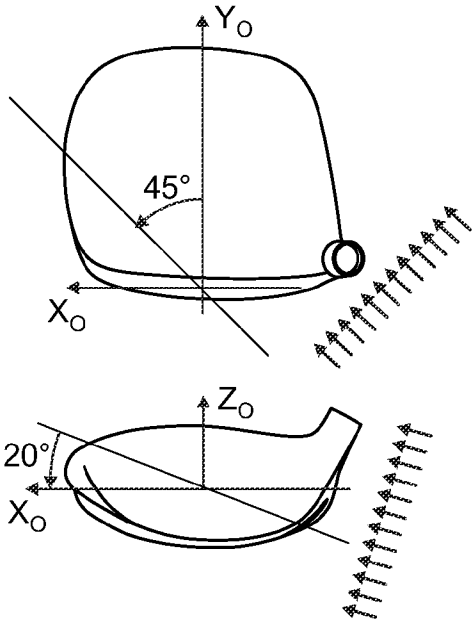
FIGS. 14A-14C schematically illustrate a club head 14 (both top plan view and front elevation view) and typical orientations of the air flow over the club head at points A, B and C of FIG. 11, respectively.
Figure 14B:
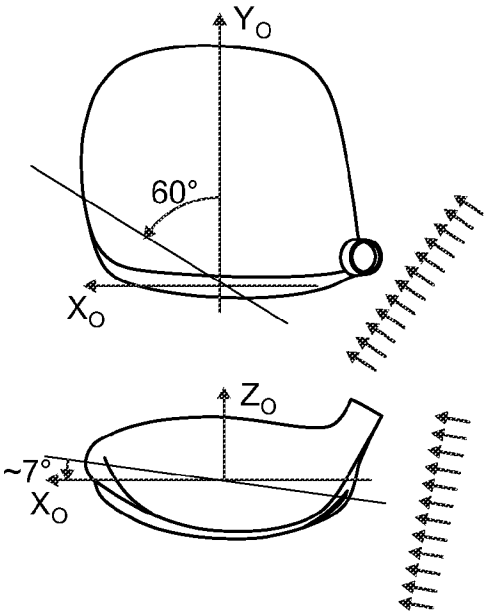
Figure 14A:
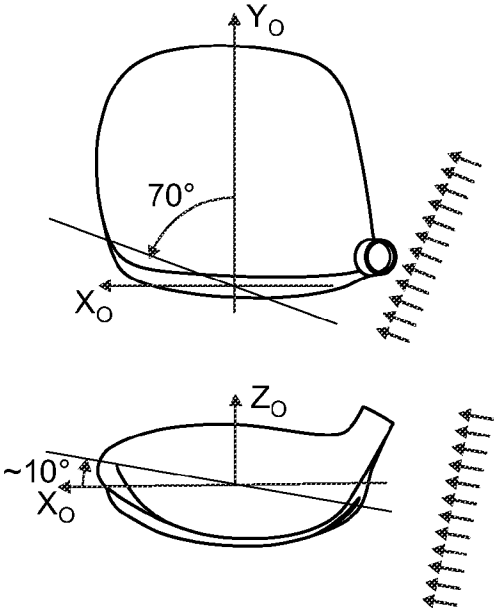
Figure 15:
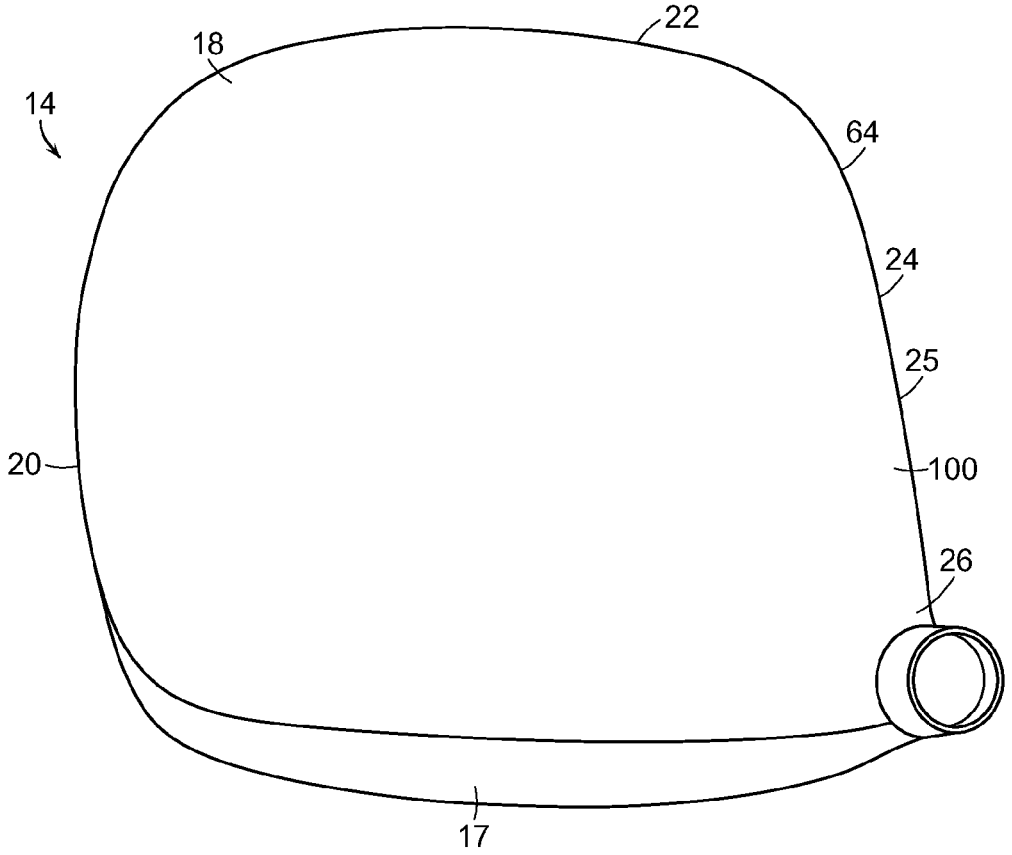
FIG. 15 is a top plan view of a club head according to certain illustrative aspects.
Figure 16:
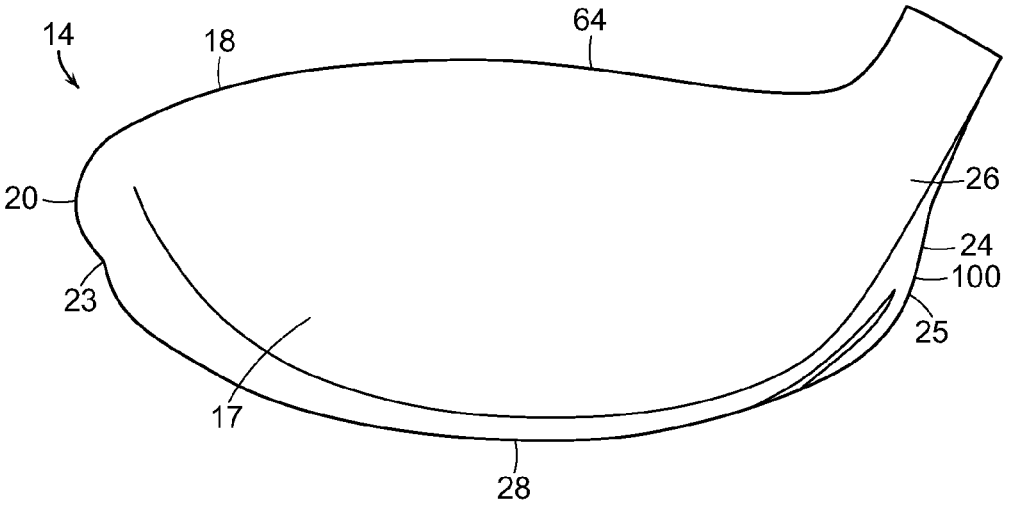
FIG. 16 is a front elevation view of the club head of FIG. 15.

Referring back to FIG. 11, several points (A, B and C) along a golfer's typical downswing have been identified. At point A, the club head 14 is at a downswing angle of approximately 120°, i.e., approximately 120° from the point-of-impact with the golf ball. At this point, the club head may already be traveling at approximately 70% of its maximum velocity. FIG. 14A schematically illustrates a club head 14 and a typical orientation of the air flow over the club head 14 at point A. The yaw angle of the club head 14 may be approximately 70°, meaning that the heel 24 is no longer substantially perpendicular to the air flowing over the club head 14, but rather that the heel 24 is oriented at approximately 20° to the perpendicular to the air flowing over the club head 14. Note also, that at this point in the downswing, the club head 14 may have a roll angle of approximately 7° to 10°, i.e., the heel 24 of the club head 14 is rolled upwards by 7° to 10° relative to the direction of air flow. Thus, the heel 24 (slightly canted to expose the lower (sole side) portion of the heel 24), in conjunction with the heel-side surface of the hosel region 26, leads the swing.

At point B shown on FIG. 11, the club head 14 is at a downswing angle of approximately 100°, i.e., approximately 100° from the point-of-impact with the golf ball. At this point, the club head 14 may now be traveling at approximately 80% of its maximum velocity. FIG. 14B schematically illustrates a club head 14 and a typical orientation of the air flow over the club head 14 at point B. The yaw angle of the club head 14 may be approximately 60°, meaning that the heel 24 is oriented at approximately 30° to the perpendicular to the air flowing over the club head 14. Further, at this point in the downswing, the club head 14 may have a roll angle of approximately 5° to 10°. Thus, the heel 24 is again slightly canted to the expose the lower (sole side) portion of the heel 24. This portion of the heel 24, in conjunction with the heel-side surface of the hosel region 26, and now also with some minor involvement of the striking face-side surface of the hosel region 26, leads the swing. In fact, at this yaw and roll angle orientation, the intersection of the heel-side surface with the striking face-side surface of the hosel region 26 provides the most forward surface (in the trajectory direction). As can be seen, the heel 24 and the hosel region 26 are associated with the leading edge, and the toe 20, a portion of the back 22 adjacent to the toe 20, and/or their intersection are associated with the trailing edge (as defined by the direction of air flow).

At point C of FIG. 11, the club head 14 is at a downswing position of approximately 70°, i.e., approximately 70° from the point of impact with the golf ball. At this point, the club head 14 may now be traveling at approximately 90% or more of its maximum velocity. FIG. 14C schematically illustrates a club head 14 and a typical orientation of the air flow over the club head 14 at point C. The yaw angle of the club head 14 is approximately 45°, meaning that the heel 24 is no longer substantially perpendicular to the air flowing over the club head 14, but rather is oriented at approximately 45° to the perpendicular to the air flow. Further, at this point in the downswing, the club head 14 may have a roll angle of approximately 20°. Thus, the heel 24 (canted by approximately 20° to expose the lower (sole side) portion of the heel 24) in conjunction with the heel-side surface of the hosel region 26, and with even more involvement of the striking face-side surface of the hosel region 26 leads the swing. At this yaw and roll angle orientation, the intersection of the heel-side surface with the striking face-side surface of the hosel region 26 provides the most forward surface (in the trajectory direction). As can be seen, the heel 24 and the hosel region 26 are again associated with the leading edge and a portion of the toe 20 adjacent to the back 22, the portion of the back 22 adjacent to the toe 20 and/or their intersection are associated with the trailing edge (as defined by the direction of air flow).

Referring back to FIGS. 11 and 13, it can be understood that the integration or summation of the drag forces during the entire downswing provides the total drag work experienced by the club head 14. Calculating the percent reduction in the drag work throughout the swing can produce a very different result than calculating the percent reduction in drag force at the point of impact only. The drag-reducing structures described below provide various means to reduce the total drag, not just reducing the drag at the point-of-impact (I).

A further embodiment of the club head 14 is shown as club head 64 in FIGS. 15-20A. Club head 64 is a generally "square head" shaped club. Club head 64 includes ball-striking surface 17, crown 18, a sole 28, a heel 24, a toe 20, a back 22 and a hosel region 26.

Figure 17:
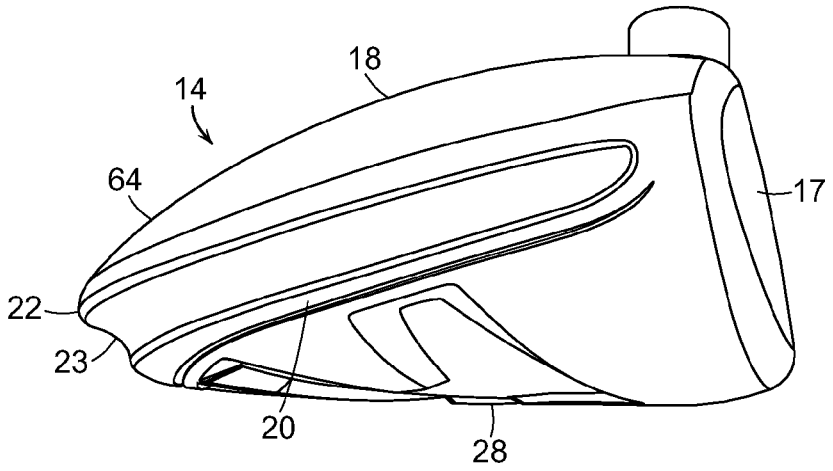
FIG. 17 is a toe-side elevation view of the club head of FIG. 15.
Figure 18:
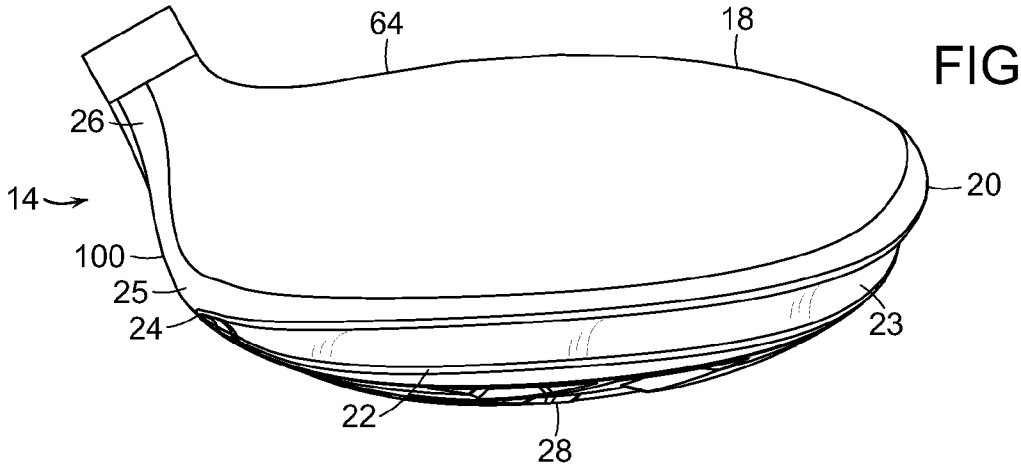
FIG. 18 is a rear-side elevation view of the club head of FIG. 15.
Figure 19:
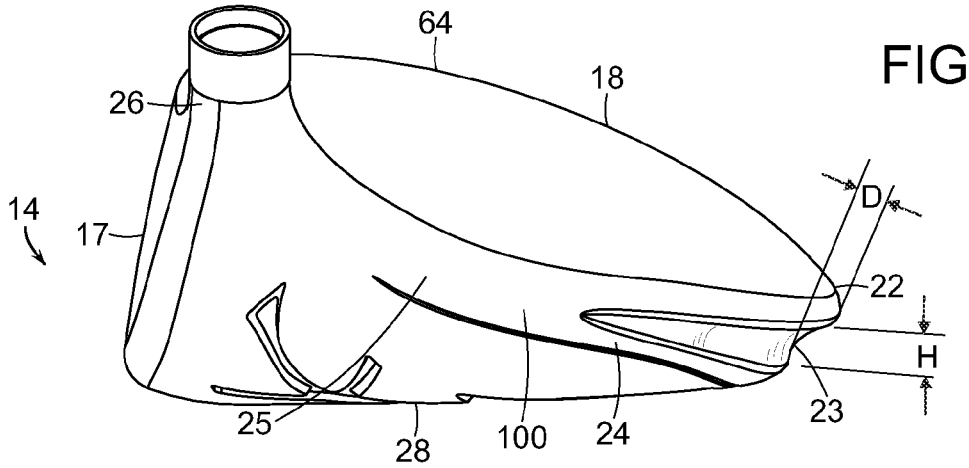
FIG. 19 is a heel-side elevation view of the club head of FIG. 15.

A Kammback feature 23, located between the crown 18 and the sole 28, continuously extends from a forward portion (i.e., a region that is closer to the ball striking face 17 than to the back 22) of the toe 20 to the back 22, across the back 22 to the heel 24 and into a rearward portion of the heel 24. Thus, as best seen in FIG. 17, the Kammback feature 23 extends along a majority of the length of the toe 20. As best seen in FIG. 19, the Kammback feature extends along a minority of the length of the heel 24. In this particular embodiment, Kammback feature 23 is a concave groove having a maximum height (H) that may range from approximately 10 mm to approximately 20 mm and a maximum depth (D) that may range from approximately 5 mm to approximately 15 mm.

Figure 20A:
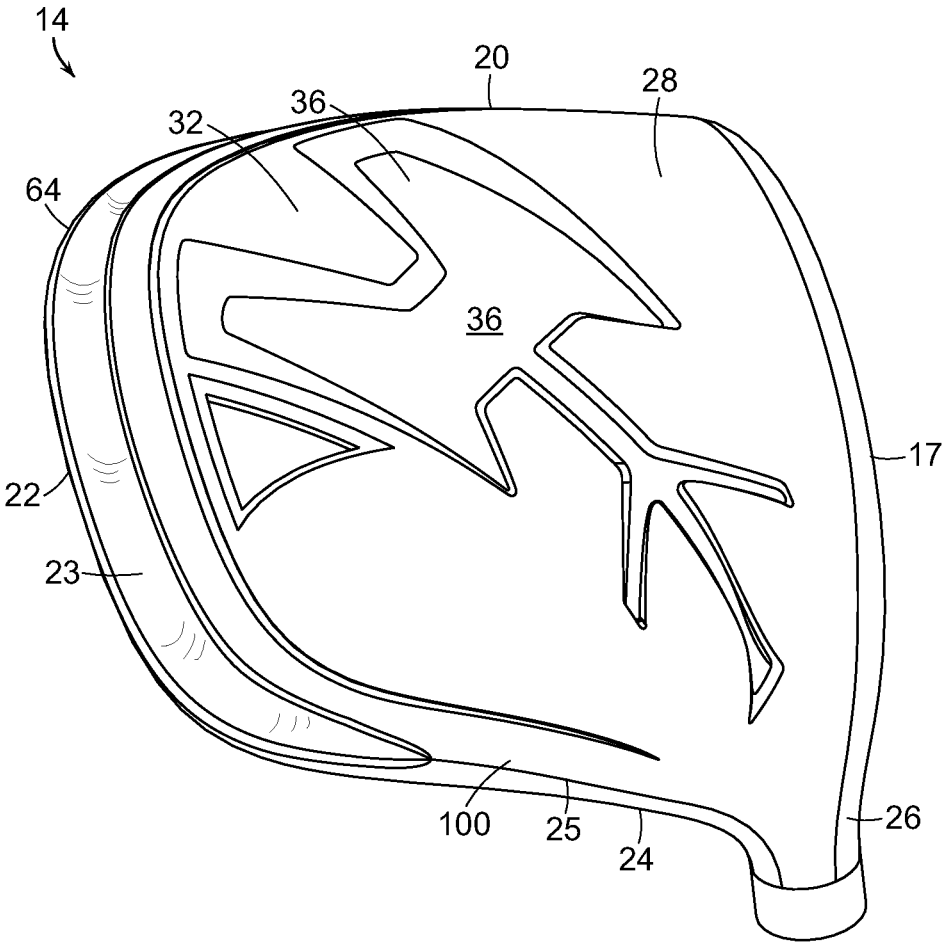
FIG. 20A is a bottom perspective view of the club head of FIG. 15.

One or more diffusers 36 may be formed in sole 28, as shown in FIG. 20A. In an alternative embodiment of club head 14 as shown as club head 74 in FIG. 20B, the sole 28 may be formed without a diffuser.

Referring back to FIGS. 16, 18 and 19, in the heel 24, from the tapered end of the Kammback feature 23 to the hosel region 26, a streamlined region 100 having a surface 25 that is generally shaped as the leading surface of an airfoil may be provided. As disclosed below in greater detail, this streamlined region 100 and the airfoil-like surface 25 may be configured so as to achieve aerodynamic benefits as the air flows over the club head 14 during a downswing stroke of the golf club 10. In particular, the airfoil-like surface 25 of the heel 24 may transition smoothly and gradually into the crown 18. Further, the airfoil-like surface 25 of the heel 24 may transition smoothly and gradually into the sole 28. Even further, the airfoil-like surface 25 of the heel 24 may transition smoothly and gradually into the hosel region 26.

A further embodiment of the club head 14 is shown as club head 84 in FIGS. 21-26A. Club head 84 is a generally "round head" shaped club. Club head 84 includes ball-striking surface 17, crown 18, a sole 28, a heel 24, a toe 20, a back 22 and a hosel region 26.

Figure 23:
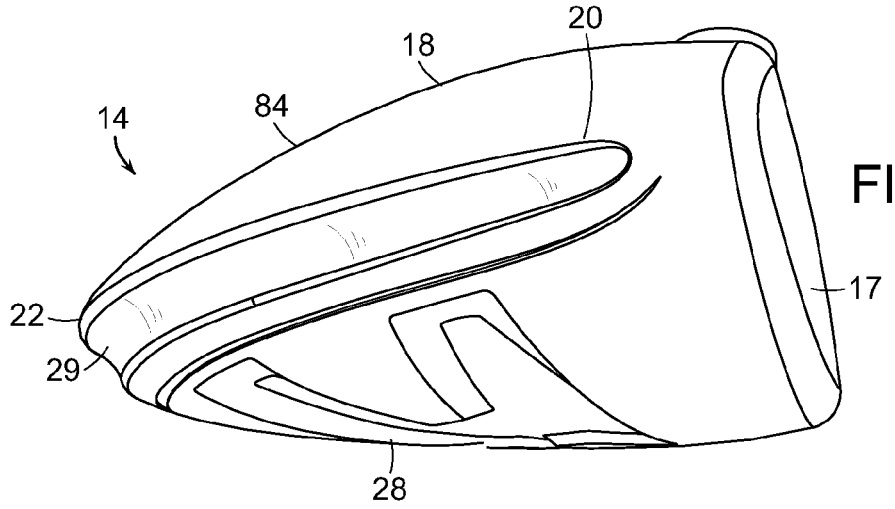
FIG. 23 is a toe-side elevation view of the club head of FIG. 21.
Figure 24:
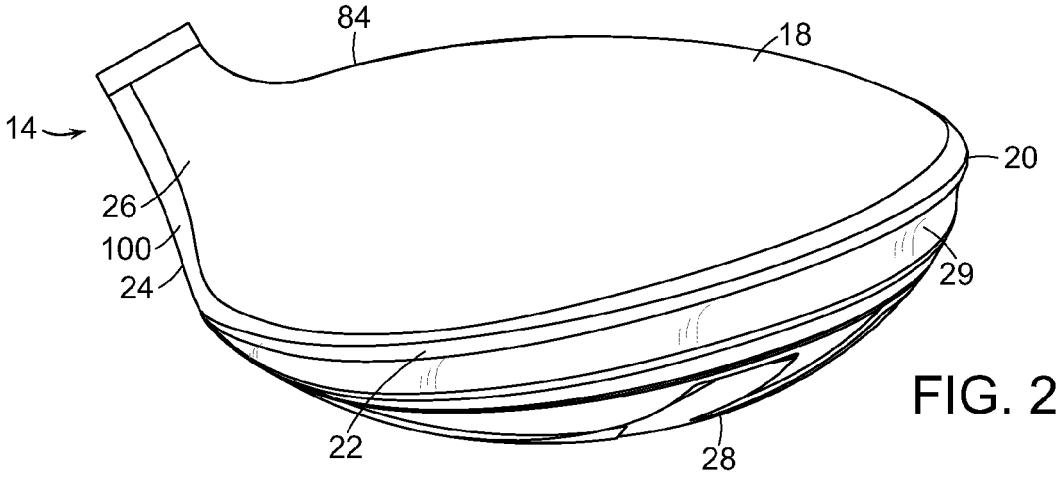
FIG. 24 is a rear-side elevation view of the club head of FIG. 21.
Figure 25:
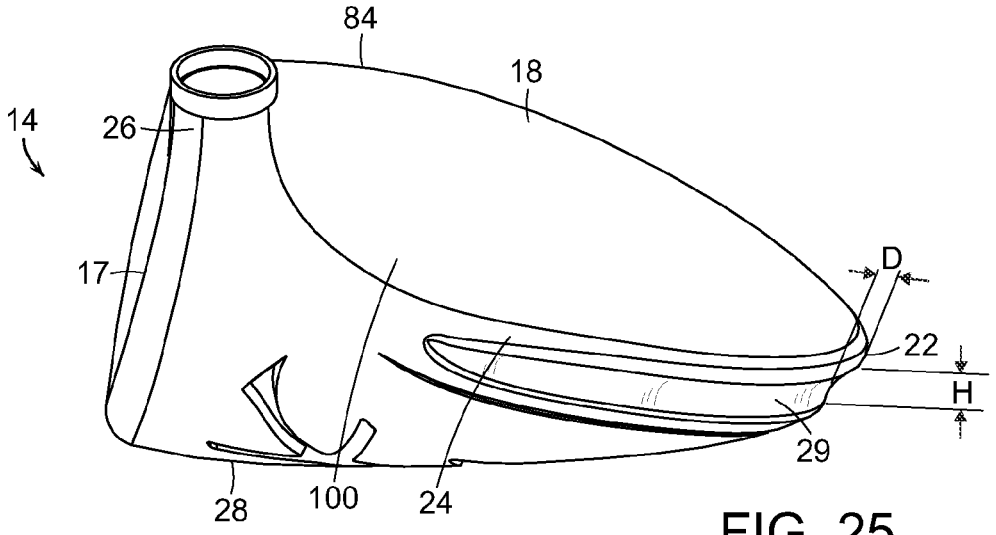
FIG. 25 is a heel-side elevation view of the club head of FIG. 21.

Referring to FIGS. 23-26, a groove 29, located below the outermost edge of the crown 18, continuously extends from a forward portion of the toe 20 to the back 22, across the back 22 to the heel 24 and into a forward portion of the heel 24. Thus, as best seen in FIG. 23, the groove 29 extends along a majority of the length of the toe 20. As best seen in FIG. 25, the groove 29 also extends along a majority of the length of the heel 24. In this particular embodiment, groove 29 is a concave groove having a maximum height (H) that may range from approximately 10 mm to approximately 20 mm and a maximum depth (D) that may range from approximately 5 mm to approximately 10 mm. Further, as best shown in FIG. 26A, sole 28 includes a shallow step 21 that generally parallels groove 29. Step 21 smoothly merges into the surface of the hosel region 26.

Figure 26A:
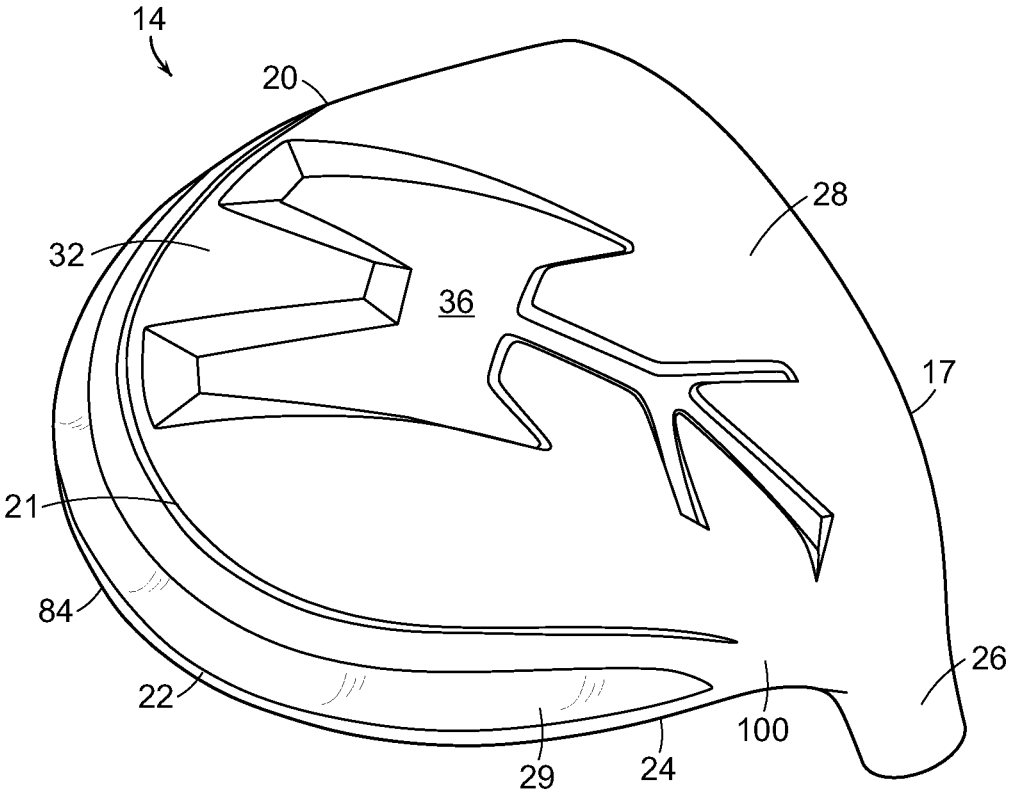
FIG. 26A is a bottom perspective view of the club head of FIG. 21.
Figure 26B:
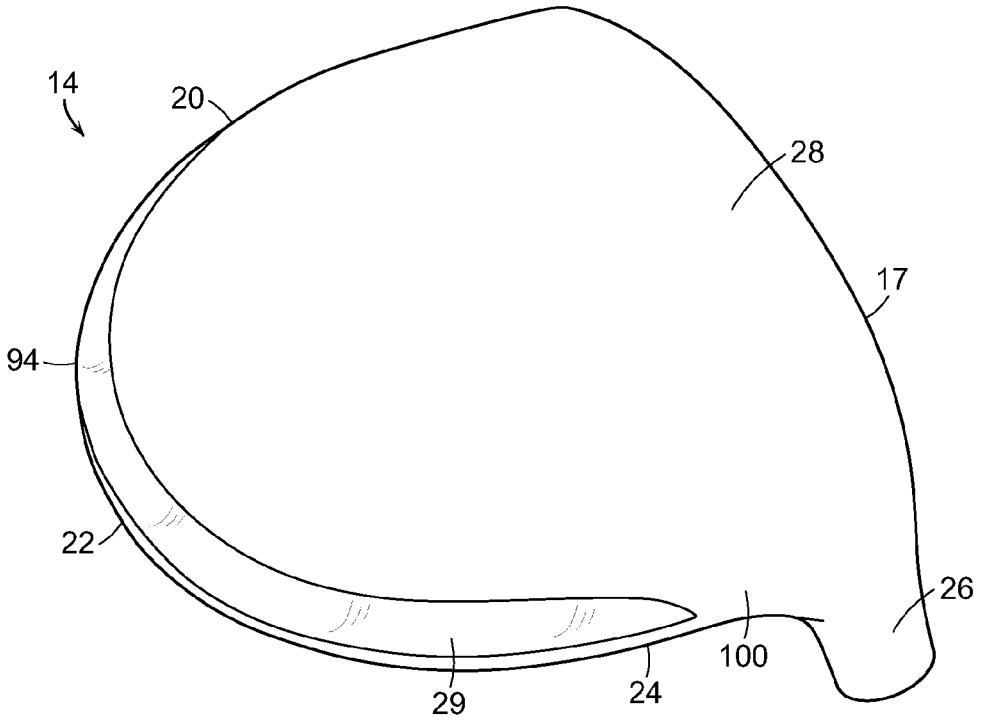
FIG. 26B is a bottom perspective view of an alternative embodiment of a club head that is similar to the club head of FIG. 21, but without a diffuser.

A diffuser 36 may be formed in sole 28, as shown in FIGS. 20A and 26A. In these particular embodiments, diffuser 36 extends from a region of the sole 28 that is adjacent to the hosel region 26 toward the toe 20, the back 22 and the intersection of the toe 22 with the back 22. In an alternative embodiment of club head 14 as shown in FIG. 26B as club head 94, the sole 28 may be formed without a diffuser.

Some of the example drag-reducing structures described in more detail below may provide various means to maintain laminar airflow over one or more of the surfaces of the club head 14 when the ball striking face 17 is generally leading the swing, i.e., when air flows over the club head 14 from the ball striking face 17 toward the back 22. Additionally, some of the example drag-reducing structures described in more detail below may provide various means to maintain laminar airflow over one or more surfaces of the club head 14 when the heel 24 is generally leading the swing, i.e., when air flows over the club head 14 from the heel 24 toward the toe 20. Moreover, some of the example drag-reducing structures described in more detail below may provide various means to maintain laminar airflow over one or more surfaces of the club head 14 when the hosel region 26 is generally leading the swing, i.e., when air flows over the club head 14 from the hosel region 26 toward the toe 20 and/or the back 22. The example drag-reducing structures disclosed herein may be incorporated singly or in combination in club head 14 and are applicable to any and all embodiments of club head 14.

According to certain aspects, and referring, for example, to FIGS. 3-6, 8-10, 15-31, a drag-reducing structure may be provided as a streamlined region 100 located on the heel 24 in the vicinity of (or adjacent to and possibly including a portion of) the hosel region 26. This streamlined region 100 may be configured so as to achieve aerodynamic benefits as the air flows over the club head 14 during a downswing stroke. As described above with respect to FIGS. 11-14, in the latter portion of the downswing, where the velocity of the club head 14 is significant, the club head 14 may rotate through a yaw angle of from approximately 70° to 0°. Further, due to the non-linear nature of the yaw angle rotation, configurations of the heel 24 designed to reduce drag due to airflow when the club head 14 is oriented between the yaw angles of approximately 70° to approximately 45° may achieve the greatest benefits.

Thus, due to the yaw angle rotation during the downswing, it may be advantageous to provide a streamlined region 100 in the heel 24. For example, providing the streamlined region 100 with a smooth, aerodynamically-shaped leading surface may allow air to flow past the club head with minimal disruption. Such a streamlined region 100 may be shaped to minimize resistance to airflow as the air flows from the heel 24 toward the toe 20, toward the back 22, and/or toward the intersection of the back 22 with the toe 20. The streamlined region 100 may be advantageously located on the heel 24 adjacent to, and possibly even overlapping with, the hosel region 26. This streamlined region of the heel 24 may form a portion of the leading surface of the club head 14 over a significant portion of the downswing. The streamlined region 100 may extend along the entire heel 24. Alternatively, the streamlined region 100 may have a more limited extent.

Figure 27:
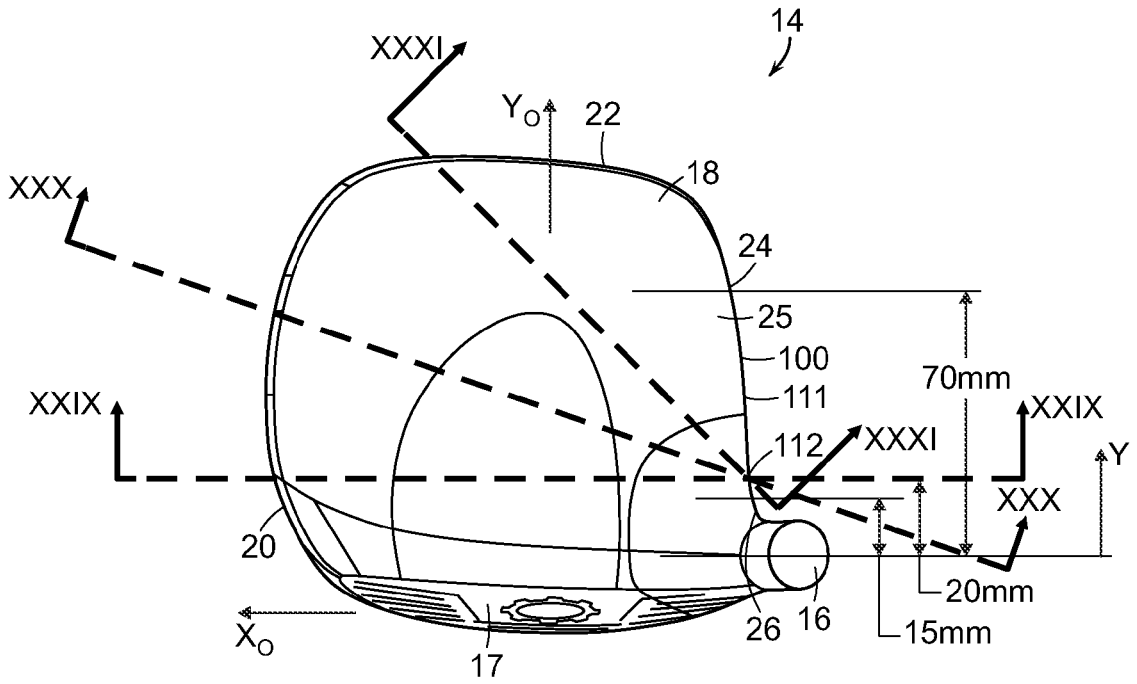
FIG. 27 is a top plan view of the club head of FIGS. 1-6, without a diffuser, in a 60 degree lie angle position, showing cross-sectional cuts taken through point 112.
Figure 28:
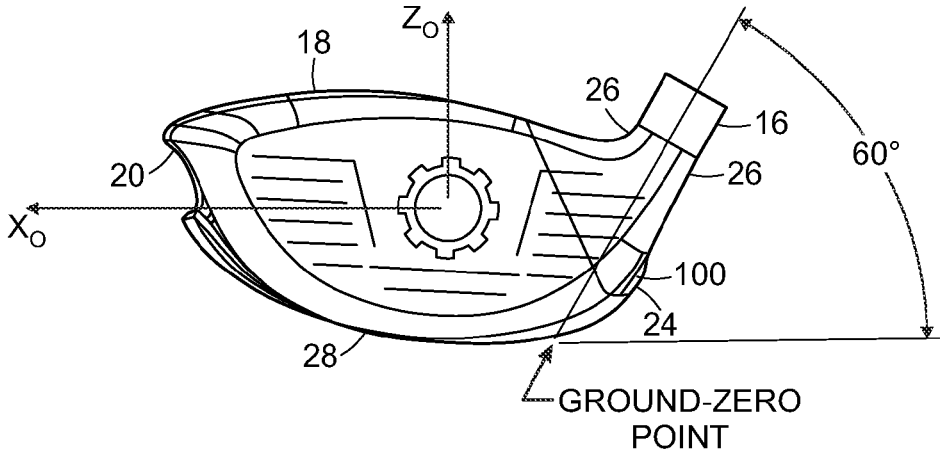
FIG. 28 is a front elevation view of the club head of FIG. 27 in the 60 degree lie angle position.

Referring to FIGS. 27 and 28, according to certain aspects, the streamlined region 100 as, for example, referenced in FIGS. 3-6, 8-10 and 15-31 may be provided at least along the length of the heel 24 from approximately 15 mm to approximately 70 mm in the Y-direction, as measured from a longitudinal axis of the shaft 12 or from where the longitudinal axis of the shaft 12 meets the ground, i.e., at the "ground-zero" point, when the club is at a 60 degree lie angle position with a face angle of zero degrees. In these embodiments, the streamlined region 100 may also optionally extend beyond the enumerated range. For certain other embodiments, the streamlined region 100 may be provided at least from approximately 15 mm to approximately 50 mm in the Y-direction along the length of the heel 24, as measured from the ground-zero point. For further embodiments, the streamlined region 100 may be provided at least from approximately 15 mm to approximately 30 mm, or even at least from approximately 20 mm to approximately 25 mm, in the Y-direction along the length of the heel 24, as measured from the ground-zero point.

Figure 29A:
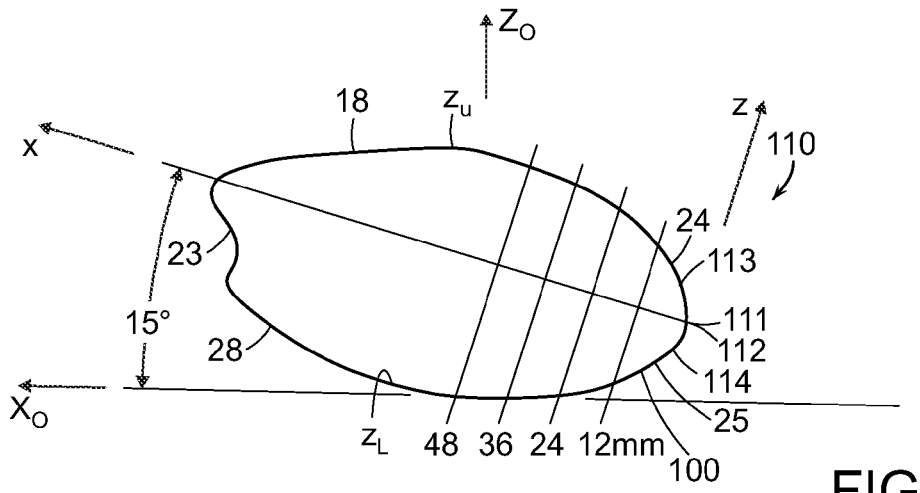
FIGS. 29A and 29B are cross-sectional cuts taken through line XXIX-XXIX of FIG. 27.
Figure 30A:
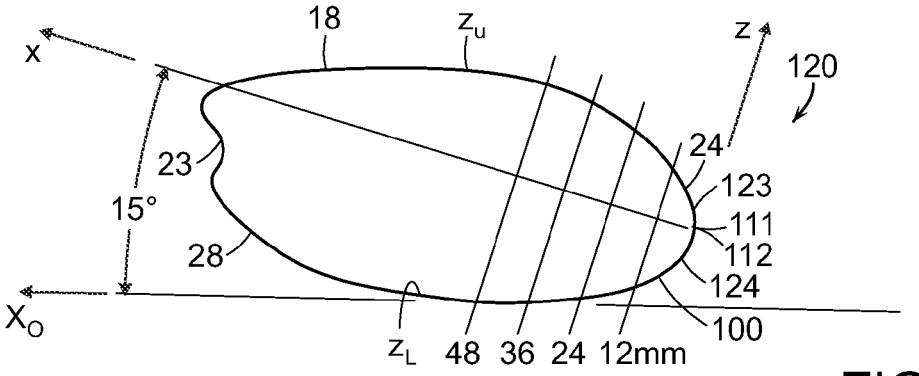
FIGS. 30A and 30B are cross-sectional cuts taken through line XXX-XXX of FIG. 27.
Figure 31A:
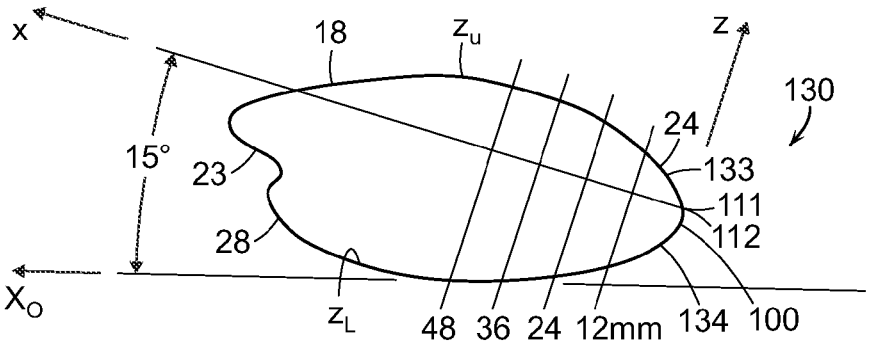
FIGS. 31A and 31B are cross-sectional cuts taken through line XXXI-XXXI of FIG. 27.
Figure 29B:
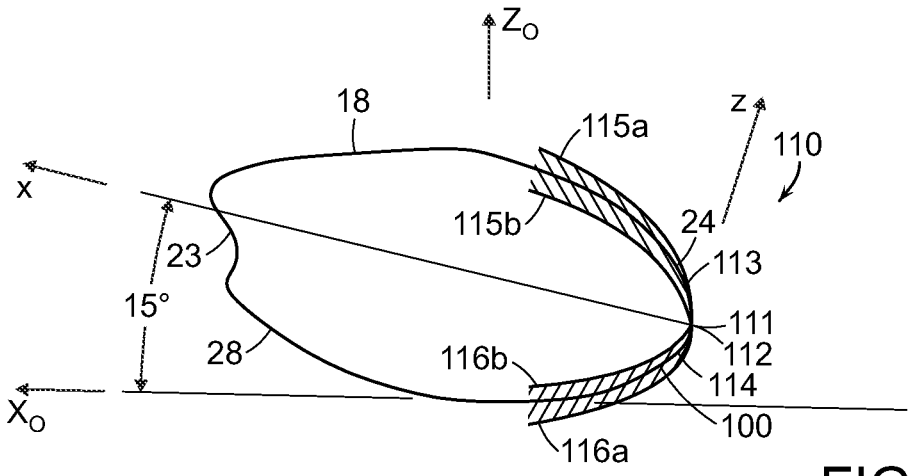
Figure 30B:
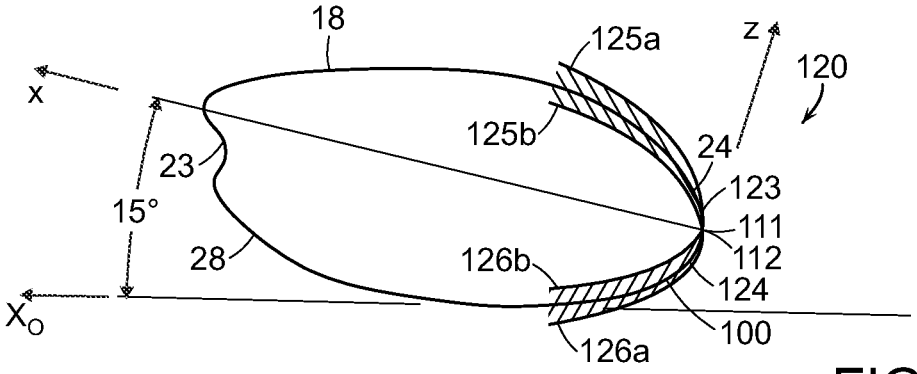
Figure 31B:
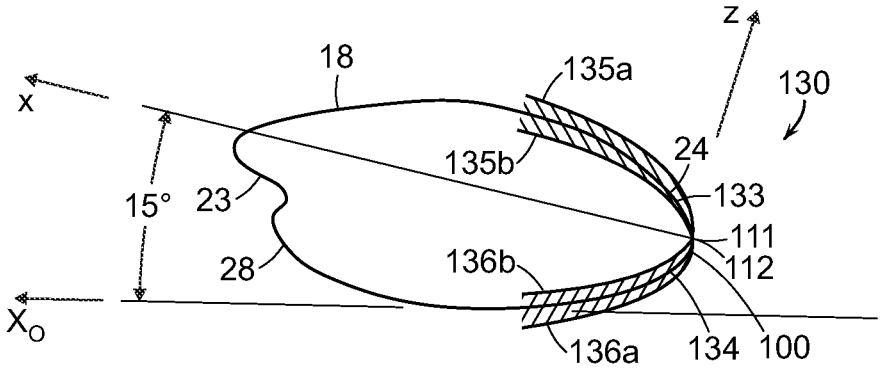

FIG. 27 is shown with three cross-section cuts. The cross-section at line XXIX-XXIX is shown in FIGS. 29A and 29B. The cross-section at line XXX-XXX is shown in FIGS. 30A and 30B. The cross-section at line XXXI-XXXI is shown in FIGS. 31A and 31B. The cross-sections shown in FIGS. 29-31 are used to illustrate specific characteristics of club head 14 of FIGS. 1-6 and are also used to schematically illustrate characteristics of the club head embodiments shown in FIGS. 7-10, FIGS. 15-20 and FIGS. 21-26.

According to certain aspects and referring to FIGS. 29A and 29B, the streamlined region 100 may be defined by a cross-section 110 in the heel 24. FIGS. 29A and 29B illustrate a cross-section 110 of club head 14 taken through line XXIX-XXIX of FIG. 27. A portion of the cross-section 110 cuts through the sole 28, the crown 18 and the heel 24. Further, at least a portion of the cross-section 110 lies within the streamlined region 100, and thus, as discussed above, the leading portion of the cross-section 110 may resemble an airfoil. The cross-section 110 is taken parallel to the $X_0$-axis (i.e., approximately 90 degrees from the $Y_0$-axis (i.e., within a range of ±5 degrees)) in a vertical plane located approximately 20 mm in the Y-direction as measured from the ground-zero point. In other words, the cross-section 110 is oriented perpendicular to the $Y_0$-axis. This cross-section 110 is thus oriented for air flowing over the club head 14 in a direction from the heel 24 to the toe 20.

Referring to FIGS. 27, 29A and 29B, a leading edge 111 is located on the heel 24. The leading edge 111 extends generally from the hosel region 26 toward the back 22 and lies between the crown 18 and the sole 28. If air were to flow parallel to the $X_0$-axis over the club head 14 from the heel 24 toward the toe 20, the leading edge 111 would be the first portion of the heel 24 to experience the air flow. Generally, at the leading edge 111, the slope of the surface of the cross-section 110 is perpendicular to the $X_0$-axis, i.e., the slope is vertical when the club head 14 is at the 60 degree lie angle position.

An apex point 112, which lies on the leading edge 111 of the heel 24 may be defined at Y=20 mm (see FIG. 27). Further, a local coordinate system associated with the cross-section 110 and the apex point 112 may be defined: x- and z-axes extending from the apex point 112 are oriented in the plane of the cross-section 110 at an angle of 15° from the $X_0$- and $Z_0$-axes, respectively, associated with the club head 14. This orientation of the axes at 15° corresponds to the roll angle of 15°, which was considered to be representative over the course of a waist-to-knee portion of the downswing (i.e., when the club head 14 approaches its greatest velocity).

Thus, according to certain aspects, the airfoil-like surface 25 of the streamlined region 100 may be described as being "quasi-parabolic." As used herein, the term "quasi-parabolic" refers to any convex curve having an apex point 112 and two arms that smoothly and gradually curve away from the apex point 112 and from each other on the same side of the apex point. The first arm of the airfoil-like surface 25 may be referred to as a crown-side curve or upper curve 113. The other arm of the airfoil-like surface 25 may be referred to as a sole-side curve or lower curve 114. For example, a branch of a hyperbolic curve may be considered to be quasi-parabolic. Further, as used herein, a quasi-parabolic cross-section need not be symmetric. For example, one arm of the quasi-parabolic cross-section may be most closely represented by a parabolic curve, while the other arm may be most closely represented by a hyperbolic curve. As another example, the apex point 112 need not be centered between the two arms. In which case, the term "apex point" refers to the leading point of the quasi-parabolic curve, i.e., the point from which the two curves 113, 114 curve away from each other. In other words, a "quasi-parabolic" curve oriented with the arms extending horizontally in the same direction has a maximum slope at the apex point 112 and the absolute values of the slope of the curves 113, 114 gradually and continuously decrease as the horizontal distance from the apex point 112 increases.

FIGS. 30A and 30B illustrate a cross-section 120 of club head 14 taken through line XXX-XXX of FIG. 27. According to certain aspects and referring to FIGS. 30A and 30B, the streamlined region 100 may be defined by its cross-section 120 in the heel 24. The cross-section 120 is taken at an angle of approximately 70 degrees (i.e., within a range of ±5 degrees) to the $Y_0$-axis, rotated around the apex point 112, as shown in FIG. 27. This cross-section 120 is thus also oriented for air flowing over the club head 14 in a direction from the heel 24 to the toe 20, but now with the direction of airflow angled more toward the intersection of the toe 20 with the back 22 as compared to the cross-section 110 (refer to FIG. 14A). Similar to the cross-section 110, the cross-section 120 includes a crown-side curve or upper curve 123 extending from the apex point 112 and a sole-side curve or lower curve 124 also extending from the apex point. The apex point 112, which is associated with the leading edge 111 of the heel 24 at Y=20 mm, is shown.

The x- and z-axes associated with cross-section 120 are oriented in the plane of the cross-section 120 at an angle of 15° from the $X_0$- and $Z_0$-axes, respectively, associated with the club head 14. Once again, this orientation of the cross-sectional axes at 15° corresponds to a roll angle of 15°, which was considered to be representative over the course of a waist-to-knee portion of the downswing (i.e., when the club head 14 approaches its greatest velocity).

FIGS. 31A and 31B illustrate a cross-section 130 of club head 14 taken through line XXXI-XXXI of FIG. 27. According to certain aspects and referring to FIGS. 31A and 31B, the streamlined region 100 may be defined by its cross-section 130 in the heel 24. As discussed above, the cross-section 130 of the streamlined region 100 may resemble the leading edge of an airfoil. The cross-section 130 is taken at an angle of approximately 45 degrees (i.e., within a range of ±5 degrees) to the Y-axis, rotated around the apex point 112, as shown in FIG. 27. This cross-section 130 is thus oriented for air flowing over the club head 14 generally in a direction from the heel 24 to the back 22 (refer to FIG. 14C). Similar to the cross-sections 110 and 120, the cross-section 130 also includes a crown-side curve or upper curve 133 extending from the apex point 112 and a sole-side curve or lower curve 134 also extending from the apex point. The apex point 112, which is associated with the leading edge 111 of the heel 24 at Y=20 mm, as measured from the ground-zero point, is shown.

The x- and z-axes associated with cross-section 130 are oriented in the plane of the cross-section 130 at an angle of 15° from the $X_0$- and $Z_0$-axes, respectively, associated with the club head 14. Once again, this orientation of the cross-sectional axes at 15° corresponds to a roll angle of 15°, which was considered to be representative over the course of a waist-to-knee portion of the downswing (i.e., when the club head 14 approaches its greatest velocity).

Referring to FIGS. 29A, 30A and 31A, a person of ordinary skill in the art would recognize that one way to characterize the shape of a curve is by providing a table of spline points. For purposes of these spline point tables, the apex point 112 is defined at (0, 0) and all of the coordinates of the spline points are defined relative to the apex point 112. FIGS. 29A, 30A and 31A include x-axis coordinate lines at 12 mm, 24 mm, 36 mm, 48 mm at which spline points may be defined. Although spline points may be defined at other x-axis coordinates, for example, at 3 mm, 6 mm and 18 mm, such coordinate lines are not included in FIGS. 29A, 30A and 31A for purposes of clarity.

As shown in FIGS. 29A, 30A and 31A, the $z_U$-coordinates are associated with the upper curves 113, 123, 133; the $z_L$-coordinates are associated with the lower curves 114, 124, 134. The upper curves are generally not the same as the lower curves. In other words, the cross-sections 110, 120, 130 may be non-symmetric. As can be seen from examining FIGS. 29A, 30A and 31A, this non-symmetry, i.e. the differences between the upper and lower curves, may become more pronounced as the cross-sections swing toward the back of the club head. Specifically, the upper and lower curves of the cross-section taken at an angle of approximately 90 degrees to the centerline (see, e.g., FIG. 29A) may be more symmetrical than the upper and lower curves of the cross-section taken at an angle of approximately 45 degrees to the centerline (see, e.g., FIG. 31A). Furthermore, again referring to FIGS. 29A, 30A and 31A, the lower curves may, for some example embodiments, remain relatively constant as the cross-section swings toward the back of the club head, while the upper curves may flatten out.

Referring to FIGS. 29B, 30B and 31B, a person of ordinary skill in the art would recognize that another way to characterize a curve is by fitting the curve to one or more functions. For example, because of the asymmetry of the upper and lower curves as discussed above, the upper and lower curves of cross-sections 110, 120, 130 may be independently curve fit using polynomial functions. Thus, according to certain aspects, second-order or third-order polynomials, i.e., quadratic or cubic functions, may sufficiently characterize the curves.

For example, a quadratic function may be determined with the vertex of the quadratic function being constrained to be the apex point 112, i.e., the (0, 0) point. In other words, the curve fit may require that the quadratic function extend through the apex point 112. Further the curve fit may require that the quadratic function be perpendicular to the x-axis at the apex point 112.

Another mathematical technique that may be used to curve fit involves the use of Bézier curves, which are parametric curves that may be used to model smooth curves. Bézier curves, for example, are commonly used in computer numerical control (CNC) machines for controlling the machining of complex smooth curves.

Using Bézier curves, the following generalized parametric curves may be used to obtain, respectively, the x- and z-coordinates of the upper curve of the cross-section:

$$x_U=(1-t)^3Pxu_0+3(1-t)^2tPxu_1+3(1-t)t^2Pxu_2+t^3Pxu_3 \quad \text{Equ. (1a)}$$

$$z_U=(1-t)^3Pzu_0+3(1-t)^2tPzu_1+3(1-t)t^2Pzu_2+t^3Pzu_3 \quad \text{Equ. (1b)}$$

over the range of: $0 \leq t \leq 1$.

$Pxu_0$, $Pxu_1$, $Pxu_2$ and $Pxu_3$ are the control points for the Bézier curve for the x-coordinates associated with the upper curve, and $Pzu_0$, $Pzu_1$, $Pzu_2$ and $Pzu_3$ are the control points for the Bézier curve for the z-coordinates associated with the upper curve.

Similarly, the following generalized parametric Bézier curves may be used to obtain, respectively, the x- and z-coordinates of the lower curve of the cross-section:

$$x_L=(1-t)^3P_{XL_0}+3(1-t)^2tP_{XL_1}+3(1-t)t^2P_{XL_2}+t^3P_{XL_3} \quad \text{Equ. (2a)}$$

$$z_L=(1-t)^3P_{ZL_0}+3(1-t)^2tP_{ZL_1}+3(1-t)t^2P_{ZL_2}+t^3P_{ZL_3} \quad \text{Equ. (2b)}$$

over the range of: $0 \leq t \leq 1$.

$PXL_0$, $PXL_1$, $PXL_2$ and $PXL_3$ are the control points for the Bézier curve for the x-coordinates associated with the lower curve, and $PZL_0$, $PZL_1$, $PZL_2$ and $PZL_3$ are the control points for the Bézier curve for the z-coordinates associated with the lower curve.

Since curve fits are used to generally fit the data, one way to capture the data may be to provide curves that bound the data. Thus, for example, referring to FIGS. 29B, 30B, 31B, each of the upper and lower curves of cross-sections 110, 120, 130 may be characterized as residing within a region bounded by a pair of curves (115*a*, 115*b*), (116*a*, 116*b*), (125*a*, 125*b*), (126*a*, 126*b*), (135*a*, 135*b*), (136*a*, 136*b*) wherein the pairs of curves may, for example, represent a variation in the z-coordinates of the curves 113, 114, 123, 124, 133 and 134, respectively, of up to ±10%, or even up to 20%.

Further, it is noted that the cross-sections 110, 120 and 130 presented in FIGS. 29-31 are for a club head 14 without a diffuser 36 provided on the sole 28. According to certain aspects, a diffuser 36 may be provided on the sole 28, and as such, the lower curves of the cross-sections 110, 120 and/or 130 would vary from the shapes presented in FIGS. 29-31. Even further, according to certain aspects, each of the cross-sections 110, 120 and 130 may include a Kammback feature 23 at their trailing edge.

Referring back to FIGS. 27 and 28, it is noted that the apex point 112, which is associated with the leading edge 111 of the heel 24 at Y=20 mm (see FIG. 27), was used to assist in the description of the cross-sections 110, 120 and 130 (see FIGS. 29-31). However, the apex point 112 need not be positioned precisely at Y=20 mm. In the more general case, according to certain aspects, the apex point 112 may be position from approximately 10 mm to approximately 30 mm in the Y-direction as measured from the "ground-zero" point. For some embodiments, the apex point 112 may be position from approximately 15 mm to approximately 25 mm in the Y-direction as measured from the "ground-zero" point. A variation of plus or minus a millimeter in the location of the apex point may be considered acceptable. According to certain embodiments, the apex point 112 may be positioned on the leading edge 111 of the heel 24 in the forward half of the club head 14.

Figure 20B:
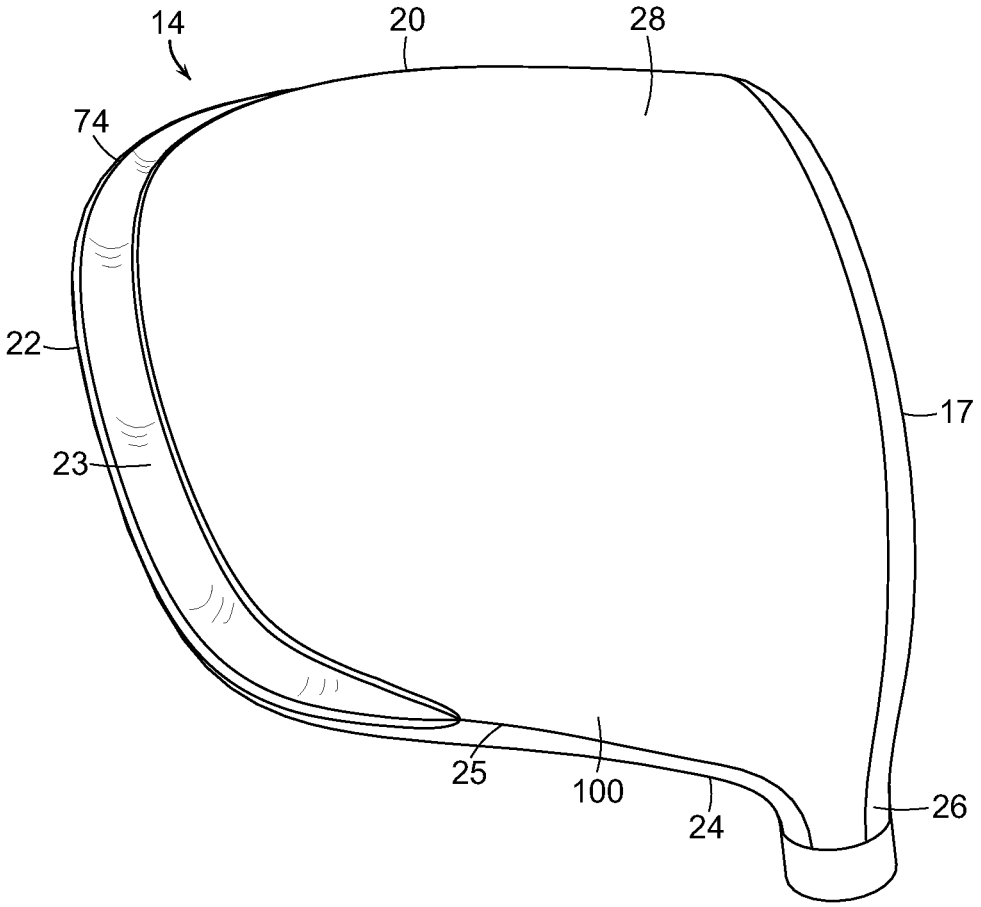
FIG. 20B is a bottom perspective view of an alternative embodiment of a club head that is similar to the club head of FIG. 15, but without a diffuser.
Figure 21:
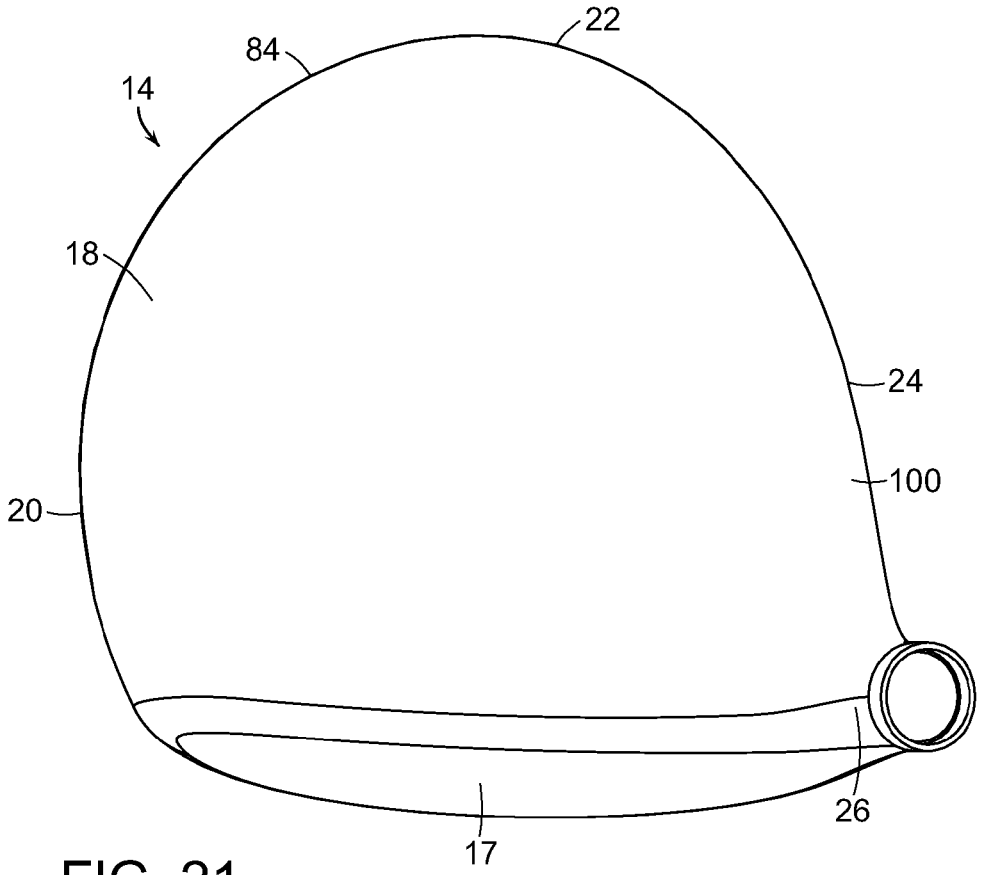
FIG. 21 is a top plan view of a club head according to other illustrative aspects.
Figure 22:
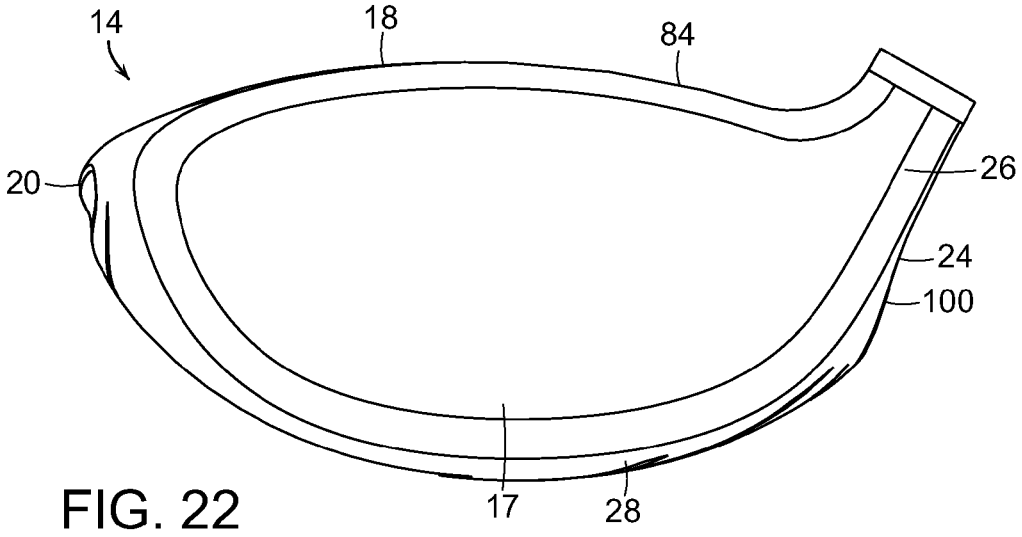
FIG. 22 is a front elevation view of the club head of FIG. 21.

According to certain aspects and as best shown in FIG. 20B, the sole 28 may extend across the width of the club head 14, from the heel 24 to the toe 20, with a generally convex, gradual, widthwise curvature. Further, the smooth and uninterrupted, airfoil-like surface 25 of the heel 24 may continue into, and even beyond, a central region of the sole 28. The sole's generally convex, widthwise, curvature may extend all the way across the sole 28 to the toe 20. In other words, the sole 28 may be provided with a convex curvature across its entire width, from the heel 24 to the toe 20.

Further, the sole 28 may extend across the length of the club head 14, from the ball striking face 17 to the back 22, with a generally convex smooth curvature. This generally convex curvature may extend from adjacent the ball striking surface 17 to the back 22 without transitioning from a positive to a negative curvature. In other words, the sole 28 may be provided with a convex curvature along its entire length from the ball striking face 17 to the back 22.

Figure 5:
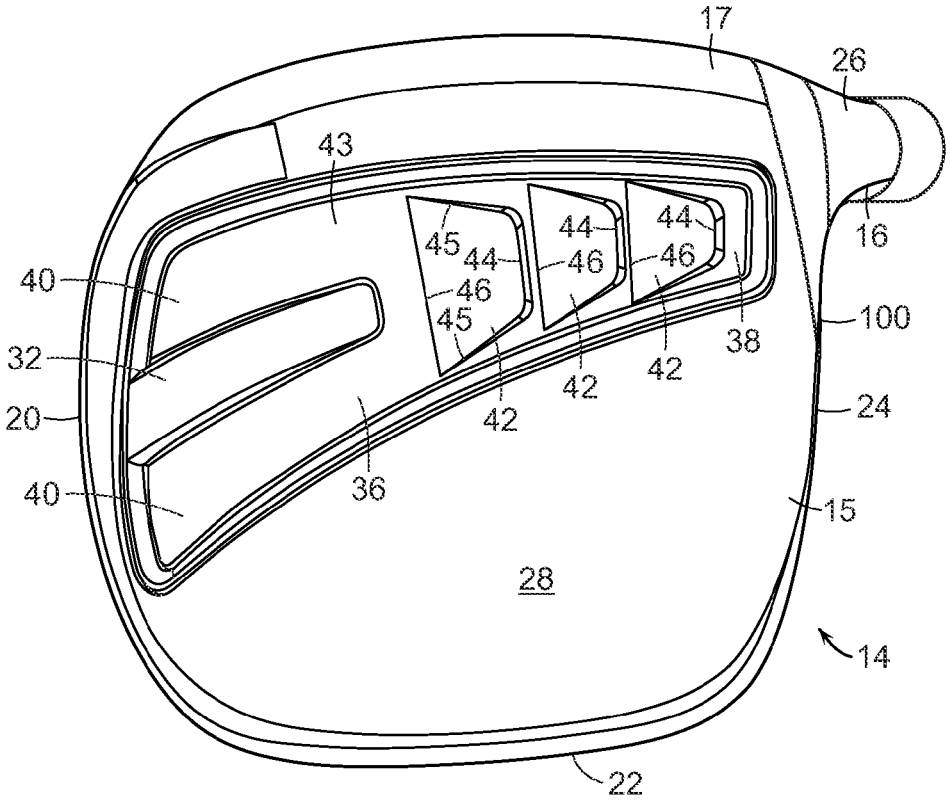
FIG. 5 is a plan view of the sole of the club head of the golf club of FIG. 1A.

Alternatively, according to certain aspects, as illustrated, for example, in FIGS. 5, 20A and 26A, a recess or diffuser 36 may be formed in sole 28. In the illustrated embodiment of FIG. 5, recess or diffuser 36 is substantially V-shaped with a vertex 38 of its shape being positioned proximate ball striking face 17 and heel 24. That is, vertex 38 is positioned close to ball striking face 17 and heel 24 and away from skirt or Kammback feature 23 and toe 20. Recess or diffuser 36 includes a pair of legs 40 extending to a point proximate toe 20 and away from ball striking face 17, and curving toward skirt or Kammback feature 23 and away from ball striking face 17.

Still referring to FIG. 5, a plurality of secondary recesses 42 may be formed in a bottom surface 43 of recess or diffuser 36. In the illustrated embodiment, each secondary recess 42 is a regular trapezoid, with its smaller base 44 closer to heel 24 and its larger base 46 closer to toe 20, and angled sides 45 joining smaller base 44 to larger base 46. In the illustrated embodiment a depth of each secondary recess 42 varies from its largest amount at smaller base 44 to larger base 46, which is flush with bottom surface 43 of recess or diffuser 36.

Thus, according to certain aspects and as best shown in FIGS. 5, 20A and 26A, diffuser 36 may extend from adjacent the hosel region 26 toward the toe 20, toward the intersection of the toe 20 with the back 22 and/or toward the back 22. The cross-sectional area of the diffuser 36 may gradually increase as the diffuser 36 extends away from the hosel region 26. It is expected than any adverse pressure gradient building up in an air stream flowing from the hosel region 26 toward the toe 20 and/or toward the back 22 will be mitigated by the increase in cross-sectional area of the diffuser 36. Thus, it is expected that any transition from the laminar flow regime to the turbulent flow regime of the air flowing over the sole 28 will be delayed or even eliminated altogether. In certain configurations, the sole 28 may include multiple diffusers.

The one or more diffusers 36 may be oriented to mitigate drag during at least some portion of the downswing stroke, particularly as the club head 14 rotates around the yaw axis. The sides of the diffuser 36 may be straight or curved. In certain configurations, the diffuser 36 may be oriented at an angle from the $Y_0$-axis in order to diffuse the air flow (i.e., reduce the adverse pressure gradient) when the hosel region 26 and/or the heel 24 lead the swing. The diffuser 36 may be oriented at angles that range from approximately 10° to approximately 80° from the $Y_0$-axis. Optionally, the diffuser 36 may be oriented at angles that range from approximately 20° to approximately 70°, or from approximately 30° to approximately 70°, or from approximately 40° to approximately 70°, or even from approximately 45° to approximately 65° from the $Y_0$-axis. Thus, in certain configurations, the diffuser 36 may extend from the hosel region 26 toward the toe 20 and/or toward the back 22. In other configurations, the diffuser 36 may extend from the heel 24 toward the toe 20 and/or the back 22.

Optionally, as shown in FIGS. 5, 20A and 26, the diffuser 36 may include one or more vanes 32. The vane 32 may be located approximately centered between the sides of the diffuser 36. In certain configurations (not shown), the diffuser 36 may include multiple vanes. In other configurations, the diffuser 36 need not include any vane. Even further, the vane 32 may extend substantially along the entire length of the diffuser 36 or only partially along the length of the diffuser 36.

Figure 2:
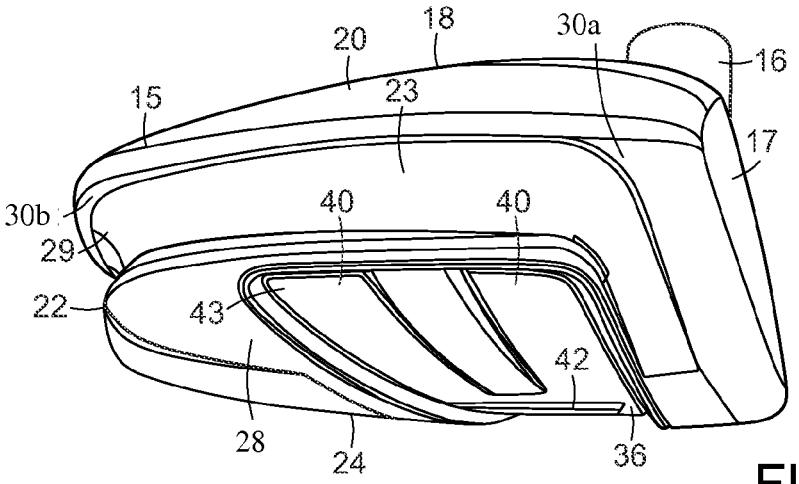
FIG. 2 is a side perspective view of the club head of the golf club of FIG. 1A.
Figure 6:
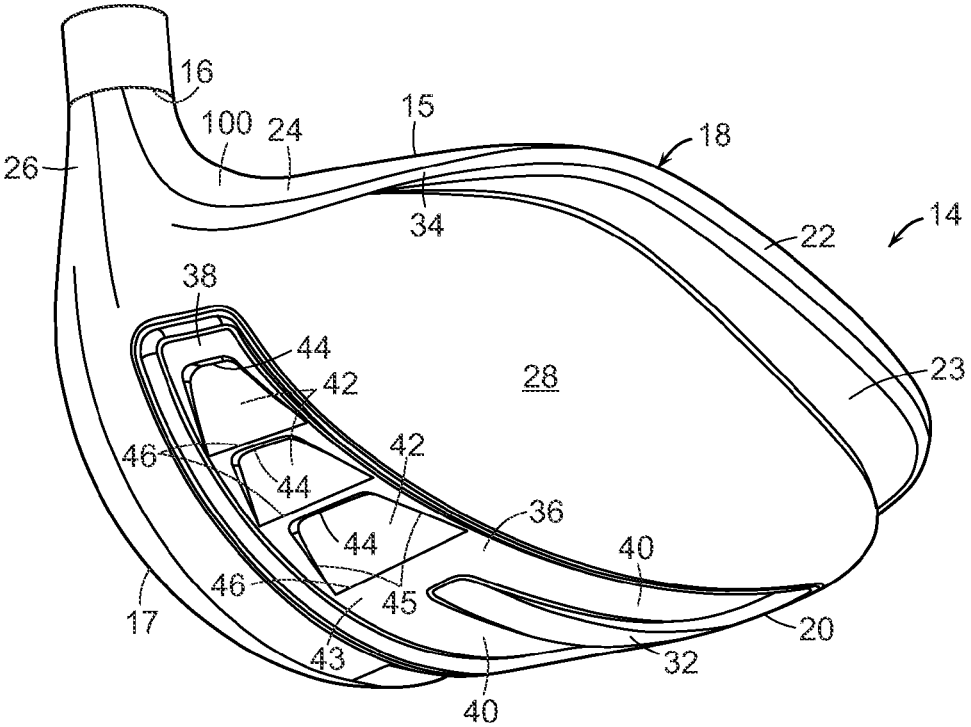
FIG. 6 is a bottom perspective view of the club head of the golf club of FIG. 1A.
Figure 8:
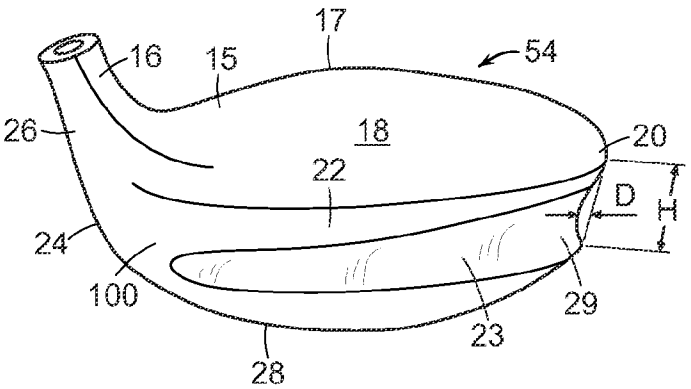
FIG. 8 is a back elevation view of the club head of FIG. 7.
Figure 10:
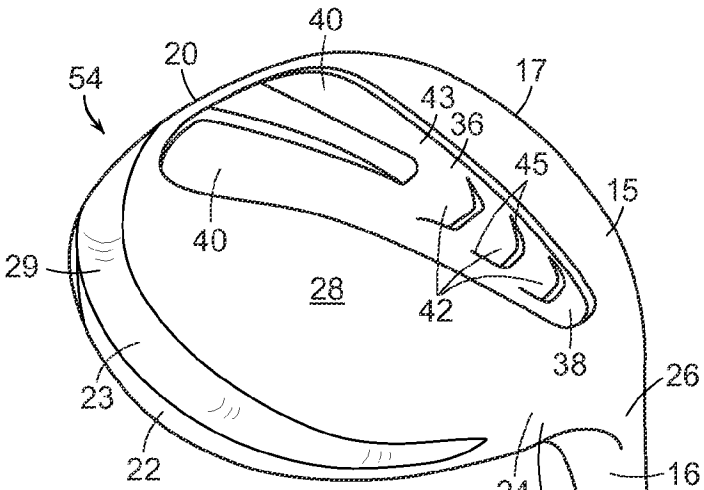
FIG. 10 is a bottom perspective view of the club head of FIG. 7.
Figure 7:
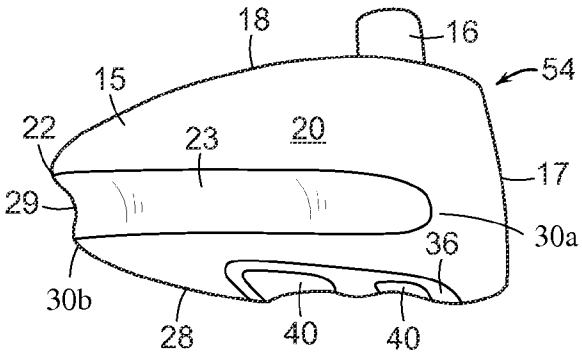
FIG. 7 is a side elevation view of an alternative embodiment of the club head of the golf club of FIG. 1A, viewed from a toe side of the club head.

As shown, according to one embodiment, in FIGS. 1-4 and 6, the club head 14 may include the "Kammback" feature 23. The Kammback feature 23 may extend from the crown 18 to the sole 28. As shown in FIGS. 3 and 6, the Kammback feature 23 extends across the back 22 from the heel 24 to the toe 20. Further, as shown in FIGS. 2 and 4, the Kammback feature 23 may extend into the toe 22 and/or into the heel 24.

Generally, Kammback features are designed to take into account that a laminar flow, which could be maintained with a very long, gradually tapering, downstream (or trailing) end of an aerodynamically-shaped body, cannot be maintained with a shorter, tapered, downstream end. When a downstream tapered end would be too short to maintain a laminar flow, drag due to turbulence may start to become significant after the downstream end of a club head's cross-sectional area is reduced to approximately fifty percent of the club head's maximum cross section. This drag may be mitigated by shearing off or removing the too-short tapered downstream end of the club head, rather than maintaining the too-short tapered end. It is this relatively abrupt cut off of the tapered end that is referred to as the Kammback feature 23.

During a significant portion of the golfer's downswing, as discussed above, the heel 24 and/or the hosel region 26 lead the swing. During these portions of the downswing, either the toe 20, portion of the toe 20, the intersection of the toe 20 with the back 22, and/or portions of the back 22 form the downstream or trailing end of the club head 14 (see, e.g., FIGS. 27 and 29-31). Thus, the Kammback feature 23, when positioned along the toe, at the intersection of the toe 20 with the back 22, and/or along the back 22 of the club head 14, may be expected to reduce turbulent flow, and therefore reduce drag due to turbulence, during these portions of the downswing.

Further, during the last approximately 20° of the golfer's downswing prior to impact with the golf ball, as the ball striking face 17 begins to lead the swing, the back 22 of the club head 14 becomes aligned with the downstream direction of the airflow. Thus, the Kammback feature 23, when positioned along the back 22 of club head 14, is expected to reduce turbulent flow, and therefore reduce drag due to turbulence, most significantly during the last approximately 20° of the golfer's downswing.

According to certain aspects, the Kammback feature 23 may include a continuous groove 29 formed about a portion of a periphery of club head 14. As illustrated in FIGS. 2-4, groove 29 extends from a front portion 30*a* of toe 20 completely to a rear edge 30*b* of toe 20, and continues on to back 22. Groove 29 then extends across the entire length of back 22. As can be seen in FIG. 4, groove 29 tapers to an end in a rear portion 34 of heel 24. In certain embodiments (see FIG. 2), groove 29 at front portion 30*a* of toe 20 may turn and continue along a portion of sole 28.

In the illustrated embodiment of FIGS. 2-4, groove 29 is substantially U-shaped. In certain embodiments, groove 29 has a maximum depth (D) of approximately 15 mm. It is to be appreciated however, that groove 29 may have any depth along its length, and further that the depth of groove 29 may vary along its length. Even further, it is to be appreciated that groove 29 may have any height (H), although a height of from one-quarter to one-half of the maximum sole-to-crown height of the club head 14 may be most advantageous. The height of the groove 29 may vary over its length, as shown in FIGS. 2-4, or alternatively, the height of the groove 29 may be uniform over some or all of its length.

As air flows over crown 18 and sole 28 of body member 15 of club head 14, it tends to separate, which causes increased drag. Groove 29 may serve to reduce the tendency of the air to separate, thereby reducing drag and improving the aerodynamics of club head 14, which in turn increases club head speed and the distance that the ball will travel after being struck. Having groove 29 extend along toe 20 may be particularly advantageous, since for the majority of the swing path of golf club head 14, the leading portion of club head 14 is heel 24 with the trailing edge of club head 14 being toe 20, as noted above. Thus, the aerodynamic advantage provided by groove 29 along toe 20 is realized during the majority of the swing path. The portion of groove 29 that extends along the back 22 may provide an aerodynamic advantage at the point of impact of club head 14 with the ball.

An illustrative example of the reduction in drag during the swing provided by groove 29 is provided in the table below. This table is based on a computer fluid dynamic (CFD) model for the embodiment of club head 14 as shown in FIGS. 1-6. In the table, drag force values are shown for different degrees of yaw throughout the golf swing for both a square head design and for the square head design incorporating the drag-reducing structure of groove 29.

| | Drag Force | | | | | |
|---|---|---|---|---|---|---|
| | Yaw | | | | | |
| | 90° | 70° | 60° | 45° | 20° | 0° |
| Standard | 0 | 3.04 | 3.68 | 8.81 | 8.60 | 8.32 |
| W/Groove | 0 | 1.27 | 1.30 | 3.25 | 3.39 | 4.01 |

From the results of the computer model, it can be seen that at the point of impact, where the yaw angle is 0°, the drag force for the square club head with groove 29 is approximately 48.2% (4.01/8.32) of that of the square club head. However, an integration of the total drag during the entire swing for the square club head provides a total drag work of 544.39, while the total drag work for the square club head with groove 29 is 216.75. Thus the total drag work for the square club head with groove 29 is approximately 39.8% (216.75/544.39) of that of the square club head. Thus, integrating the drag force throughout the swing can produce a very different result than calculating the drag force at the point of impact only.

Figure 9:
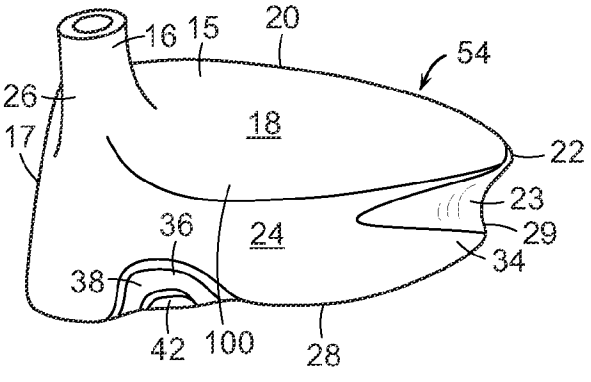
FIG. 9 is a side elevation view of the club head of FIG. 7, viewed from a heel side of the club head.

Referring to FIGS. 7-10, continuous groove 29 is formed about a portion of a periphery of club head 54. As illustrated in FIGS. 7-10, groove 29 extends from a front portion 30*a* of toe 20 completely to a rear edge 30*b* of toe 20, and continues on to back 22. Groove 29 then extends across the entire length of back 22. As can be seen in FIG. 9, groove 29 tapers to an end in a rear portion 34 of heel 24.

One or more of the drag-reducing structures, such as the streamlined portion 100 of the heel 24, the diffuser 36 of the sole 28, and/or the Kammback feature 23, may be provided on the club head 14 in order to reduce the drag on the club head during a user's golf swing from the end of a user's backswing throughout the downswing to the ball impact location. Specifically, the streamlined portion 100 of the heel 24, the diffuser 36, and the Kammback feature 23 may be provided to reduce the drag on the club head 14 primarily when the heel 24 and/or the hosel region 26 of the club head 14 are generally leading the swing. The Kammback feature 23, especially when positioned within the back 22 of the club head 14, may also be provided to reduce the drag on the club head 14 when the ball striking face 17 is generally leading the swing.

Different golf clubs are designed for the different skills that a player brings to the game. For example, professional players may opt for clubs that are highly efficient at transforming the energy developed during the swing into the energy driving the golf ball over a very small sweet spot or desired-point-of-contact. In contrast, weekend players may opt for clubs designed to forgive less-than-perfect placement of the club's sweet spot relative to the struck golf ball. In order to provide these differing club characteristics, clubs may be provided with club heads having any of various weights, volumes, moments-of-inertias, center-of-gravity placements, stiffnesses, face (i.e., ball-striking surface) heights, widths and/or areas, etc.

Figure 32B:
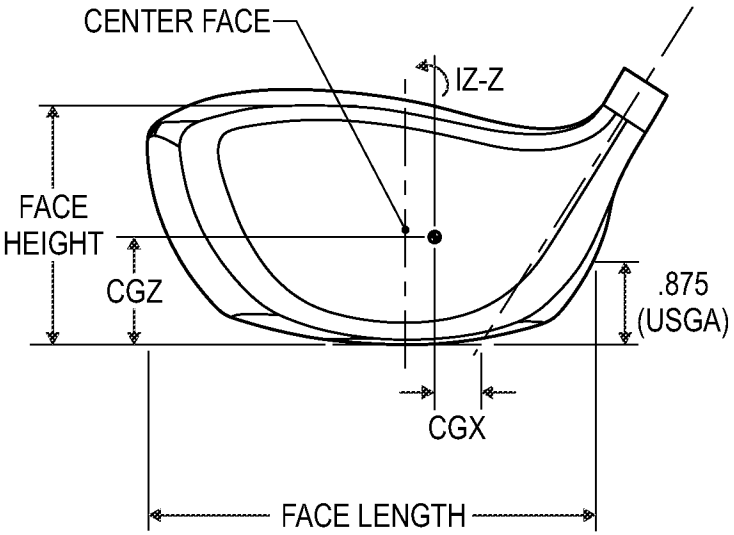
FIGS. 32A and 32B are schematics (top plan view and front elevation) of a club head illustrating certain other physical parameters.
Figure 32A:
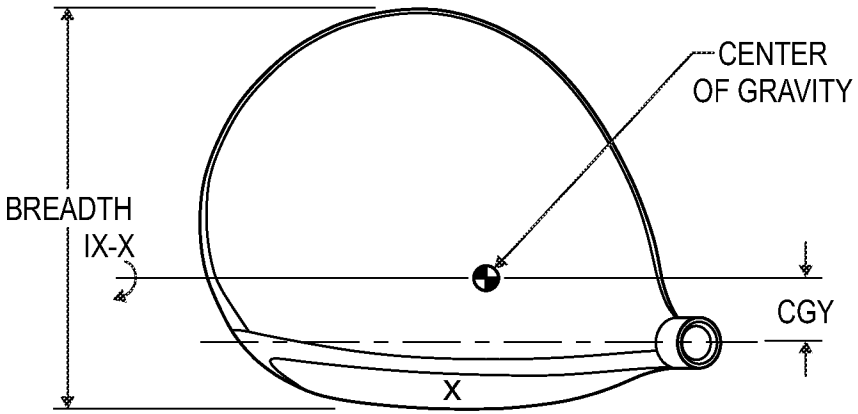

The club heads of typical modern drivers may be provided with a volume that ranges from approximately 420 cc to approximately 470 cc. Club head volumes, as presented herein, are as measured using the USGA "Procedure for Measuring the Club Head Size of Wood Clubs" (Nov. 21, 2003). The club head weight for a typical driver may range from approximately 190 g to approximately 220 g. Referring to FIGS. 32A and 32B, other physical properties of a typical driver can be defined and characterized. For example, the face area may range from approximately 3000 $mm^2$ to approximately 4800 $mm^2$, with a face length that may range from approximately 110 mm to approximately 130 mm and a face height that may range from approximately 48 mm to approximately 62 mm. The face area is defined as the area bounded by the inside tangent of a radius which blends the ball striking face to the other portions of the body member of the golf club head. The face length is measured from opposed points on the club head as shown in FIG. 32B. The face height is defined as the distance measured at the face center (see USGA, "Procedure for Measuring the Flexibility of a Golf ClubHead," Section 6.1 Determination of Impact Location, for determining the location of the face center) from the ground plane to the midpoint of the radius which blends the ball striking face and crown of the club as measured when the club is sitting at a lie angle of 60 degrees with a face angle of zero degrees. The club head breadth may range from approximately 105 mm to approximately 125 mm. The moment-of-inertia at the center-of-gravity around an axis parallel to the $X_0$-axis may range from approximately 2800 g-$cm^2$ to approximately 3200 g-$cm^2$. The moment-of-inertia at the center-of-gravity around an axis parallel to the $Z_0$-axis may range from approximately 4500 g-$cm^2$ to approximately 5500 g-$cm^2$. For typical modern drivers, the location of the center-of-gravity in the $X_0$ direction of the club head (as measured from the ground-zero point) may range from approximately 25 mm to approximately 33 mm; the location of the center-of-gravity in the $Y_0$ direction may also range from approximately 16 mm to approximately 22 mm (also as measured from the ground-zero point); and the location of the center-of-gravity in the $Z_0$ direction may also range from approximately 25 mm to approximately 38 mm (also as measured from the ground-zero point).

The above-presented values for certain characteristic parameters of the club heads of typical modern drivers are not meant to be limiting. Thus, for example, for certain embodiments, club head volumes may exceed 470 cc or club head weights may exceed 220 g. For certain embodiments, the moment-of-inertia at the center-of-gravity around an axis parallel to the $X_0$-axis may exceed 3200 g-$cm^2$. For example, the moment-of-inertia at the center-of-gravity around an axis parallel to the $X_0$-axis may be range up to 3400 g-$cm^2$, up to 3600 g-$cm^2$, or even up to or over 4000 g-$cm^2$. Similarly, for certain embodiments, the moment-of-inertia at the center-of-gravity around an axis parallel to the $Z_0$-axis may exceed 5500 g-$cm^2$. For example, the moment-of-inertia at the center-of-gravity around an axis parallel to the $Z_0$-axis may be range up to 5700 g-$cm^2$, up to 5800 g-$cm^2$, or even up to 6000 g-$cm^2$.

The design of any given golf club always involves a series of tradeoffs or compromises. The following disclosed embodiments illustrate some of these tradeoffs.

Example Embodiment (1)

In a first example, a representative embodiment of a club head as shown in FIGS. 1-6 is described. This first example club head is provided with a volume that is greater than approximately 400 cc. Referring to FIGS. 32A and 32B, other physical properties can be characterized. The face height ranges from approximately 53 mm to approximately 57 mm. The moment-of-inertia at the center-of-gravity around an axis parallel to the $X_0$-axis ranges from approximately 2800 g-$cm^2$ to approximately 3300 g-$cm^2$. The moment-of-inertia at the center-of-gravity around an axis parallel to the $Z_0$-axis is greater than approximately 4800 g-$cm^2$. As an indication of the aspect ratio of the club, the club breadth-to-face length ratio is 0.94 or greater.

In addition, the club head of this first example embodiment may have a weight that ranges from approximately 200 g to approximately 210 g. Referring again to FIGS. 32A and 32B, the face length may range from approximately 114 mm to approximately 118 mm and the face area may range from approximately 3200 $mm^2$ to approximately 3800 $mm^2$. The club head breadth may range from approximately 112 mm to approximately 114 mm. The location of the center-of-gravity in the $X_0$ may range from approximately 28 mm to approximately 32 mm; the location of the center-of-gravity in the $Y_0$ direction may range from approximately 17 mm to approximately 21 mm; and the location of the center-of-gravity in the $Z_0$ direction may range from approximately 27 mm to approximately 31 mm (all as measured from the ground-zero point).

For this example club head, Table I provides a set of nominal spline point coordinates for the upper curve 113 and lower curve 114 of cross-section 110. As discussed, these nominal spline point coordinates may vary, in some instances, within a range of ±10%.

TABLE I

Spline Points for Cross-Section 110 for Example (1)

| | | | | | | | | |
|---|---|---|---|---|---|---|---|---|
| x-coordinate (mm) | 0 | 3 | 6 | 12 | 18 | 24 | 36 | 48 |
| $z_U$-coordinate (mm) (upper surface 113) | 0 | 7 | 11 | 16 | 19 | 22 | 25 | 26 |
| $z_L$-coordinate (mm) (lower surface 114) | 0 | −10 | −14 | −19 | −23 | −25 | −29 | −32 |

Alternatively, for this example club head, the Bézier equations (1a) and (1b) presented above may be used to obtain, respectively, the x- and z-coordinates of the upper curve 113 of cross-section 110 as follows:

$$x_U=3(17)(1-t)t^2+(48)t^3 \quad \text{Equ. (113a)}$$

$$z_U=3(10)(1-t)^2t+3(26)(1-t)t^2+(26)t^3 \quad \text{Equ. (113b)}$$

over the range of: $0 \le t \le 1$.

Thus, for this particular curve 113, the Bézier control points for the x-coordinates have been defined as: $Pxu_0=0$, $Pxu_1=0$, $Pxu_2=17$ and $Pxu_3=48$, and the Bézier control points for the z-coordinates have been defined as: $Pzu_0=0$, $Pzu_1=10$, $Pzu_2=26$ and $Pzu_3=26$. As discussed, these z-coordinates may vary, in some instances, within a range of ±10%.

Similarly, for this example club head, the Bézier equations (2a) and (2b) may be used to obtain, respectively, the x- and z-coordinates of the lower curve 114 of cross-section 110 as follows:

$$x_L=3(11)(1-t)t^2+(48)t^3 \quad \text{Equ. (114a)}$$

$$z_L=3(-10)(1-t)^2t+3(-26)(1-t)t^2+(-32)t^3 \quad \text{Equ. (114b)}$$

over the range of: $0 \le t \le 1$.

Thus, for this particular curve 114, the Bézier control points for the x-coordinates have been defined as: $PxL_0=0$, $PxL_1=0$, $PxL_2=11$ and $PxL_3=48$, and the Bézier control points for the z-coordinates have been defined as: $PzL_0=0$, $PzL_1=-10$, $PzL_2=-26$ and $PzL_3=-32$. These z-coordinates may also vary, in some instances, within a range of ±10%.

It can be seen from an examination of the data and the figures that the upper, crown-side curve 113 differs from the lower, sole-side curve 114. For example, at 3 mm along the x-axis from the apex point 112, the lower curve 114 has a z-coordinate value that is approximately 40% greater than the z-coordinate value of the upper curve 113. This introduces an initial asymmetry into the curves, i.e., lower curve 114 starts out deeper than upper curve 113. However, from 3 mm to 24 mm along the x-axis, the upper curve 113 and the lower curve 114 both extend away from the x-axis by an additional 15 mm (i.e., the $\Delta z_U=22-7=15$ mm and the $\Delta z_L=25-10=15$ mm). And, from 3 mm to 36 mm along the x-axis, the upper curve 113 and the lower curve 114 extend away from the x-axis by an additional 18 mm and 19 mm, respectively—a difference of less than 10%. In other words, from 3 mm to 36 mm along the x-axis, the curvatures of the upper curve 113 and the lower curve 114 are approximately the same.

As with curves 113 and 114 discussed above with respect to FIG. 29A, referring now to FIG. 30A, upper and lower curves 123 and 124 for this first example club head each may be characterized by a curve presented as a table of spline points. Table II provides a set of spline point coordinates for the cross-section 120 for Example (1). The $z_U$-coordinates are associated with the upper curve 123; the $z_L$-coordinates are associated with the lower curve 124.

TABLE II

Spline Points for Cross-Section 120 for Example (1)

| | | | | | | | | |
|---|---|---|---|---|---|---|---|---|
| x-coordinate (mm) | 0 | 3 | 6 | 12 | 18 | 24 | 36 | 48 |
| $z_U$-coordinate (mm) (upper surface 123) | 0 | 7 | 11 | 16 | 19 | 21 | 24 | 25 |
| $z_L$-coordinate (mm) (lower surface 124) | 0 | −9 | −13 | −18 | −21 | −24 | −28 | −30 |

Alternatively, for this example club head, the Bézier equations (1a) and (1b) presented above may be used to obtain, respectively, the x- and z-coordinates of the upper curve 123 of cross-section 120 as follows:

$$x_U=3(19)(1-t)t^2+(48)t^3 \quad \text{Equ. (123a)}$$

$$z_U=3(10)(1-t)^2t+3(25)(1-t)t^2+(25)t^3 \quad \text{Equ. (123b)}$$

over the range of: $0 \le t \le 1$.

Thus, it can be seen that for this particular curve 123, the Bézier control points for the x-coordinates have been defined as: $Pxu_0=0$, $Pxu_1=0$, $Pxu_2=19$ and $Pxu_3=48$, and the Bézier control points for the z-coordinates have been defined as: $Pzu_0=0$, $Pzu_1=10$, $Pzu_2=25$ and $Pzu_3=25$.

As above, for this example club head, the Bézier equations (2a) and (2b) may be used to obtain, respectively, the x- and z-coordinates of the lower curve 124 of cross-section 120 as follows:

$$x_L=3(13)(1-t)t^2+(48)t^3 \quad \text{Equ. (124a)}$$

$$z_L=3(-10)(1-t)^2t+3(-26)(1-t)t^2+(-30)t^3 \quad \text{Equ. (124b)}$$

over the range of: $0 \le t \le 1$.

Thus, for this particular curve 124, the Bézier control points for the x-coordinates have been defined as: $PxL_0=0$, $PxL_1=0$, $PxL_2=13$ and $PxL_3=48$, and the Bézier control points for the z-coordinates have been defined as: $PzL_0=0$, $PzL_1=-10$, $PzL_2=-26$ and $PzL_3=-30$.

It can be seen from an examination of the data and the figures that the upper, crown-side curve 123 differs from the lower, sole-side curve 124. For example, at 3 mm along the x-axis from the apex point 112, the lower curve 124 has a z-coordinate value that is approximately 30% greater than the z-coordinate value of the upper curve 123. This introduces an initial asymmetry into the curves. However, from 3 mm to 18 mm along the x-axis, the upper curve 123 and the lower curve 124 both extend away from the x-axis by an additional 12 mm (i.e., the $\Delta z_U=19-7=12$ mm and the $\Delta z_L=21-9=12$ mm). And, from 3 mm to 24 mm along the x-axis, the upper curve 123 and the lower curve 124 extend away from the x-axis by an additional 14 mm and 15 mm, respectively—a difference of less than 10%. In other words, from 3 mm to 24 mm along the x-axis, the curvatures of the upper curve 123 and the lower curve 124 are approximately the same.

Again, as with surfaces 113 and 114 discussed above, the upper and lower curves 133 and 134 may be characterized by curves presented as a table of spline points. Table III provides a set of spline point coordinates for the cross-section 130 for Example (1). For purposes of this table, all of the coordinates of the spline points are defined relative to the apex point 112. The $z_U$-coordinates are associated with the upper curve 133; the $z_L$-coordinates are associated with the lower curve 134.

TABLE III

Spline Points for Cross-Section 130 for Example (1)

| | | | | | | | | |
|---|---|---|---|---|---|---|---|---|
| x-coordinate (mm) | 0 | 3 | 6 | 12 | 18 | 24 | 36 | 48 |
| $z_U$-coordinate (mm) (upper surface 133) | 0 | 6 | 9 | 12 | 15 | 17 | 18 | 18 |
| $z_L$-coordinate (mm) (lower surface 134) | 0 | −8 | −12 | −16 | −20 | −22 | −26 | −29 |

Alternatively, for this example club head, the Bézier equations (1a) and (1b) presented above may be used to obtain, respectively, the x- and z-coordinates of the upper curve 133 of cross-section 130 as follows:

$$x_U=3(25)(1-t)t^2+(48)t^3 \quad \text{Equ. (133a)}$$

$$z_U=3(10)(1-t)^2t+3(21)(1-t)t^2+(18)t^3 \quad \text{Equ. (133b)}$$

over the range of: $0 \le t \le 1$.

Thus, for this particular curve 133, the Bézier control points for the x-coordinates have been defined as: $Pxu_0=0$, $Pxu_1=0$, $Pxu_2=25$ and $Pxu_3=48$, and the Bézier control points for the z-coordinates have been defined as: $Pzu_0=0$, $Pzu_1=10$, $Pzu_2=21$ and $Pzu_3=18$.

As above, for this example club head, the Bézier equations (2a) and (2b) may be used to obtain, respectively, the x- and z-coordinates of the lower curve 134 of cross-section 130 as follows:

$$x_L=3(12)(1-t)t^2+(48)t^3 \quad \text{Equ. (134a)}$$

$$z_L=3(-10)(1-t)^2t+3(-22)(1-t)t^2+(-29)t^3 \quad \text{Equ. (134b)}$$

over the range of: $0 \le t \le 1$.

Thus, for this particular curve 134, the Bézier control points for the x-coordinates have been defined as: $Pxl_0=0$, $Pxl_1=0$, $Pxl_2=12$ and $Pxl_3=48$, and the Bézier control points for the z-coordinates have been defined as: $Pzl_0=0$, $Pzl_1=-10$, $Pzl_2=-22$ and $Pzl_3=-29$.

An analysis of the data for this Example (1) embodiment at cross-section 130 shows that at 3 mm along the x-axis from the apex point 112 the lower, sole-side curve 134 has a z-coordinate value that is approximately 30% greater than the z-coordinate value of the upper, crown-side curve 133. This introduces an initial asymmetry into the curves. From 3 mm to 18 mm along the x-axis, the upper curve 133 and the lower curve 134 extend away from the x-axis by an additional 9 mm and 12 mm, respectively. In fact, from 3 mm to 12 mm along the x-axis, the upper curve 133 and the lower curve 134 extend away from the x-axis by an additional 6 mm and 8 mm, respectively—a difference of greater than 10%. In other words, the curvatures of the upper curve 133 and the lower curve 134 for this Example (1) embodiment are significantly different over the range of interest. And it can be seen, by looking at FIG. 31A, that upper curve 133 is flatter (less curved) than lower curve 134.

Further, when the curves of the cross-section 110 (i.e., the cross-section oriented at 90 degrees from the centerline) are compared to the curves of the cross-section 120 (i.e., the cross-section oriented at 70 degrees from the centerline), it can be seen that they are very similar. Specifically, the values of the z-coordinates for the upper curve 113 are the same as the values of the z-coordinates for the upper curve 123 at the x-coordinates of 3 mm, 6 mm, 12 mm and 18 mm, and thereafter, the values for the z-coordinates of the upper curves 113 and 123 depart from each other by less than 10%. With respect to the lower curves 114 and 124 for the cross-sections 110 and 120, respectively, the values of the z-coordinates depart from each other by 10% or less over the x-coordinate range from 0 mm to 48 mm, with the lower curve 124 being slightly smaller than the lower curve 114. When the curves of the cross-section 110 (i.e., the cross-section oriented at 90 degrees from the centerline) are compared to the curves of the cross-section 130 (i.e., the cross-section oriented at 45 degrees from the centerline), it can be seen that the values of the z-coordinates for the lower curve 134 of the cross-section 130 differ from the values of the z-coordinates for the lower curve 114 of the cross-section 110 by a fairly constant amount—either 2 mm or 3 mm—over the x-coordinate range of 0 mm to 48 mm. On the other hand, it can be seen that the difference in the values of the z-coordinates for the upper curve 133 of the cross-section 130 from the values of the z-coordinates for the upper curve 113 of the cross-section 110 increases over the x-coordinate range of 0 mm to 48 mm. In other words, the curvature of the upper curve 133 significantly departs from curvature of the upper curve 113, with upper curve 133 being significantly flatter than upper curve 113. This can also be appreciated by comparing curve 113 in FIG. 29A with curve 133 in FIG. 31A.

Example Embodiment (2)

In a second example, a representative embodiment of a club head as shown in FIGS. 7-10 is described. This second example club head is provided with a volume that is greater than approximately 400 cc. The face height ranges from approximately 56 mm to approximately 60 mm. The moment-of-inertia at the center-of-gravity around an axis parallel to the $X_0$-axis ranges from approximately 2600 g-cm$^2$ to approximately 3000 g-cm$^2$. The moment-of-inertia at the center-of-gravity around an axis parallel to the $Z_0$-axis ranges from approximately 4500 g-cm$^2$ to approximately 5200 g-cm$^2$. The club breadth-to-face length ratio is 0.90 or greater.

In addition, the club head of this second example embodiment may have a weight that ranges from approximately 197 g to approximately 207 g. Referring again to FIGS. 32A and 32B, the face length may range from approximately 122 mm to approximately 126 mm and the face area may range from approximately 3200 mm$^2$ to approximately 3800 mm$^2$. The club head breadth may range from approximately 112 mm to approximately 116 mm. The location of the center-of-gravity in the $X_0$ direction may range from approximately 28 mm to approximately 32 mm; the location of the center-of-gravity in the $Y_0$ direction may range from approximately 17 mm to approximately 21 mm; and the location of the center-of-gravity in the $Z_0$ direction may range from approximately 33 mm to approximately 37 mm (all as measured from the ground-zero point).

For this Example (2) club head, Table IV provides a set of nominal spline point coordinates for the upper and lower curves of cross-section 110. As previously discussed, these nominal spline point coordinates may vary, in some instances, within a range of ±10%.

TABLE IV

Spline Points for Cross-Section 110 for Example (2)

| | | | | | | | | |
|---|---|---|---|---|---|---|---|---|
| x-coordinate (mm) | 0 | 3 | 6 | 12 | 18 | 24 | 36 | 48 |
| $z_U$-coordinate (mm) (upper surface 113) | 0 | 6 | 9 | 13 | 16 | 19 | 22 | 23 |
| $z_L$-coordinate (mm) (lower surface 114) | 0 | −9 | −13 | −18 | −21 | −24 | −30 | −33 |

Alternatively, for this example club head, the Bézier equations (1a) and (1b) presented above may be used to obtain, respectively, the x- and z-coordinates of the upper curve 113 of cross-section 110 as follows:

$$x_U=3(22)(1-t)t^2+(48)t^3 \quad \text{Equ. (213a)}$$

$$z_U=3(8)(1-t)^2t+3(23)(1-t)t^2+(23)t^3 \quad \text{Equ. (213b)}$$

over the range of: $0 \le t \le 1$.

Thus, for this particular curve 113, the Bézier control points for the x-coordinates have been defined as: $Pxu_0=0$, $Pxu_1=0$, $Pxu_2=22$ and $Pxu_3=48$, and the Bézier control points for the z-coordinates have been defined as: $Pzu_0=0$, $Pzu_1=8$, $Pzu_2=23$ and $Pzu_3=23$. As discussed, these z-coordinates may vary, in some instances, within a range of ±10%.

Similarly, for this example club head, the Bézier equations (2a) and (2b) may be used to obtain, respectively, the x- and z-coordinates of the lower curve 114 of cross-section 110 as follows:

$$x_L=3(18)(1-t)t^2+(48)t^3 \quad \text{Equ. (214a)}$$

$$z_L=3(-12)(1-t)^2t+3(-25)(1-t)t^2+(-33)t^3 \quad \text{Equ. (214b)}$$

over the range of: $0 \le t \le 1$.

Thus, for this particular curve 114, the Bézier control points for the x-coordinates have been defined as: $Pxl_0=0$, $Pxl_1=0$, $Pxl_2=18$ and $Pxl_3=48$, and the Bézier control points for the z-coordinates have been defined as: $Pzl_m=0$, $Pzl_1=-$ 12, $PZL_2$=−25 and $PZL_3$=−33. These z-coordinates may also vary, in some instances, within a range of ±10%.

It can be seen from an examination of the data of this Example (2) embodiment at cross-section 110 that at 3 mm along the x-axis from the apex point 112, the lower curve 114 has a z-coordinate value that is 50% greater than the z-coordinate value of the upper curve 113. This introduces an initial asymmetry into the curves. However, from 3 mm to 24 mm along the x-axis, the upper curve 113 extends away from the x-axis by an additional 13 mm (i.e., $\Delta z_U$=19−6=13 mm) and the lower curve 114 extends away from the x-axis by an additional 15 mm (i.e., $\Delta z_L$=24−9=15 mm). And, from 3 mm to 36 mm along the x-axis, the upper curve 113 and the lower curve 114 extend away from the x-axis by an additional 16 mm and 21 mm, respectively. In other words, from 3 mm to 36 mm along the x-axis, the upper curve 113 is flatter than the lower curve 114.

As with curves 113 and 114 discussed above with respect to FIG. 29A, referring now to FIG. 30A, upper and lower curves 123 and 124 for this second example club head may be characterized by a curve presented as a table of spline points. Table V provides a set of spline point coordinates for the cross-section 120 for Example (2). For purposes of this table, the coordinates of the spline points are defined as values relative to the apex point 112. The $z_U$-coordinates are associated with the upper curve 123; the $z_L$-coordinates are associated with the lower curve 124.

TABLE V

Spline Points for Cross-Section 120 for Example (2)

| | | | | | | | | |
|---|---|---|---|---|---|---|---|---|
| x-coordinate (mm) | 0 | 3 | 6 | 12 | 18 | 24 | 36 | 48 |
| $z_U$-coordinate (mm) (upper surface 123) | 0 | 6 | 8 | 12 | 15 | 17 | 20 | 21 |
| $z_L$-coordinate (mm) (lower surface 124) | 0 | −9 | −12 | −17 | −21 | −24 | −29 | −33 |

Alternatively, for this example club head, the Bézier equations (1a) and (1b) presented above may be used to obtain, respectively, the x- and z-coordinates of the upper curve 123 of cross-section 120 as follows:

$$x_U=3(28)(1-t)t^2+(48)t^3 \quad \text{Equ. (223a)}$$

$$z_U=3(9)(1-t)^2t+3(22)(1-t)t^2+(21)t^3 \quad \text{Equ. (223b)}$$

over the range of: 0≤t≤1.

Thus, it can be sent that for this particular curve 123, the Bézier control points for the x-coordinates have been defined as: $Pxu_0$=0, $Pxu_1$=0, $Pxu_2$=28 and $Pxu_3$=48, and the Bézier control points for the z-coordinates have been defined as: $Pzu_0$=0, $Pzu_1$=9, $Pzu_2$=22 and $Pzu_3$=21.

As above, for this example club head, the Bézier equations (2a) and (2b) may be used to obtain, respectively, the x- and z-coordinates of the lower curve 124 of cross-section 120 as follows:

$$x_L=3(13)(1-t)t^2+(48)t^3 \quad \text{Equ. (224a)}$$

$$z_L=3(-11)(1-t)^2t+3(-22)(1-t)t^2+(-33)t^3 \quad \text{Equ. (224b)}$$

over the range of: 0≤t≤1.

Thus, for this particular curve 124, the Bézier control points for the x-coordinates have been defined as: $PxL_0$=0, $PxL_1$=0, $PxL_2$=13 and $PxL_3$=48, and the Bézier control points for the z-coordinates have been defined as: $PzL_0$=0, $PzL_1$=−11, $PzL_2$=−22 and $PzL_3$=−33.

At cross-section 120 at 3 mm along the x-axis from the apex point 112, the lower curve 124 has a z-coordinate value that is 50% greater than the z-coordinate value of the upper curve 123. This introduces an initial asymmetry into the curves. However, from 3 mm to 24 mm along the x-axis, the upper curve 123 extends away from the x-axis by an additional 11 mm (i.e., $\Delta z_U$=17−6=11 mm) and the lower curve 124 extends away from the x-axis by an additional 15 mm (i.e., $\Delta z_L$=24−9=15 mm). And, from 3 mm to 36 mm along the x-axis, the upper curve 123 and the lower curve 124 extend away from the x-axis by an additional 14 mm and 20 mm, respectively. In other words, similar to the curves of cross-section 110, from 3 mm to 36 mm along the x-axis, the upper curve 123 is flatter than the lower curve 124.

As with surfaces 113 and 114 discussed above, the upper and lower curves 133 and 134 may be characterized by curves presented as a table of spline points. Table VI provides a set of spline point coordinates for the cross-section 130 for Example (2). For purposes of this table, all of the coordinates of the spline points are defined relative to the apex point 112. The $z_U$-coordinates are associated with the upper curve 133; the $z_L$-coordinates are associated with the lower curve 134.

TABLE VI

Spline Points for Cross-Section 130 for Example (2)

| | | | | | | | | |
|---|---|---|---|---|---|---|---|---|
| x-coordinate (mm) | 0 | 3 | 6 | 12 | 18 | 24 | 36 | 48 |
| $z_U$-coordinate (mm) (upper surface 133) | 0 | 5 | 7 | 9 | 10 | 12 | 13 | 13 |
| $z_L$-coordinate (mm) (lower surface 134) | 0 | −6 | −10 | −15 | −18 | −21 | −26 | −30 |

Alternatively, for this example club head, the Bézier equations (1a) and (1b) presented above may be used to obtain, respectively, the x- and z-coordinates of the upper curve 133 of cross-section 130 as follows:

$$x_U=3(26)(1-t)t^2+(48)t^3 \quad \text{Equ. (233a)}$$

$$z_U=3(9)(1-t)^2t+3(14)(1-t)t^2+(13)t^3 \quad \text{Equ. (233b)}$$

over the range of: 0≤t≤1.

Thus, for this particular curve 133, the Bézier control points for the x-coordinates have been defined as: $Pxu_0$=0, $Pxu_1$=0, $Pxu_2$=26 and $Pxu_3$=48, and the Bézier control points for the z-coordinates have been defined as: $Pzu_0$=0, $Pzu_1$=9, $Pzu_2$=14 and $Pzu_3$=13.

As above, for this example club head, the Bézier equations (2a) and (2b) may be used to obtain, respectively, the x- and z-coordinates of the lower curve 134 of cross-section 130 as follows:

$$x_L=3(18)(1-t)t^2+(48)t^3 \quad \text{Equ. (234a)}$$

$$z_L=3(-7)(1-t)^2t+3(-23)(1-t)t^2+(-30)t^3 \quad \text{Equ. (234b)}$$

over the range of: 0≤t≤1.

Thus, for this particular curve 134, the Bézier control points for the x-coordinates have been defined as: $PxL_0$=0, $PxL_1$=0, $PxL_2$=18 and $PxL_3$=48, and the Bézier control points for the z-coordinates have been defined as: $PzL_0$=0, $PzL_1$=−7, $PzL_2$=−23 and $PzL_3$=−30.

At cross-section 130, at 3 mm along the x-axis from the apex point 112, the lower curve 134 has a z-coordinate value that is only 20% greater than the z-coordinate value of the upper curve 133. This introduces an initial asymmetry into the curves. From 3 mm to 24 mm along the x-axis, the upper curve 133 extends away from the x-axis by an additional 7 mm (i.e., $\Delta z_U$=12−5=7 mm) and the lower curve 134 extends away from the x-axis by an additional 15 mm (i.e., $\Delta z_L$=21−6=15 mm). And, from 3 mm to 36 mm along the x-axis, the upper curve 133 and the lower curve 134 extend away from the x-axis by an additional 8 mm and 20 mm, respectively. In other words, from 3 mm to 36 mm along the x-axis, the upper curve 133 is significantly flatter than the lower curve 134.

Further, for this Example (2) embodiment, when the curves of the cross-section 110 (i.e., the cross-section oriented at 90 degrees from the centerline) are compared to the curves of the cross-section 120 (i.e., the cross-section oriented at 70 degrees from the centerline), it can be seen that they are similar. Specifically, the values of the z-coordinates for the upper curve 113 vary from the values of the z-coordinates for the upper curve 123 by approximately 10% or less. With respect to the lower curves 114 and 124 for the cross-sections 110 and 120, respectively, the values of the z-coordinates depart from each other by less than 10% over the x-coordinate range from 0 mm to 48 mm, with the lower curve 124 being slightly smaller than the lower curve 114. When the curves for this Example (2) embodiment of the cross-section 110 (i.e., the cross-section oriented at 90 degrees from the centerline) are compared to the curves of the cross-section 130 (i.e., the cross-section oriented at 45 degrees from the centerline), it can be seen that the values of the z-coordinates for the lower curve 134 of the cross-section 130 differ from the values of the z-coordinates for the lower curve 114 of the cross-section 110 by a fairly constant amount—either 3 mm or 4 mm—over the x-coordinate range of 0 mm to 48 mm. On the other hand, it can be seen that the difference in the values of the z-coordinates for the upper curve 133 of the cross-section 130 from the values of the z-coordinates for the upper curve 113 of the cross-section 110 steadily increases over the x-coordinate range of 0 mm to 48 mm. In other words, the curvature of the upper curve 133 significantly departs from curvature of the upper curve 113, with upper curve 133 being significantly flatter than upper curve 113.

Example Embodiment (3)

In a third example, a representative embodiment of a club head as shown in FIGS. 15-20 is described. This third example club head is provided with a volume that is greater than approximately 400 cc. The face height ranges from approximately 52 mm to approximately 56 mm. The moment-of-inertia at the center-of-gravity around an axis parallel to the $X_0$-axis ranges from approximately 2900 g-cm$^2$ to approximately 3600 g-cm$^2$. The moment-of-inertia at the center-of-gravity around an axis parallel to the $Z_0$-axis is greater than approximately 5000 g-cm$^2$. The club breadth-to-face length ratio is 0.94 or greater.

This third example club head may also be provided with a weight that may range from approximately 200 g to approximately 210 g. Referring to FIGS. 32A and 32B, a face length may range from approximately 122 mm to approximately 126 mm and a face area may range from approximately 3300 mm$^2$ to approximately 3900 mm$^2$. The club head breadth may range from approximately 115 mm to approximately 118 mm. The location of the center-of-gravity in the $X_0$ direction may range from approximately 28 mm to approximately 32 mm; the location of the center-of-gravity in the $Y_0$ direction may range from approximately 16 mm to approximately 20 mm; and the location of the center-of-gravity in the $Z_0$ direction may range from approximately 29 mm to approximately 33 mm (all as measured from the ground-zero point).

For this Example (3) club head, Table VII provides a set of nominal spline point coordinates for the upper and lower curves of cross-section 110. As previously discussed, these nominal spline point coordinates may vary, in some instances, within a range of ±10%.

TABLE VII

Spline Points for Cross-Section 110 for Example (3)

| | | | | | | | | |
|---|---|---|---|---|---|---|---|---|
| x-coordinate (mm) | 0 | 3 | 6 | 12 | 18 | 24 | 36 | 48 |
| $z_U$-coordinate (mm) (upper surface 113) | 0 | 4 | 6 | 7 | 9 | 10 | 11 | 11 |
| $z_L$-coordinate (mm) (lower surface 114) | 0 | −15 | −20 | −26 | −31 | −34 | −40 | −44 |

Alternatively, for this example club head, the Bézier equations (1a) and (1b) presented above may be used to obtain, respectively, the x- and z-coordinates of the upper curve 113 of cross-section 110 as follows:

$$x_U=3(17)(1-t)t^2+(48)t^3 \quad \text{Equ. (313a)}$$

$$z_U=3(5)(1-t)^2t+3(12)(1-t)t^2+(11)t^3 \quad \text{Equ. (313b)}$$

over the range of: $0 \le t \le 1$.

Thus, for this particular curve 113, the Bézier control points for the x-coordinates have been defined as: $Pxu_0=0$, $Pxu_1=0$, $Pxu_2=17$ and $Pxu_3=48$, and the Bézier control points for the z-coordinates have been defined as: $Pzu_0=0$, $Pzu_1=5$, $Pzu_2=12$ and $Pzu_3=11$. As discussed, these z-coordinates may vary, in some instances, within a range of ±10%.

Similarly, for this example club head, the Bézier equations (2a) and (2b) may be used to obtain, respectively, the x- and z-coordinates of the lower curve 114 of cross-section 110 as follows:

$$x_L=3(7)(1-t)t^2+(48)t^3 \quad \text{Equ. (314a)}$$

$$z_L=3(-15)(1-t)^2t+3(-32)(1-t)t^2+(-44)t^3 \quad \text{Equ. (314b)}$$

over the range of: $0 \le t \le 1$.

Thus, for this particular curve 114, the Bézier control points for the x-coordinates have been defined as: $PxL_0=0$, $PxL_1=0$, $PxL_2=7$ and $PxL_3=48$, and the Bézier control points for the z-coordinates have been defined as: $PzL_0=0$, $PzL_1=-15$, $PzL_2=-32$ and $PzL_3=-44$. These z-coordinates may also vary, in some instances, within a range of ±10%.

It can be seen from an examination of the data of this Example (3) embodiment at cross-section 110 that at 3 mm along the x-axis from the apex point 112, the lower curve 114 has a z-coordinate value that is 275% greater than the z-coordinate value of the upper curve 113. This introduces an initial asymmetry into the curves. From 3 mm to 24 mm along the x-axis, the upper curve 113 extends away from the x-axis by an additional 6 mm (i.e., $\Delta z_U=10-4=6$ mm) and the lower curve 114 extends away from the x-axis by an additional 19 mm (i.e., $\Delta z_L=34-15=19$ mm). And, from 3 mm to 36 mm along the x-axis, the upper curve 113 and the lower curve 114 extend away from the x-axis by an additional 7 mm and 25 mm, respectively. In other words, from 3 mm to 36 mm along the x-axis, the upper curve 113 is significantly flatter than the lower curve 114.

As with curves 113 and 114 discussed above with respect to FIG. 29A, referring now to FIG. 30A, upper and lower curves 123 and 124 for this third example club head may be characterized by a curve presented as a table of spline points. Table VIII provides a set of spline point coordinates for the cross-section 120 for Example (3). For purposes of this table, the coordinates of the spline points are defined as values relative to the apex point 112. The $z_U$-coordinates are associated with the upper curve 123; the $z_L$-coordinates are associated with the lower curve 124.

TABLE VIII

| Spline Points for Cross-Section 120 for Example (3) | | | | | | | | |
|---|---|---|---|---|---|---|---|---|
| x-coordinate (mm) | 0 | 3 | 6 | 12 | 18 | 24 | 36 | 48 |
| $z_U$-coordinate (mm) (upper surface 123) | 0 | 4 | 4 | 5 | 6 | 7 | 7 | 7 |
| $z_L$-coordinate (mm) (lower surface 124) | 0 | −14 | −19 | −26 | −30 | −34 | −39 | −43 |

Alternatively, for this Example (3) club head, the Bézier equations (1a) and (1b) presented above may be used to obtain, respectively, the x- and z-coordinates of the upper curve 123 of cross-section 120 as follows:

$$x_U=3(21)(1-t)t^2+(48)t^3 \quad \text{Equ. (323a)}$$

$$z_U=3(5)(1-t)^2t+3(7)(1-t)t^2+(7)t^3 \quad \text{Equ. (323b)}$$

over the range of: $0 \le t \le 1$.

Thus, it can be seen that for this particular curve 123, the Bézier control points for the x-coordinates have been defined as: $Pxu_0=0$, $Pxu_1=0$, $Pxu_2=21$ and $Pxu_3=48$, and the Bézier control points for the z-coordinates have been defined as: $Pzu_0=0$, $Pzu_1=5$, $Pzu_2=7$ and $Pzu_3=7$.

As above, for this example club head, the Bézier equations (2a) and (2b) may be used to obtain, respectively, the x- and z-coordinates of the lower curve 124 of cross-section 120 as follows:

$$x_L=3(13)(1-t)t^2+(48)t^3 \quad \text{Equ. (324a)}$$

$$z_L=3(-18)(1-t)^2t+3(-34)(1-t)t^2+(-43)t^3 \quad \text{Equ. (324b)}$$

over the range of: $0 \le t \le 1$.

Thus, for this particular curve 124, the Bézier control points for the x-coordinates have been defined as: $PxL_0=0$, $PxL_1=0$, $PxL_2=13$ and $PxL_3=48$, and the Bézier control points for the z-coordinates have been defined as: $PzL_0=0$, $PzL_1=-18$, $PzL_2=-34$ and $PzL_3=-43$.

At cross-section 120 for Example (3) at 3 mm along the x-axis from the apex point 112, the lower curve 124 has a z-coordinate value that is 250% greater than the z-coordinate value of the upper curve 123. This introduces an initial asymmetry into the curves. From 3 mm to 24 mm along the x-axis, the upper curve 123 extends away from the x-axis by an additional 3 mm (i.e., $\Delta z_U=7-4=3$ mm) and the lower curve 124 extends away from the x-axis by an additional 20 mm (i.e., $\Delta z_L=34-14=20$ mm). And, from 3 mm to 36 mm along the x-axis, the upper curve 123 and the lower curve 124 extend away from the x-axis by an additional 3 mm and 25 mm, respectively. In other words, similar to the curves of cross-section 110, from 3 mm to 36 mm along the x-axis, the upper curve 123 is significantly flatter than the lower curve 124. In fact, from 24 mm to 48 mm, the upper curve 123 maintains a constant distance from the x-axis, while the lower curve 124 over this same range departs by an additional 9 mm.

As with surfaces 113 and 114 discussed above, the upper and lower curves 133 and 134 may be characterized by curves presented as a table of spline points. Table IX provides a set of spline point coordinates for the cross-section 130 for Example (3). For purposes of this table, all of the coordinates of the spline points are defined relative to the apex point 112. The $z_U$-coordinates are associated with the upper curve 133; the $z_L$-coordinates are associated with the lower curve 134.

TABLE IX

| Spline Points for Cross-Section 130 for Example (3) | | | | | | | | |
|---|---|---|---|---|---|---|---|---|
| x-coordinate (mm) | 0 | 3 | 6 | 12 | 18 | 24 | 36 | 48 |
| $z_U$-coordinate (mm) (upper surface 133) | 0 | 4 | 3 | 3 | 2 | 2 | 0 | −2 |
| $z_L$-coordinate (mm) (lower surface 134) | 0 | −11 | −16 | −22 | −27 | −30 | −37 | −41 |

Alternatively, for this example club head, the Bézier equations (1a) and (1b) presented above may be used to obtain, respectively, the x- and z-coordinates of the upper curve 133 of cross-section 130 as follows:

$$x_U=3(5)(1-t)t^2+(48)t^3 \quad \text{Equ. (333a)}$$

$$z_U=3(6)(1-t)^2t+3(5)(1-t)t^2+(-2)t^3 \quad \text{Equ. (333b)}$$

over the range of: $0 \le t \le 1$.

Thus, for this particular curve 133, the Bézier control points for the x-coordinates have been defined as: $Pxu_0=0$, $Pxu_1=0$, $Pxu_2=5$ and $Pxu_3=48$, and the Bézier control points for the z-coordinates have been defined as: $Pzu_0=0$, $Pzu_1=6$, $Pzu_2=5$ and $Pzu_3=-2$.

As above, for this Example (3) club head, the Bézier equations (2a) and (2b) may be used to obtain, respectively, the x- and z-coordinates of the lower curve 134 of cross-section 130 as follows:

$$x_L=3(18)(1-t)t^2+(48)t^3 \quad \text{Equ. (334a)}$$

$$z_L=3(-15)(1-t)^2t+3(-32)(1-t)t^2+(-41)t^3 \quad \text{Equ. (334b)}$$

over the range of: $0 \le t \le 1$.

Thus, for this particular curve 134, the Bézier control points for the x-coordinates have been defined as: $PxL_0=0$, $PxL_1=0$, $PxL_2=18$ and $PxL_3=48$, and the Bézier control points for the z-coordinates have been defined as: $PzL_0=0$, $PzL_1=-15$, $PzL_2=-32$ and $PzL_3=-41$.

At cross-section 130 for Example (3), at 3 mm along the x-axis from the apex point 112, the lower curve 134 has a z-coordinate value that is 175% greater than the z-coordinate value of the upper curve 133. This introduces an initial asymmetry into the curves. From 3 mm to 24 mm along the x-axis, the upper curve 133 extends away from the x-axis by −2 mm (i.e., $\Delta z_U=2-4=-2$ mm). In other words, the upper curve 133 has actually approached the x-axis over this range. On the other hand, the lower curve 134 extends away from the x-axis by an additional 19 mm (i.e., $\Delta z_L=30-11=19$ mm). And, from 3 mm to 36 mm along the x-axis, the upper curve 133 and the lower curve 134 extend away from the x-axis by an additional −4 mm and 26 mm, respectively. In other words, from 3 mm to 36 mm along the x-axis, the upper curve 133 is significantly flatter than the lower curve 134.

Further, for this Example (3) embodiment, when the curves of the cross-section 110 (i.e., the cross-section oriented at 90 degrees from the centerline) are compared to the curves of the cross-section 120 (i.e., the cross-section oriented at 70 degrees from the centerline), it can be seen that the upper curves vary significantly, while the lower curves are very similar. Specifically, the values of the z-coordinates for the upper curve 113 vary from the values of the z-coordinates for the upper curve 123 by up to 57% (relative to upper curve 123). Upper curve 123 is significantly flatter than upper curve 113. With respect to the lower curves 114 and 124 for the cross-sections 110 and 120, respectively, the values of the z-coordinates depart from each other by less than 10% over the x-coordinate range from 0 mm to 48 mm, with the lower curve 124 being slightly smaller than the lower curve 114. When the curves for this Example (3) embodiment of the cross-section 110 (i.e., the cross-section oriented at 90 degrees from the centerline) are compared to the curves of the cross-section 130 (i.e., the cross-section oriented at 45 degrees from the centerline), it can be seen that the values of the z-coordinates for the lower curve 134 of the cross-section 130 differ from the values of the z-coordinates for the lower curve 114 of the cross-section 110 by a fairly constant amount—either 3 mm or 4 mm—over the x-coordinate range of 0 mm to 48 mm. Thus, the curvature of lower curve 134 is approximately the same as the curvature of lower curve 114, with respect to the x-axis, over the x-coordinate range of 0 mm to 48 mm. On the other hand, it can be seen that the difference in the values of the z-coordinates for the upper curve 133 of the cross-section 130 from the values of the z-coordinates for the upper curve 113 of the cross-section 110 steadily increases over the x-coordinate range of 0 mm to 48 mm. In other words, the curvature of the upper curve 133 significantly departs from curvature of the upper curve 113, with upper curve 133 being significantly flatter than upper curve 113.

Example Embodiment (4)

In a fourth example, a representative embodiment of a club head as shown in FIGS. 21-26 is described. This fourth example club head is provided with a volume that is greater than approximately 400 cc. The face height ranges from approximately 58 mm to approximately 63 mm. The moment-of-inertia at the center-of-gravity around an axis parallel to the $X_0$-axis ranges from approximately 2800 g-cm$^2$ to approximately 3300 g-cm$^2$. The moment-of-inertia at the center-of-gravity around an axis parallel to the $Z_0$-axis ranges from approximately 4500 g-cm$^2$ to approximately 5200 g-cm$^2$. The club breadth-to-face length ratio is 0.94 or greater.

Additionally, this fourth example club head is provided with a weight that may range from approximately 200 g to approximately 210 g. Referring to FIGS. 32A and 32B, the face length that may range from approximately 118 mm to approximately 122 mm and the face area may range from approximately 3900 mm$^2$ to 4500 mm$^2$. The club head breadth may range from approximately 116 mm to approximately 118 mm. The location of the center-of-gravity in the $X_0$ direction may range from approximately 28 mm to approximately 32 mm; the location of the center-of-gravity in the $Y_0$ direction may range from approximately 15 mm to approximately 19 mm; and the location of the center-of-gravity in the $Z_0$ direction may range from approximately 29 mm to approximately 33 mm (all as measured from the ground-zero point).

For this Example (4) club head, Table X provides a set of nominal spline point coordinates for the heel side of cross-section 110. These spline point coordinates are provided as absolute values. As discussed, these nominal spline point coordinates may vary, in some instances, within a range of ±10%.

TABLE X

Spline Points for Cross-Section 110 for Example (4)

| x-coordinate (mm) | 0 | 3 | 6 | 12 | 18 | 24 | 36 | 48 |
|---|---|---|---|---|---|---|---|---|
| $z_U$-coordinate (mm) (upper surface 113) | 0 | 5 | 7 | 11 | 14 | 16 | 19 | 20 |
| $z_L$-coordinate (mm) (lower surface 114) | 0 | −10 | −14 | −21 | −26 | −30 | −36 | −40 |

Alternatively, for this Example (4) club head, the Bézier equations (1a) and (1b) presented above may be used to obtain, respectively, the x- and z-coordinates of the upper curve 113 of cross-section 110 as follows:

$$x_U=3(31)(1-t)t^2+(48)t^3 \quad \text{Equ. (413a)}$$

$$z_U=3(9)(1-t)^2t+3(21)(1-t)t^2+(20)t^3 \quad \text{Equ. (413b)}$$

over the range of: $0 \le t \le 1$.

Thus, for this particular curve 113, the Bézier control points for the x-coordinates have been defined as: $Pxu_0=0$, $Pxu_1=0$, $Pxu_2=31$ and $Pxu_3=48$, and the Bézier control points for the z-coordinates have been defined as: $Pzu_0=0$, $Pzu_1=9$, $Pzu_2=21$ and $Pzu_3=20$. As discussed, these z-coordinates may vary, in some instances, within a range of ±10%.

Similarly, for this example club head, the Bézier equations (2a) and (2b) may be used to obtain, respectively, the x- and z-coordinates of the lower curve 114 of cross-section 110 as follows:

$$x_L=3(30)(1-t)t^2+(48)t^3 \quad \text{Equ. (414a)}$$

$$z_L=3(-17)(1-t)^2t+3(-37)(1-t)t^2+(-40)t^3 \quad \text{Equ. (414b)}$$

over the range of: $0 \le t \le 1$.

Thus, for this particular curve 114, the Bézier control points for the x-coordinates have been defined as: $Pxl_0=0$, $Pxl_1=0$, $Pxl_2=30$ and $Pxl_3=48$, and the Bézier control points for the z-coordinates have been defined as: $Pzl_0=0$, $Pzl_1=-17$, $Pzl_2=-37$ and $Pzl_3=-40$. These z-coordinates may also vary, in some instances, within a range of +10%.

It can be seen from an examination of the data of this Example (4) embodiment at cross-section 110 that at 3 mm along the x-axis from the apex point 112, the lower curve 114 has a z-coordinate value that is 100% greater than the z-coordinate value of the upper curve 113. This introduces an initial asymmetry into the curves. From 3 mm to 24 mm along the x-axis, the upper curve 113 extends away from the x-axis by an additional 11 mm (i.e., $\Delta z_U=16-5=11$ mm) and the lower curve 114 extends away from the x-axis by an additional 20 mm (i.e., $\Delta z_L=30-10=20$ mm). And, from 3 mm to 36 mm along the x-axis, the upper curve 113 and the lower curve 114 extend away from the x-axis by an additional 14 mm and 26 mm, respectively. In other words, from 3 mm to 36 mm along the x-axis, the upper curve 113 is significantly flatter than the lower curve 114.

As with curves 113 and 114 discussed above with respect to FIG. 29A, referring now to FIG. 30A, upper and lower curves 123 and 124 for this first example club head may be characterized by a curve presented as a table of spline points. Table XI provides a set of spline point coordinates for the cross-section 120 for Example (4). For purposes of this table, the coordinates of the spline points are defined relative to the apex point 112. The $z_U$-coordinates are associated with the upper curve 123; the $z_L$-coordinates are associated with the lower curve 124.

TABLE XI

| Spline Points for Cross-Section 120 Example (4) | | | | | | | | |
|---|---|---|---|---|---|---|---|---|
| x-coordinate (mm) | 0 | 3 | 6 | 12 | 18 | 24 | 36 | 48 |
| $z_U$-coordinate (mm) (upper surface 123) | 0 | 4 | 5 | 8 | 10 | 12 | 14 | 14 |
| $z_L$-coordinate (mm) (lower surface 124) | 0 | −11 | −15 | −22 | −27 | −31 | −37 | −41 |

Alternatively, for this Example (4) club head, the Bézier equations (1a) and (1b) presented above may be used to obtain, respectively, the x- and z-coordinates of the upper curve 123 of cross-section 120 as follows:

$$x_U=3(25)(1-t)t^2+(48)t^3 \quad \text{Equ. (423a)}$$

$$z_U=3(4)(1-t)^2t+3(16)(1-t)t^2+(14)t^3 \quad \text{Equ. (423b)}$$

over the range of: $0 \le t \le 1$.

Thus, it can be seen that for this particular curve 123, the Bézier control points for the x-coordinates have been defined as: $Pxu_0=0$, $Pxu_1=0$, $Pxu_2=25$ and $Pxu_3=48$, and the Bézier control points for the z-coordinates have been defined as: $Pzu_0=0$, $Pzu_1=4$, $Pzu_2=16$ and $Pzu_3=14$.

As above, for this example club head, the Bézier equations (2a) and (2b) may be used to obtain, respectively, the x- and z-coordinates of the lower curve 124 of cross-section 120 as follows:

$$x_L=3(26)(1-t)t^2+(48)t^3 \quad \text{Equ. (424a)}$$

$$z_L=3(-18)(1-t)^2t+3(-36)(1-t)t^2+(-41)t^3 \quad \text{Equ. (424b)}$$

over the range of: $0 \le t \le 1$.

Thus, for this particular curve 124, the Bézier control points for the x-coordinates have been defined as: $PxL_0=0$, $PxL_1=0$, $PxL_2=26$ and $PxL_3=48$, and the Bézier control points for the z-coordinates have been defined as: $PzL_0=0$, $PzL_1=-18$, $PzL_2=-36$ and $PzL_3=-41$.

At cross-section 120 for Example (4) at 3 mm along the x-axis from the apex point 112, the lower curve 124 has a z-coordinate value that is 175% greater than the z-coordinate value of the upper curve 123. This introduces an initial asymmetry into the curves. From 3 mm to 24 mm along the x-axis, the upper curve 123 extends away from the x-axis by an additional 8 mm (i.e., $\Delta z_U=12-4=8$ mm) and the lower curve 124 extends away from the x-axis by an additional 20 mm (i.e., $\Delta z_L=31-11=20$ mm). And, from 3 mm to 36 mm along the x-axis, the upper curve 123 and the lower curve 124 extend away from the x-axis by an additional 10 mm and 26 mm, respectively. In other words, similar to the curves of cross-section 110, from 3 mm to 36 mm along the x-axis, the upper curve 123 is significantly flatter than the lower curve 124.

As with surfaces 113 and 114 discussed above, the upper and lower curves 133 and 134 may be characterized by curves presented as a table of spline points. Table XII provides a set of spline point coordinates for the cross-section 130 for Example (4). For purposes of this table, all of the coordinates of the spline points are defined relative to the apex point 112. The $z_U$-coordinates are associated with the upper curve 133; the $z_L$-coordinates are associated with the lower curve 134.

TABLE XII

| Spline Points for Cross-Section 130 for Example (4) | | | | | | | | |
|---|---|---|---|---|---|---|---|---|
| x-coordinate (mm) | 0 | 3 | 6 | 12 | 18 | 24 | 36 | 48 |
| $z_U$-coordinate (mm) (upper surface 133) | 0 | 4 | 4 | 5 | 6 | 7 | 7 | 5 |
| $z_L$-coordinate (mm) (lower surface 134) | 0 | −8 | −12 | −18 | −22 | −26 | −32 | −37 |

Alternatively, for this example club head, the Bézier equations (1a) and (1b) presented above may be used to obtain, respectively, the x- and z-coordinates of the upper curve 133 of cross-section 130 as follows:

$$x_U=3(35)(1-t)t^2+(48)t^3 \quad \text{Equ. (433a)}$$

$$z_U=3(6)(1-t)^2t+3(9)(1-t)t^2+(5)t^3 \quad \text{Equ. (433b)}$$

over the range of: $0 \le t \le 1$.

Thus, for this particular curve 133, the Bézier control points for the x-coordinates have been defined as: $Pxu_0=0$, $Pxu_1=0$, $Pxu_2=35$ and $Pxu_3=48$, and the Bézier control points for the z-coordinates have been defined as: $Pzu_0=0$, $Pzu_1=6$, $Pzu_2=9$ and $Pzu_3=5$.

As above, for this Example (4) club head, the Bézier equations (2a) and (2b) may be used to obtain, respectively, the x- and z-coordinates of the lower curve 134 of cross-section 130 as follows:

$$x_L=3(40)(1-t)t^2+(48)t^3 \quad \text{Equ. (434a)}$$

$$z_L=3(-17)(1-t)^2t+3(-35)(1-t)t^2+(-37)t^3 \quad \text{Equ. (434b)}$$

over the range of: $0 \le t \le 1$.

Thus, for this particular curve 134, the Bézier control points for the x-coordinates have been defined as: $PxL_0=0$, $PxL_1=0$, $PxL_2=40$ and $PxL_3=48$, and the Bézier control points for the z-coordinates have been defined as: $PzL_0=0$, $PzL_1=-17$, $PzL_2=-35$ and $PzL_3=-37$.

At cross-section 130 for Example (4), at 3 mm along the x-axis from the apex point 112, the lower curve 134 has a z-coordinate value that is 100% greater than the z-coordinate value of the upper curve 133. This introduces an initial asymmetry into the curves. From 3 mm to 24 mm along the x-axis, the upper curve 133 extends away from the x-axis by 3 mm (i.e., $\Delta z_U=7-4=3$ mm). The lower curve 134 extends away from the x-axis by an additional 18 mm (i.e., $\Delta z_L=26-8=18$ mm). And, from 3 mm to 36 mm along the x-axis, the upper curve 133 and the lower curve 134 extend away from the x-axis by an additional 3 mm and 24 mm, respectively. In other words, from 3 mm to 36 mm along the x-axis, the upper curve 133 is significantly flatter than the lower curve 134.

Further, for this Example (4) embodiment, when the curves of the cross-section 110 (i.e., the cross-section oriented at 90 degrees from the centerline) are compared to the curves of the cross-section 120 (i.e., the cross-section oriented at 70 degrees from the centerline), it can be seen that the upper curves vary significantly, while the lower curves are very similar. Specifically, the values of the z-coordinates for the upper curve 113 vary from the values of the z-coordinates for the upper curve 123 by up to 43% (relative to upper curve 123). Upper curve 123 is significantly flatter than upper curve 113. With respect to the lower curves 114 and 124 for the cross-sections 110 and 120, respectively, the values of the z-coordinates depart from each other by less than 10% over the x-coordinate range from 0 mm to 48 mm, with the lower curve 124 being slightly smaller than the lower curve 114. When the curves for this Example (4) embodiment of the cross-section 110 (i.e., the cross-section oriented at 90 degrees from the centerline) are compared to the curves of the cross-section 130 (i.e., the cross-section oriented at 45 degrees from the centerline), it can be seen that the values of the z-coordinates for the lower curve 134 of the cross-section 130 differ from the values of the z-coordinates for the lower curve 114 of the cross-section 110 by over a range of 2 mm to 4 mm—over the x-coordinate range of 0 mm to 48 mm. Thus, for the Example (4) embodiment, the curvature of lower curve 134 varies somewhat from the curvature of lower curve 114. On the other hand, it can be seen that the difference in the values of the z-coordinates for the upper curve 133 of the cross-section 130 from the values of the z-coordinates for the upper curve 113 of the cross-section 110 steadily increases from a difference of 1 mm to a difference of 15 mm over the x-coordinate range of 0 mm to 48 mm. In other words, the curvature of the upper curve 133 significantly departs from curvature of the upper curve 113, with upper curve 133 being significantly flatter than upper curve 113.

It would be apparent to persons of ordinary skill in the art, given the benefit of this disclosure, that a streamlined region 100 similarly proportioned to the cross-sections 110, 120, 130 would achieve the same drag reduction benefits as the specific cross-sections 110, 120, 130 defined by Tables I-XII. Thus, the cross-sections 110, 120, 130 presented in Tables I-XII may be enlarged or reduced to accommodate club heads of various sizes. Additionally, it would be apparent to persons of ordinary skill in the art, given the benefit of this disclosure, that a streamlined region 100 having upper and lower curves that substantially accord with those defined by Tables I-XII would also generally achieve the same drag reduction benefits as the specific upper and lower curves presented in Tables I-XII. Thus, for example, the z-coordinate values may vary from those presented in Tables I-XII by up to ±5%, up to ±10%, or even in some instances, up to ±15%.

An illustrative embodiment of a golf club 10 is shown in FIGS. 33-36. The golf club of these figures is a driver. In certain embodiments, the golf club head may have a volume of 400 cc or greater, a volume of 420 cc or greater, or even a volume of 440 cc or greater. Further the club head may have a club breadth-to-face length ratio of 0.90 or greater, of 0.92 or greater, or even of 0.94 or greater. In another embodiment, the golf club head may have a volume of only 380 cc or greater. Further, the club head may have a club breadth-to-face length ratio of only 0.88 or greater.

In the example structure of these figures, the club head 14 includes a body member 15 to which the shaft 12 is attached at a hosel 16 in known fashion. The body member 15 further includes a plurality of portions, regions, or surfaces. This example body member 15 includes a ball striking face 17, a crown 18, a toe 20, a back 22, a heel 24, a hosel region 26 and a sole 28. The hosel region 26 is generally located at the intersection of the ball striking face 17, the heel 24, the crown 18 and the sole 28. As previously discussed in detail, the heel 24 of the club head 14 may have a surface 25 that is generally shaped as the leading surface of an airfoil, i.e., an airfoil-like surface 25. As explained in greater detail below, the crown may have a relatively round rear-side edge profile, as viewed from above; and the sole may have a relatively square rear-side edge profile, as viewed from below.

Figure 33:
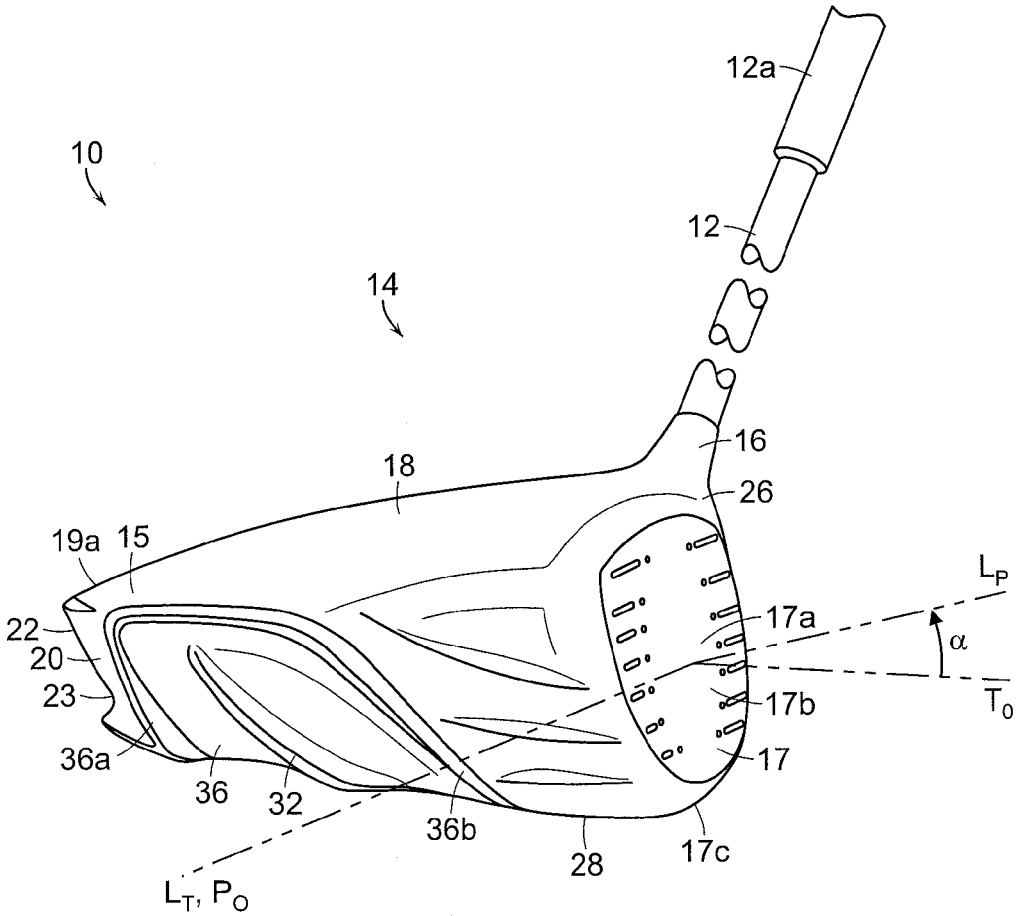
FIG. 33 is a perspective view of a golf club with at least one drag-reducing structure included on a surface of the club head according to another illustrative aspect.

As best shown in FIG. 33, the perimeter of the ball striking surface 17 may include a chamfered region 17*c*. The chamfered region 17*c* provides a smooth transition from the generally planar or slightly curved striking surface of the face 17 to the crown 18, the sole 28, the heel 24 and/or the toe 20. The chamfered region 17*c* presents an aerodynamically shaped surface to air flowing over the club head 14 in a direction parallel to the moment-of-impact club-head-trajectory direction $T_0$.

Figure 34:
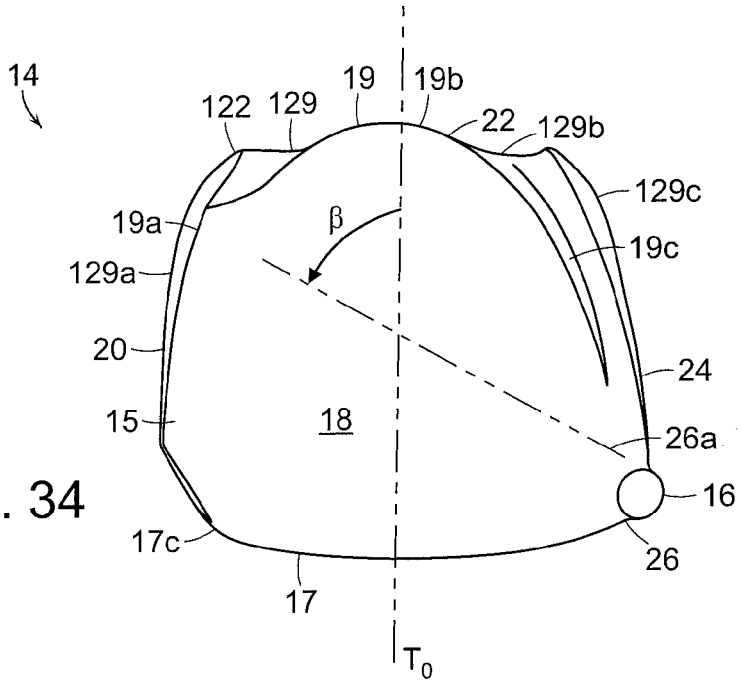
FIG. 34 is a top plan view of the club head of FIG. 33.
Figure 35:
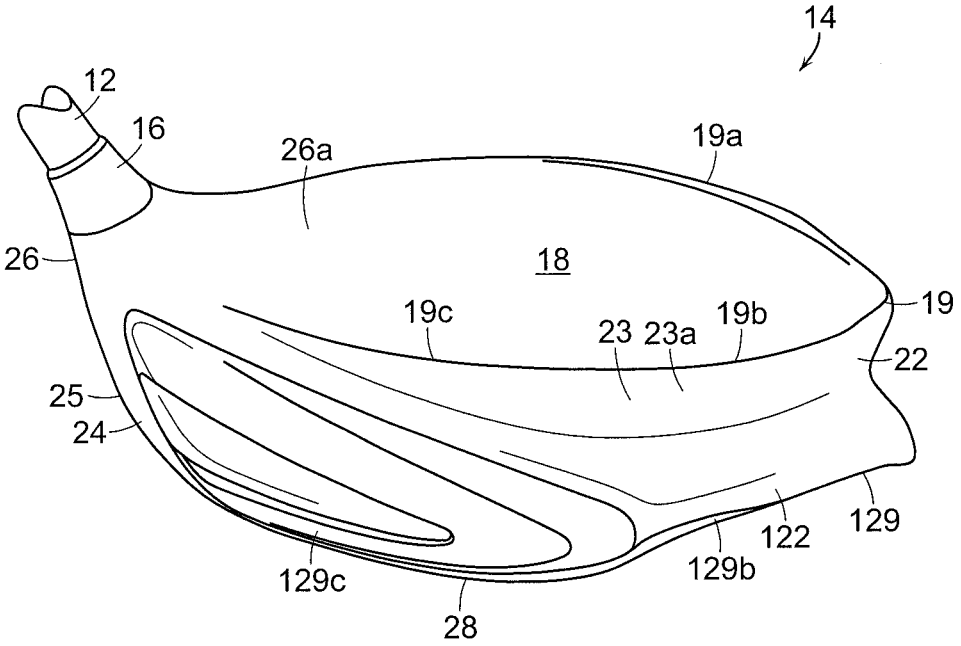
FIG. 35 is a perspective view of the club head of FIG. 33.

As shown in FIGS. 34 and 35, the crown 18 may have an edge 19. The edge 19 may include a toe-side edge 19*a*, a rear-side edge 19*b*, and a heel-side edge 19*c*. Referring to FIG. 34, the toe-side edge 19*a* is shown as extending in a generally linear fashion, at a slight angle relative to the $T_0$ direction, from the forward portion of the club head 14 to a rearward portion of the club head 14. The rear-side edge 19*b* is shown as extending from the toe-side edge to the heel-side edge 19*c* with a generally smooth convex curvature. By way of non-limiting examples, at least a major portion of the rear-side edge 19*b* may have a generally circular, elliptical, or parabolic profile, when viewed from above or from a vertical perspective. The profile of the rear-side edge 19 may also be represented by higher order equations. The rear-side edge 19*b* may have a maximum distance from the ball striking face 17 that is aligned in the $T_0$ direction with the desired-point-of-contact 17*a*. The heel-side edge 19*c* is shown as extending from the rearward portion of the club head 14 to a rearward portion of the hosel region 26. According to certain aspects, the heel-side edge 19*c* may become visually indistinguishable from the surrounding surfaces well short of the hosel region 26. This occurs, for example, when the heel 24 includes an airfoil-like surface 25 that transitions smoothly and gradually into the crown 18.

The transition from the rear-side edge 19*b* to the toe-side edge 19*a* or to the heel-side edge 19*c*, when viewed from above, may be smooth and gradual or the transition may be more abrupt. For example, as shown in FIG. 34, the transition from the rear-side edge 19*b* to the toe-side edge 19*a* forms a transition profile, when viewed from above, having a corner. The transition from the rear-side edge 19*b* to the heel-side edge 19*c* forms a transition profile, when viewed from above, which is generally an extension of the convex curvature that defines the rear-side edge 19*b*. Alternatively, both of these transitions could be formed as the more abrupt transitions of corners or as the more gradual transitions of merged curvatures.

Further, when viewed from a horizontal perspective, the edge 19 of the crown 18 may provide a noticeable transition from a generally horizontal crown surface to a generally vertical toe surface, rear surface or heel surface. A "sharp transition" may be defined as a transition having more than a 90° change in surface orientation, i.e., the toe surface, rear surface or heel surface is an undercut surface and the edge 19 of the crown 18 projects beyond the undercut surface. An "abrupt transition" may be defined as having approximately a 70° to a 90° degree change in surface orientation over a relatively short distance. In other words, for an abrupt transition, the transition from the crown surface to the toe, back or heel surface generally forms a corner. A "gradual transition" may be defined as having a smoothly changing surface orientation over a relatively long distance. Thus, referring to FIG. 33, the toe-side edge 19*a* of the crown 18 provides an example of a sharp transition from a generally horizontal surface of the crown 18 to a surface of the toe that cuts back under the crown 18. Referring to FIG. 35, the rear-side edge 19*b* of the crown 18 provides an example of a relatively abrupt transition from an essentially horizontal surface of the crown 18 to an essentially vertical surface of the back 22. An example of a gradual transition at the edge 19 of the crown 18 is illustrated by the heel-side edge 19*c* in the hosel region 26, wherein the crown 18 transitions smoothly and gradually into the heel 24.

Figure 36:
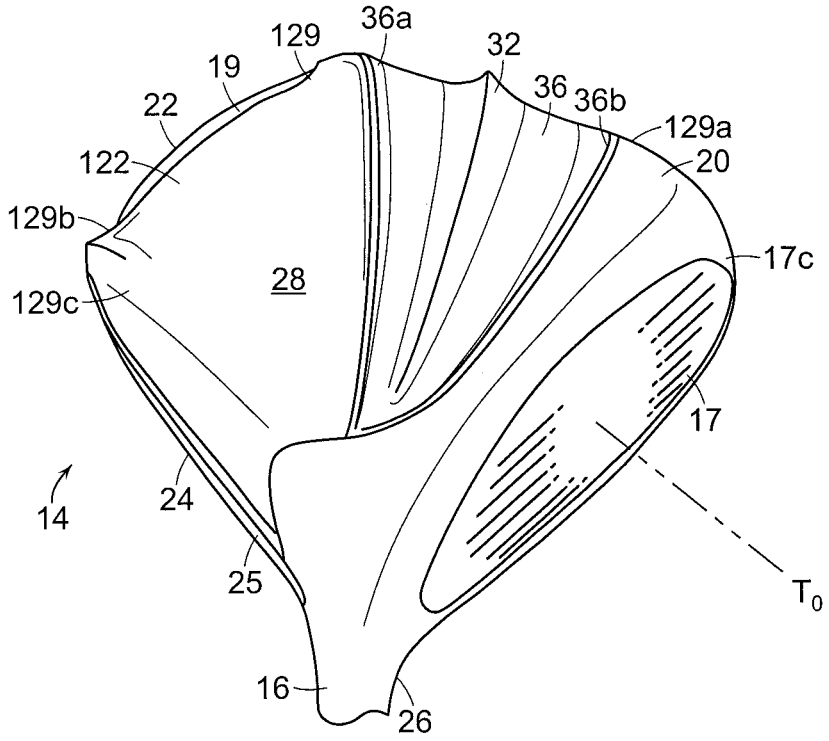
FIG. 36 is a bottom perspective view of the club head of FIG. 33.
Figure 37:
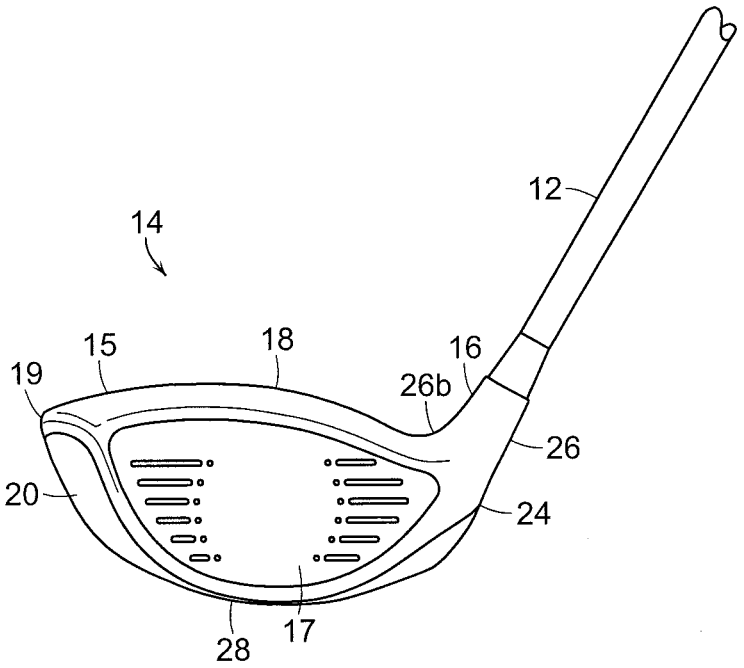
FIG. 37 is a front elevation view of a club head according to even another illustrative aspect.

As best shown in FIGS. 35 and 36, the sole 28 may have an edge 129. The edge 129 of sole 28 may include a toe-side edge 129*a*, a rear-side edge 129*b*, and a heel-side edge 129*c*. In the example structure shown in FIG. 34, the toe-side edges 129*a* and the heel-side edge 129*c* are each shown as extending in a generally linear fashion, at slight angles relative to the $T_0$ direction, from the forward portion of the club head 14 to a rearward portion of the club head 14. The rear-side edge 129*b* is shown as extending from the toe-side edge 129*a* to the heel-side edge 129*c* in a direction generally perpendicular to the moment-of-impact club-head-trajectory direction $T_0$.

According to certain aspects, the rear-side edge 129*b* of the sole 28 and the transition regions from the rear-side edge 129*b* to the heel-side edge 129*c* and to the toe-side edge 129*a* may form a generally squared-off profile, when viewed from above. In this particular embodiment, the rear-side edge 129*b* is provided with a gentle complex curvature, i.e., the rear-side edge 129*b* is slightly convex in a central region and slightly concave to either side of the central region. As best shown in FIG. 34, where the rear-side edge 129*b* joins the toe-side edge 129*a*, a corner is formed. Similarly, where the rear-side edge 129*b* joins the heel-side edge 129*c*, another corner is formed. As a person of ordinary skill in the art would recognize, given the benefit of this disclosure, the rear-side edge 129*b* may be more or less curved (including even linear) and the transition from the rear-side edge 129*b* to the heel-side edge 129*c* and/or to the toe-side edge 129*a* need not be a 90° corner, but may be more or less gradual. As with the rear-side edge 19*b* of the crown 18, the rear-side edge 129*b* of the sole 28 may have a maximum distance from the ball striking face 17 that is aligned in the $T_0$ direction with the desired-point-of-contact 17*a*.

As with the transition between the edge 19 of the crown 18 and the toe, heel or back surfaces, the transition of the edge 129 of the sole 28 to the toe, heel or back surfaces may be provided as a sharp transition, as an abrupt transition, or as a gradual transition. For example, referring to FIG. 35, the rear-side edge 129*b* of the sole 28 provides an example of a sharp transition from a generally horizontal surface of the sole 28 to a generally horizontal and oppositely facing surface 122 of the back 22. The transition from heel 24 to the sole 28 at the heel-side edge 129*c* along the most rearward portion of heel 24, as best seen in FIG. 36, illustrates an example of an abrupt, almost 90°, transition. The transition from heel 24 to the sole 28 along the more forward portion of heel 24, close to the hosel region, illustrates a much more gradual transition. According to some aspects, this forward portion of the heel-side edge 129*c* may become visually indistinguishable from the surrounding surfaces. This occurs, for example, when the heel 24 includes an airfoil-like surface 25 that transitions smoothly and gradually into the sole 28. As best shown in FIG. 33, the transition from the toe 20 to the sole 28 at the toe-side edge 129*a* illustrates an example of a very gradual transition.

According to certain aspects and as best shown in FIGS. 33 and 36, the sole 28 may include a diffuser 36. The diffuser 36 may extend from adjacent the hosel region 26 toward the toe 20. Further, the cross-sectional area of the diffuser 36 may gradually increase as the diffuser 36 extends away from the hosel region 26. In this particular example configuration, the depth $d_d$ of the diffuser 36 remains approximately constant, while the width $w_d$ of the diffuser 36, as measured from side 36*a* to side 36*b* of the diffuser 36, gradually increases as the diffuser 36 extends away from the hosel region 26. It is expected than any adverse pressure gradient building up in an air stream flowing from the hosel region 26 toward the toe 20 will be mitigated by the increase in cross-sectional area of the diffuser 36. Thus, it is expected that any transition from the laminar flow regime to the turbulent flow regime of the air flowing over the sole 28 will be delayed or even eliminated altogether. In certain configurations, the sole 28 may include multiple diffusers.

The one or more diffusers 36 may be oriented to mitigate drag during at least some portion of the downswing stroke, particularly as the club head 14 rotates around the yaw axis. Thus, in certain configurations, the diffuser 36 may be oriented to diffuse the air flow (i.e., reduce the adverse pressure gradient) when the hosel region 26 and/or the heel 24 lead the swing. The orientation of the diffuser 36 may be determined by finding a centerline between the sides 36*a*, 36*b* of the diffuser 36, and in the case of a curved centerline, using a least-squares fit to determine a corresponding straight line. In the configuration of FIGS. 33 and 36, the diffuser 36 is oriented at an angle of approximately 60° from a direction parallel to the moment-of-impact club-head trajectory direction $T_0$. The diffuser 36 may be oriented at angles that range from approximately 10° to approximately 80° from the direction parallel to direction $T_0$. Optionally, the diffuser 36 may be oriented at angles that range from approximately 20° to approximately 70°, or from approximately 30° to approximately 70°, or from approximately 40° to approximately 70°, or even from approximately 45° to approximately 65° from the direction parallel to direction $T_0$. In certain configurations, the diffuser 36 may extend from the hosel region 26 toward the toe 20 and/or toward the back 22. In other configurations, the diffuser 36 may extend from the heel 24 toward the toe 20 and/or the back 22.

One or both of the sides 36*a*, 36*b* of the diffuser 36 may be curved. In particular, as best seen in FIG. 36, in certain configurations, the sides 36*a*, 36*b* may curve in the same general direction toward the back 22 as the diffuser 36 extends away from the hosel region 26. This curvature of the diffuser 36 may enhance the diffuser's ability to delay the transition of the airflow from laminar to turbulent over a greater yaw angle range. In other configurations, the sides 36*a*, 36*b* of the diffuser 36 may be straight. Optionally, one or both sides 36*a*, 36*b* may curve away from the center of the diffuser 36, such that diffuser 36 flares as it extends away from the hosel region 26.

Optionally, the depth $d_d$ of diffuser 36 may vary. For example, the depth $d_d$ may linearly increase as the diffuser extends away from the hosel region 26. As another example, the depth $d_d$ may non-linearly increase as the diffuser extends away from the hosel region 26. Even further, the depth $d_d$ of the diffuser 36 need not be constant along the width $w_d$ of the diffuser 36. For example, the depth $d_d$ may be greatest in a central region of the diffuser 36 and less close to the sides 36*a*, 36*b*.

The diffuser 36 may include a vane 32 approximately centered between the sides 36*a* and 36*b* of the diffuser 36 and extending from the hosel region 26 to the toe 20. In the example structure of FIGS. 33 and 36, the vane 32, which projects upward from the bottom surface of the diffuser 36, tapers at either end in order to smoothly and gradually merge with the bottom surface of the diffuser 36. The vane 32 may have a maximum height $h_v$ equal to or less than the depth $d_d$ of the diffuser 36, such that the vane 32 does not extend beyond a base surface of the sole 28. In certain configurations, the diffuser 36 may include multiple vanes. In other configurations, the diffuser need not include any vane. Even further, the vane 32 may extend only partially along the length of the diffuser 36.

As can best be seen in FIG. 33, the diffuser 36 may extend into the toe region. Even further, as shown in FIG. 33, the diffuser 36 may extend all the way up to the toe-side edge 19*a* of the crown 18. As the diffuser 36 extends upward toward the toe-side edge 19*a* of the crown 18, the depth $d_d$ and or the width $w_d$ may gradually decrease. In this example structure, the vane 32 is also shown as extending into the toe region and up toward the toe-side edge 19*a*.

As best shown in FIG. 34, the club head 14 may include an additional drag-reducing structure. In particular, the hosel region 26 may include a crown-to-hosel fairing 26*a*. The crown-to-hosel fairing 26*a* may form a tapered transition from the hosel 16 to the crown 18. The crown-to-hosel fairing 26*a* is expected to assist in the maintenance of a smooth laminar airflow over the crown 18. In accord with the example structure of FIG. 34, the crown-to-hosel fairing 26*a* may be relatively long and narrow and may extend onto the crown 18. The lengthwise extension of such a relatively long and narrow crown-to-hosel fairing 26*a* may be oriented at a counterclockwise angle β from a direction parallel to the moment-of-impact club-head-trajectory direction $T_0$. By way of non-limiting example, angle β may range from approximately 10° to approximately 80°. According to other embodiments, the angle β may range from approximately 15° to approximately 60°, from approximately 20° to approximately 55°, from approximately 25° to approximately 40°, or even from approximately 30° to approximately 45°. Further, in accord with the example structure of FIG. 34, the crown-to-hosel fairing 26*a* may extend from the hosel 16 to approximately a third to approximately halfway across the crown 18, at which point the crown-to-hosel fairing 26*a* may essentially smoothly merge into the surface of the crown 18.

As best shown in FIG. 35, back 22 may include a "Kammback feature" 23. In this particular embodiment, the Kammback feature 23 includes a back surface 23*a* that relatively abruptly departs from the gently curve, generally horizontal, surface of the crown 18. Back surface 23*a* may be a generally vertical surface. Further, back surface 23*a* may have a relatively straight profile as it extends from the crown 18 toward the sole 28 (i.e., when viewed from the heel-side of the club head). Additionally, back surface 23*a* may have a convex profile as it extends around the back 22 of the club head 14 (i.e., when viewed from above).

Also as best shown in FIG. 35, back 22 may also include a rearwardly tapered projection 122. According to this example structure, the tapered projection 122 extends from the heel 24 to the toe 20 along the lower portion of the back 22. The upper surface of tapered projection 122 is shown extending rearward from a lower edge of the back surface 23*a*. As best shown in FIG. 36, the lower surface of the tapered projection 122 is shown as a smooth continuation of the sole 28. The upper and the lower surfaces of the tapered projection 122 come together along a rear edge 129*b* of the club head 14. According to this particular embodiment, both the upper and the lower surfaces of the rearwardly tapered projection 122 are formed with generally convex surfaces, when viewed from the side of the club head 14. Alternatively, one or other of the upper and lower surfaces may be generally planar or even slight concave, when viewed from the side. It may be expected that the upper surface of the tapered projection may allow air that has become detached from club head 14 behind the Kammback feature 23 to become re-attached to the club head 14 as it flows past this upper surface.

According to this example structure, as best seen in FIGS. 35 and 36, the tapered projection 122 may also be provided as a generally squared-off projection, i.e., the ends of the rear edge 129*b* where it meets the heel 24 and/or the toe 20, when viewed from above or below, are not rounded or tapered to gradually join with the heel 24 and/or the toe 20. Rather, the tapered projection 122 forms generally square corners (or, as illustrated in FIG. 34, even slightly exaggerated acute corners) when viewed from above (or below). It may be expected that this squaring of the heel-side and/or toe-side corners of the tapered projection 122 may inhibit the development of turbulence in the air stream adjacent to the heel 24 and/or the toe 20, thereby allowing laminar flow to be maintained or turbulent flow to become re-attached to the tapered surfaces of the tapered projection 122 (when the air flow is oriented generally from the ball striking face 17 to the back 22).

Tapered projection 122 may extend rearwardly beyond the crown 18. In other words, when the club is in a 60 degree lie angle position, the tapered projection 122 may extend beyond the crown 18 when viewed from above. For example, as seen in FIG. 34, the toe-side corner and/or the heel-side corner of the projection 122 may extend beyond the edge 19 of the crown 18. Further, although not shown, the central portion of the tapered projection 122 may also extend beyond the rear-side edge 19*b* of the crown. According to some aspects, the distance (measured parallel to the $T_0$ direction) between the maximum extent of the crown 18 and the maximum extent of the tapered projection 122 may be less than or equal to ±5 mm.

Even further, as best shown in the example structure of FIGS. 35 and 36, where the tapered projection 122 meets the heel 24, the transition is considered to be an abrupt transition. For example, the orientation of the surface of the tapered projection 122 may be approximately 70° to 90° relative to the orientation of the surface of the heel 24. Further, where the tapered projection 122 meets the toe 20 the transition may also be formed as an abrupt transition. Optionally, one or both of these transitions may be rounded, rather than abrupt.

FIGS. 37 through 44 show another example configuration of a golf club head 14 according to even further aspects. As above, in certain embodiments, the golf club head may have a volume of 400 cc or greater, a volume of 420 cc or greater, or even a volume of 440 cc or greater. Further the club head may have a club breadth-to-face length ratio of 0.90 or greater, of 0.92 or greater, or even of 0.94 or greater. In another embodiment, the golf club head may have a volume of only 380 cc or greater. Further, the club head may have a club breadth-to-face length ratio of only 0.88 or greater.

In this particular embodiment, the golf club head 14 includes a chamfered region 17*c* of the ball striking face 17, a diffuser 36, a crown-to-hosel fairing 26*a*, a Kammback feature 23 and a rearwardly tapered projection 122. For example, FIGS. 41 and 42 illustrate a crown-to-hosel fairing 26*b* that provides a smooth transition within the hosel region 26 from the hosel 16 to the crown 18 and ball striking face 17. In this particular configuration, the crown-to-hosel fairing 26*b* is provided as a skirt that tangentially merges with the crown 18 and the ball striking face 17 a relatively short distance from the hosel 16. Further, compared to the crown-to-hosel fairing 26*a* of FIGS. 33-36, the hosel fairing 26*b* of FIGS. 37-44 is not elongated.

Figure 39:
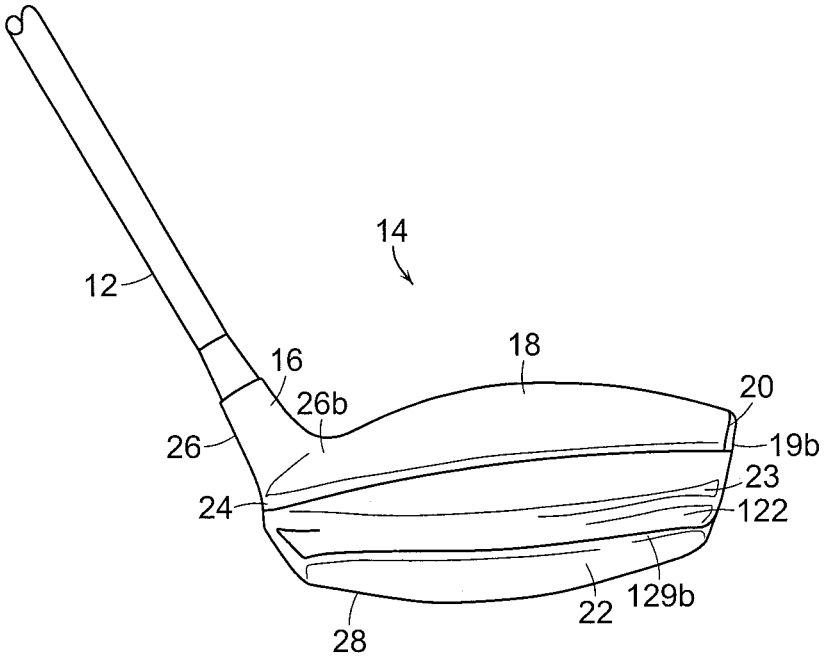
FIG. 39 is a back elevation view of the club head of FIG. 37.

FIGS. 39, 41 and 42 further illustrate that the rear-side edge 19*b* of the crown 18 has a softly rounded, slight asymmetrical arc. As used herein, the term "rounded" is not limited to circular arcs, but rather means "gently curved" as opposed to "sharply cornered." As best shown in FIG. 42, the rear-side edge 129*b* of the sole 28 rearwardly juts beyond the crown 18, forming corners where the tapered projection 122 meets the heel 24 and where the tapered projection 122 meets the toe 20. The corners in this configuration are gently angled in from the heel side and from the toe side, but are somewhat sharply pointed in the rearward direction. In other words, the heel and toe profiles, when viewed from above, are slightly convex as they approach the respective corners of the tapered projection 122, while the rear-side edge 129*b* of the tapered projection 122 has slightly concave profiles as it approaches the corners.

Figure 43:
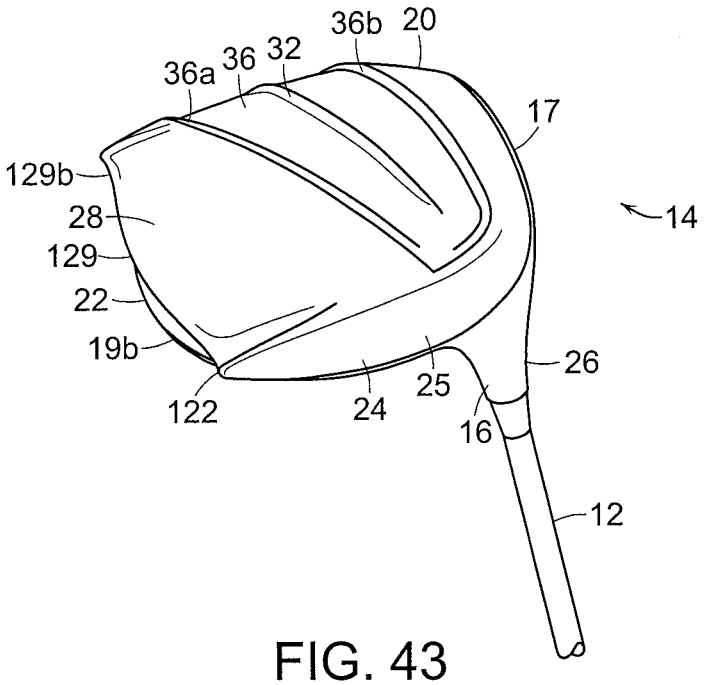
FIG. 43 is a bottom perspective view, generally angled toward the heel and the back, of the club head of FIG. 37.
Figure 44:
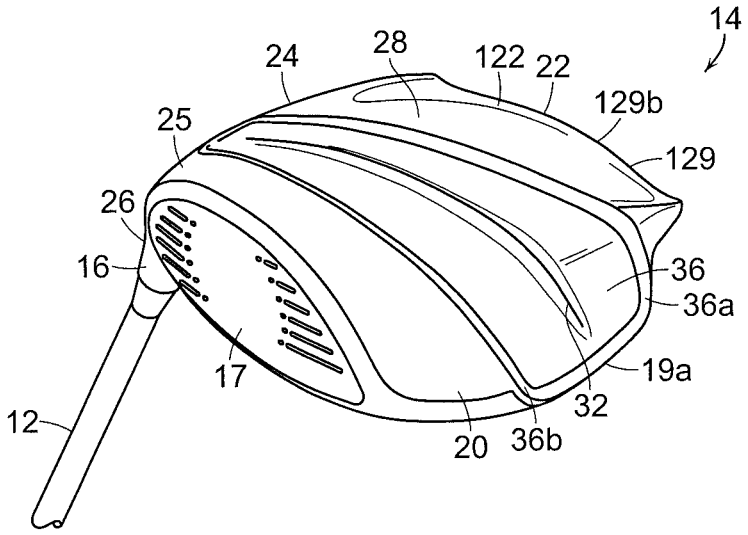
FIG. 44 is another bottom perspective view, generally angled toward the toe and the front, of the club head of FIG. 37.

As another example, FIGS. 43 and 44 illustrate a diffuser 36 located on the sole 28 of the club head 14. Diffuser 36 extends from generally adjacent the hosel region 26 and continues across the sole 28 and into the toe 20. Side 36*a* of the diffuser 36 is shown as being generally straight and extending generally toward the intersection of the toe 20 with the back 22 at an angle of approximately 65° from the $T_0$ direction. Side 36*b*, which extends generally along an angle of approximately 75° from the $T_0$ direction, may include a slight curvature toward the back 22 where the diffuser 36 transitions from the sole 28 into the toe 20 or it may be generally straight. In this example structure, the diffuser 36 extends at an angle of approximately 70° from the $T_0$ direction. The depth $d_d$ of the diffuser 36 is approximately constant.

Figure 40:
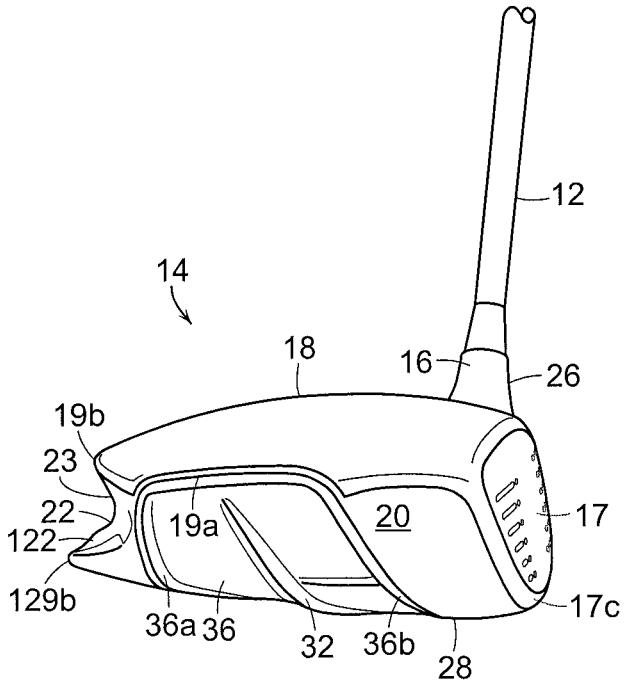
FIG. 40 is a toe-side perspective view of the club head of FIG. 37.
Figure 41:
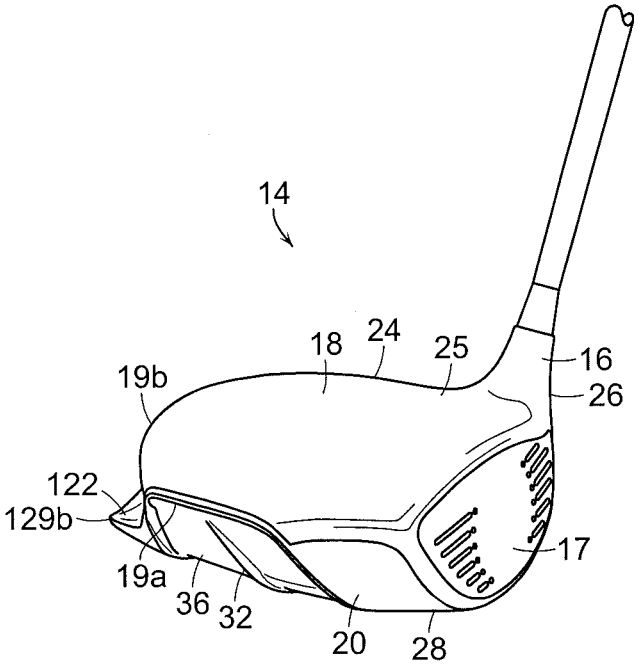
FIG. 41 is another perspective view, generally angled toward the toe, the crown and the front, of the club head of FIG. 37.
Figure 42:
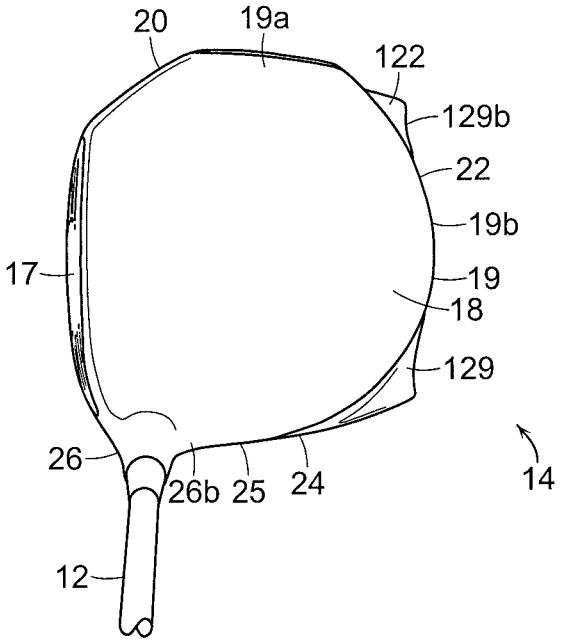
FIG. 42 is a top plan view of the club head of FIG. 37.

FIGS. 40, 41 and 44 also illustrate the extension of the diffuser 36 from the sole 28 up and across the toe 20 to the toe-side edge 19*a* of the crown 18. In this embodiment, the depth $d_d$ of the diffuser 36 in the toe 20 is essentially constant. Further, in this particular embodiment, the width $w_d$ of the diffuser 36 in the toe 20 is essentially constant.

As with the example configuration of the club head 14 shown in FIGS. 33-36, the diffuser 36 in the example configuration of the club head 14 of FIGS. 37-44 includes a vane 32.

Figure 38:
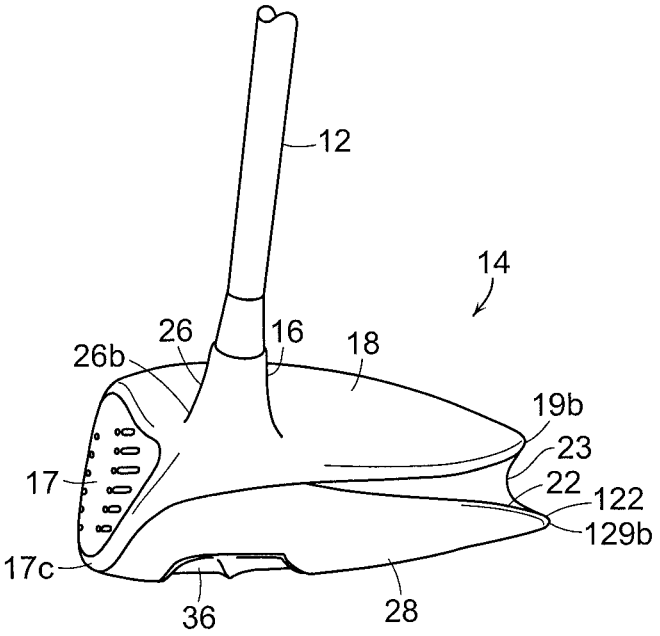
FIG. 38 is a heel-side perspective view of the club head of FIG. 37.

FIGS. 38-40 illustrate a Kammback feature 23 located on the back 22 that undercuts the crown 18, rather than extending straight down. Thus, for this embodiment, the transition from the crown 18 to the back 22 may be considered to be a sharp transition at the rear-side edge 19*b* of the crown 18. Further, it can be seen in FIG. 38 that the upper surface of the rearwardly tapered projection 122 is formed with a generally concave surface, while the lower surface of the tapered projection 122 is a generally convex extension of the sole 28. FIGS. 38-40 also illustrate that the Kammback feature 23 of this example embodiment extends from the rearward portion of the heel 22 across the back 22. In the heel 24, the end of the Kammback feature 23 has a tapered shape (see FIG. 38), whereas the other end of the Kammback feature 23, where it meets the toe 20, has a blunt, abrupt shape (see FIGS. 39 and 40).

Drag-reducing structures, such as the airfoil-like surface 25 on at least a portion of the heel 24, the chamfered region 17*c* of the ball striking face 17, the diffuser 36, the crown-to-hosel fairing 26*a*, 26*b*, the Kammback feature 23 and/or the rearwardly tapered projection 122, are provided on the club head 14 in order to reduce the drag on the club head during a user's golf swing from the end of a user's backswing throughout the downswing to the ball impact location. Specifically, the airfoil-like surface 25, the diffuser 36, and the crown-to-hosel fairing 26*a*, 26*b* may be provided to reduce the drag on the club head 14 primarily when the heel 24 and/or the hosel region 26 of the club head 14 are generally leading the swing. The chamfered region 17*c*, the Kammback feature 23 and the tapered projection 122 may be provided to reduce the drag on the club head 14 primarily when the ball striking face 17 is generally leading the swing.

While there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, the golf club head may be any driver, wood, or the like. Further, it is expressly intended that all combinations of those elements which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head for a metal wood type club, the golf club head comprising:

a body member having a ball striking face, a crown, a toe, a heel, a sole, a back and a hosel region located at an intersection of the ball striking face, the heel, the crown and the sole;

the crown having a relatively round rear-side edge profile, as viewed from above; and the sole having a rear-side edge, wherein the rear-side edge has a relatively square profile as viewed from below, wherein the sole includes a toe-side corner and a heel-side corner, wherein the toe-side corner and the heel-side corner extend beyond the crown as viewed from above and the sole further includes a central portion of the rear-side edge of the sole that is covered by the crown as viewed from above.

2. The golf club head of claim 1, wherein the club head includes a breadth that ranges from approximately 105 mm to approximately 125 mm.

3. The golf club head of claim 1, wherein the club head includes a breadth that ranges from approximately 112 mm to approximately 116 mm.

4. The golf club head of claim 1, wherein the club head includes a breadth that ranges from approximately 115 mm to approximately 118 mm.

5. The golf club head of claim 1, wherein the crown includes a shortened hosel fairing that extends from the hosel region at an angle of from approximately 10 degrees to approximately 80 degrees from a moment-of-impact trajectory direction.

6. The golf club head of claim 1, wherein the golf club head has a volume of 400 cc or greater and a club breadth-to-face length ratio of 0.90 or greater.

7. The golf club head of claim 1, wherein the heel has an airfoil surface in a forward portion of the heel.

8. The golf club head of claim 1, wherein a substantially U-shaped, concave groove is provided between the relatively round rear-side edge of the crown and the relatively square rear-side edge of the sole.

9. A golf club comprising:

a shaft; and the golf club head according to claim 1, wherein the golf club head is secured to a first end of the shaft.

10. A golf club head for a metal wood type club, the golf club head having a volume of 400 cc or greater and a club breadth-to-face length ratio of 0.90 or greater, the golf club head comprising:

a body member having a ball striking face, a crown, a toe, a heel, a sole, a back, wherein the back includes a rearwardly tapered projection that extends from the heel to the toe along a lower portion of the back;

the sole having a rear-side edge, wherein the rear-side edge has a relatively square profile as viewed from below, and further wherein the rear-side edge of the sole rearwardly juts beyond the crown, forming a toe-side corner where the rearwardly tapered projection meets the toe and a heel-side corner where the rearwardly tapered projection meets the heel and furthermore the rearwardly tapered projection includes a central portion that is covered by the crown when viewed from above.

11. The golf club head of claim 10, wherein the crown has a relatively round rear-side edge profile, as viewed from above.

12. The golf club head of claim 10, wherein the club head includes a breadth that ranges from approximately 105 mm to approximately 125 mm.

13. The golf club head of claim 10, wherein the back includes a substantially U-shaped, concave groove that extends across the entirety of the back.

14. The golf club head of claim 10, further including a hosel region located at the intersection of the ball striking face, the heel, the crown and the sole and an elongated hosel fairing that extends from the hosel region at an angle of from approximately 10 degrees to approximately 80 degrees from a moment-of-impact trajectory direction.

15. A golf club comprising: a shaft; and the golf club head according to claim 10, wherein the golf club head is secured to a first end of the shaft.

16. A golf club head for a metal wood type club, the club head comprising:

a body member having a ball striking face, a crown, a toe, a heel, a sole, a back, wherein the back includes a rearwardly tapered projection that extends from the heel to the toe along a lower portion of the back;

the crown having a relatively round rear-side edge profile, as viewed from above, the sole having a relatively square rear-side edge profile as viewed from below, wherein the rearwardly tapered projection includes a toe-side corner and a heel-side corner that extend rearwardly beyond the crown when viewed from above and a central portion of the rearwardly tapered projection that is covered by the crown when viewed from above.

17. The golf club head of claim 16, wherein the club head includes a breadth that ranges from approximately 105 mm to approximately 125 mm.

18. The golf club head of claim 16, wherein the club head includes a breadth that ranges from approximately 112 mm to approximately 116 mm.

19. The golf club head of claim 16, wherein the club head includes a breadth that ranges from approximately 115 mm to approximately 118 mm.

20. The golf club head of claim 16, wherein the golf club head has a volume of 400 cc or greater and a club breadth-to-face length ratio of 0.90 or greater.

21. The golf club head of claim 16, wherein the heel has an airfoil surface in a forward portion of the heel.

22. The golf club head of claim 16, wherein a substantially U-shaped, concave groove is provided between the relatively round rear-side edge of the crown and the relatively square rear-side edge of the sole.

23. A golf club comprising:

a shaft; and the golf club head according to claim 16, wherein the golf club head is secured to a first end of the shaft.

* * * * *